US005831580A

United States Patent [19]

Taniguchi et al.

[11] Patent Number: 5,831,580

[45] Date of Patent: Nov. 3, 1998

[54] SLOT ANTENNA HAVING A SLOT PORTION FORMED IN A VEHICLE MOUNTED INSULATOR

[75] Inventors: Tatsuaki Taniguchi, Hiroshima-ken; Eiichi Yamamoto, Hatsukaichi, both of Japan

[73] Assignee: Mazda Motor Corporation, Hiroshima-ken, Japan

[21] Appl. No.: 781,925

[22] Filed: Dec. 30, 1996

Related U.S. Application Data

[63] Continuation of Ser. No. 362,787, Dec. 23, 1994, abandoned.

[30] Foreign Application Priority Data

Dec. 29, 1993 [JP] Japan ..... 5-351186

[51] Int. Cl.[6] ..... H01Q 1/32

[52] U.S. Cl. ..... 343/713; 343/711; 343/767

[58] Field of Search ..... 343/713, 704, 343/767, 768, 770, 711, 712; H01Q 1/32

[56] References Cited

U.S. PATENT DOCUMENTS

| | | | |
|---|---|---|---|
| 4,768,037 | 8/1988 | Inaba et al. | 343/713 |
| 4,791,426 | 12/1988 | Lindenmeier et al. | 343/713 |
| 4,849,766 | 7/1989 | Inaba et al. | 343/713 |
| 4,864,316 | 9/1989 | Kaoru et al. | 343/713 |
| 5,005,020 | 4/1991 | Ogawa et al. | 343/713 |
| 5,012,255 | 4/1991 | Becker | 343/713 |
| 5,231,410 | 7/1993 | Murakami et al. | 343/713 |
| 5,355,144 | 10/1994 | Walton et al. | 343/713 |
| 5,610,618 | 3/1997 | Adrian et al. | 343/713 |

FOREIGN PATENT DOCUMENTS

| | | | |
|---|---|---|---|
| 367225 | 5/1990 | European Pat. Off. | 343/713 |
| 59-196606 | 11/1984 | Japan | 343/713 |
| 63-92409 | 6/1988 | Japan . | |
| 63-292702 | 11/1988 | Japan | H01Q 1/32 |
| 2-170702 | 7/1990 | Japan . | |

*Primary Examiner*—Hoanganh T. Le

[57] ABSTRACT

A conductor is mounted on the window glass of a vehicle in a manner that allows a slot portion between the conductor and the body. A space is allowed within the conductor, and a defogger is mounted within the space. The conductor and the body are fed. This arrangement constitutes a simple structured vehicular slot type antenna on the window glass. The area of the conductor may be reduced by taking advantage of the rear defogger as a conductor.

25 Claims, 57 Drawing Sheets

FRONT SIDE
II
III
-40 -20 0
88MHz

FRONT SIDE
-40 -20 0
89MHz

FRONT SIDE
-40 -20 0
90MHz

FRONT SIDE
-40 -20 0
90.5MHz

FRONT SIDE
-40 -20 0
92MHz

FRONT SIDE
-40 -20 0
93MHz

FRONT SIDE
-40 -20 0
94MHz

FRONT SIDE
-40 -20 0
95MHz

FRONT SIDE
-40 -20 0
96.2MHz

FRONT SIDE
-40 -20 0
97MHz

FRONT SIDE
-40 -20 0
98MHz

FRONT SIDE
-40 -20 0
99MHz

FRONT SIDE
-40 -20 0
100MHz

FRONT SIDE
-40 -20 0
101MHz

FRONT SIDE
-40 -20 0
102MHz

FRONT SIDE
-40 -20 0
103MHz

FRONT SIDE
-40 -20 0
104MHz

FRONT SIDE
-40 -20 0
105MHz

FRONT SIDE
-40 -20 0
106MHz

FRONT SIDE
-40 -20 0
107MHz

FRONT SIDE
-40 -20 0
108MHz

FRONT SIDE
I
II
III
76MHz
78MHz
80MHz
82MHz
84MHz
86MHz
88MHz
90MHz
92MHz
94MHz
96. 2MHz
98MHz
100MHz
102MHz
104MHz
106MHz
108MHz
110MHz
0
-20
-40

FRONT SIDE
I
II
III
-40
-20
0
76MHz
78MHz
80MHz
82MHz
84MHz
86MHz
88MHz
90MHz
92MHz
94MHz
96. 2MHz
98MHz
100MHz
102MHz
104MHz
106MHz
108MHz
110MHz

FIG.86
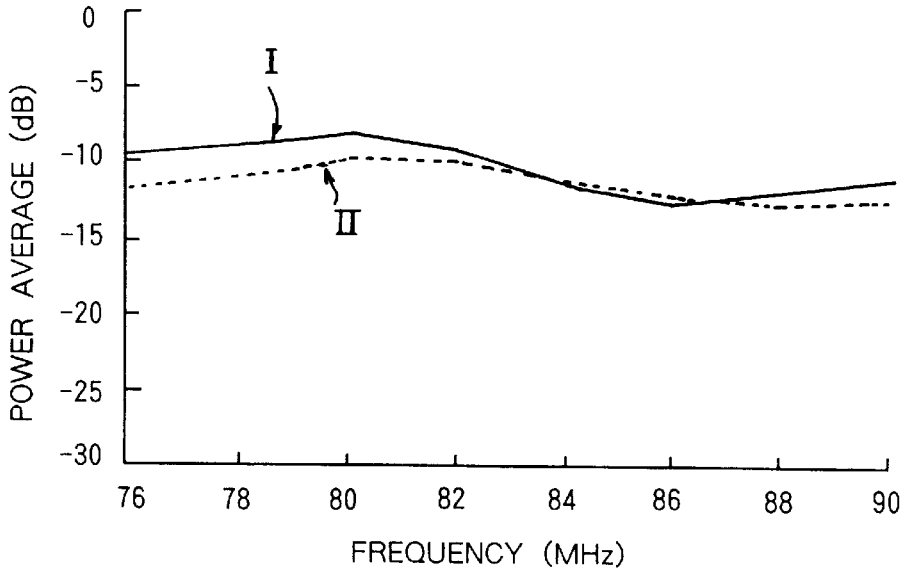
FIG. 87A FIG. 87B FIG. 87C FIG. 87D
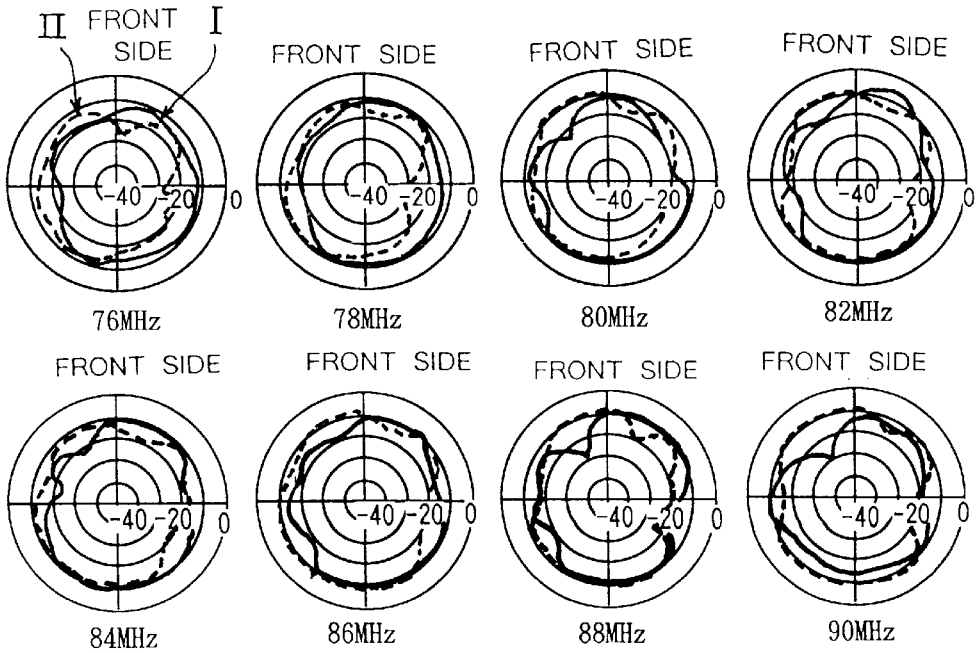
FIG. 87E FIG. 87F FIG. 87G FIG. 87H

SLOT ANTENNA HAVING A SLOT PORTION FORMED IN A VEHICLE MOUNTED INSULATOR

This application is a continuation of application Ser. No. 08/362,787, filed Dec. 23, 1994, now abandoned.

BACKGROUND OF THE INVENTION

1. Field of the Invention

The present invention relates to an insulator for use in a vehicle, a vehicular antenna made of that insulator and a setting of that antenna.

2. Description of the Related Art

Widely known as a vehicular antenna is a rod antenna which is typically projected from the body of a vehicle in a manner that assures insulation between the rod antenna and the vehicle body. However, the rod antenna is not only subject to bending and breaking damage, but also is piping when the vehicle is running fast. As an alternative, a glass antenna has been in widespread use.

In a typical glass antenna, an electric current is fed to an antenna wire that is mounted alongside of a defogger disposed in the window glass of a vehicle as disclosed in Japanese Utility Model Application No. 63-92409.

Japanese Patent Application Laid-open No. 2-170702 has separately disclosed a slot type antenna (referred to as "slot antenna", hereinafter) wherein a slot of a shape similar to that of the antenna wire is formed in a conductor member disposed on the vehicle body, and current is fed across both conductor terminals of the slot.

To manufacture the above conventional slot antenna, however, a part of the body, for example, a trunk lid is entirely made of resin to obtain insulation. The trunk lid is provided with slots which receive respectively an outer conductor member and an inner conductor member. Each of the slots is separately fed. The construction of such antenna is complex, and results in a complex arrangement.

SUMMARY OF THE INVENTION

In view of the above problem, the present invention has been developed. It is an object of the present invention to provide a simplified construction and improved receiving performance in a slot antenna by forming a slot portion of the slot antenna in an insulator mounted in an opening of a vehicle body for closing the opening.

To achieve the above object according to the present invention, a slot is formed between the body of a vehicle and a conductor on the insulator that is disposed so as to close an opening of a vehicle body, and a current is fed to the conductor and the body.

Specifically, the insulator according to the present invention is fitted in the opening of the vehicle body, and comprises the conductor that defines a slot portion relative to the body, the slot portion forming a slot antenna as a vehicle-mounted antenna.

In the antenna according to the present invention, the slot portion is formed between the vehicle body having the opening into which the insulator is fitted and the conductor mounted on the insulator, a feeder line is connected to the conductor and the body to allow the slot portion to have radio wave emission function.

The conductor is mounted on the vehicle insulator fitted into the opening of the vehicle body, and the conductor defines the slot portion that is formed relative to the body, the slot portion forming a slot antenna as a vehicle-mounted antenna, the feeding is performed to the vehicle body and the conductor of the insulator. A slot antenna is thus formed between the conductor and the body. The slot antenna thus constructed offers a simple structure.

A vehicle mounted-antenna according to the present invention comprising:

a conductor mounted on the glass of a vehicle; and a slot portion formed between the conductor and the body of the vehicle, wherein feeding is performed to both the conductor and the body.

A slot antenna thus constructed has a slot portion as an antenna between the body of the vehicle and the conductor on the glass as the insulator. The slot antenna offers a simple structure.

According to a preferred embodiment of the present invention, the conductor is constructed of an equivalently uniform conductor. If the conductor is equivalently uniform, the area of the conductor may be reduced, and a defogger may be used as a conductor that constitutes part of the slot antenna.

According to a preferred embodiment of the present invention, the conductor has a space therein available for mounting a defogger, and the conductor is capacitively coupled to the defogger. This arrangement causes the defogger to function as conductor, allowing the area of the conductor itself to be reduced.

According to a preferred embodiment of the present invention, a capacitor of a predetermined capacitance is coupled between the defogger and the conductor. In AM band, the conductor around the defogger functions as an antenna, increasing receiving sensitivity of the antenna.

According to a preferred embodiment of the present invention, a choke coil is coupled to the defogger. The defogger is isolated from the conductor and becomes equivalently uniform conductor. The defogger may be used as an AM band receiving antenna, increasing receiving sensitivity of the antenna.

According to a preferred embodiment of the present invention, a coil is coupled between the defogger and the conductor. The coil serves impedance matching purposes.

According to a preferred embodiment of the present invention, a capacitor having a capacitance equal to or smaller than a predetermined value is coupled between the junction of the choke coil with the defogger and ground. The state that the antenna made of the defogger is excluded is recovered while keeping the receiving sensitivity characteristic of the slot antenna. The receiving sensitivity of the antenna made of the conductor is increased.

According to a preferred embodiment of the present invention, part of the conductor is used as a sunshade. Without a dedicated sunshade, the conductor screens sunlight.

According to a preferred embodiment of the present invention, the conductor is provided with a space or a cutout that accommodates a mobile telephone antenna. This arrangement alleviates mounting position limitation on the mobile telephone antenna.

According to a preferred embodiment of the present invention, a slit is formed on the conductor. The slit discontinues the slot portion, resulting in an increased receiving sensitivity of the slot antenna.

According to a preferred embodiment of the present invention, the slit has a predetermined width. The length of the slot determined by the width of the slit adjusts the receiving frequency band of the slot antenna.

According to a preferred embodiment of the present invention, a feeding point is set to the top portion of the conductor.

According to a preferred embodiment of the present invention, by changing the slot in position on the conductor, a maximum receiving sensitivity frequency of the antenna is set. Tuning of the antenna is facilitated.

According to a preferred embodiment of the present invention, by changing the width of the slot, a maximum receiving sensitivity frequency of the antenna is set. Tuning of the antenna is facilitated.

According to a preferred embodiment of the present invention, the feeding point of the antenna is set to the top portion of the conductor. Receiving sensitivity characteristic is thus improved.

According to a preferred embodiment of the present invention, the feeding point is set to a position diagonally opposite from the slit on the conductor. The antenna directivity pattern is thus symmetrical with respect to the center of the conductor transversely across the conductor. Receiving sensitivity characteristic of the antenna is improved while keeping the directivity pattern good.

According to a preferred embodiment of the present invention, the feeding point is set to the upper end of the conductor at the slit, and thus an improved receiving characteristic of the antenna results.

According to a preferred embodiment of the present invention, a plurality of feeding points are set. A single antenna can be used as a plurality sorts of antenna.

According to a preferred embodiment of the present invention, a plurality of feeding points are set to symmetrical positions on the conductor transversely across the conductor to constitute a diversity antenna. The directivity pattern of the diversity antenna can thus be made use of.

According to a preferred embodiment of the present invention, the feeding point is set on the conductor near the junction where the capacitor is connected to the conductor. Improved antenna receiving characteristic thus results.

According to a preferred embodiment of the present invention, an ungrounded antenna associated with a transformer is disposed within the slot portion, and the slot antenna is connected to the feeder side of the secondary coil of the antenna. The ungrounded antenna can thus be connected to the grounded antenna. The position of the transformer is selected at will.

According to a preferred embodiment of the present invention, the upper portion of the conductor is a more equivalently uniform conductor than the lower portion of the conductor. An improved directivity of the antenna thus results.

According to a preferred embodiment of the present invention, the defogger is provided with shorting bars. An improved antenna receiving sensitivity thus results.

These and other advantages will become more apparent when the following detailed description of the invention is considered with the drawings.

BRIEF DESCRIPTION OF THE DRAWINGS

FIG. 41 shows a vertically polarized wave directivity pattern on a receiving frequency range of 88 MHz to 108 MHz.

FIG. 86 shows a horizontally polarized wave receiving sensitivity characteristic of the slot antenna in FIG. 11A, wherein the feeding points are set to both the top-left and top-right corners of the conductor loop.

FIG. 87 shows a horizontally polarized wave receiving sensitivity characteristic of the slot antenna setting corresponding to FIG. 86.

DETAILED DESCRIPTION OF THE PREFERRED EMBODIMENTS

Figure 1:
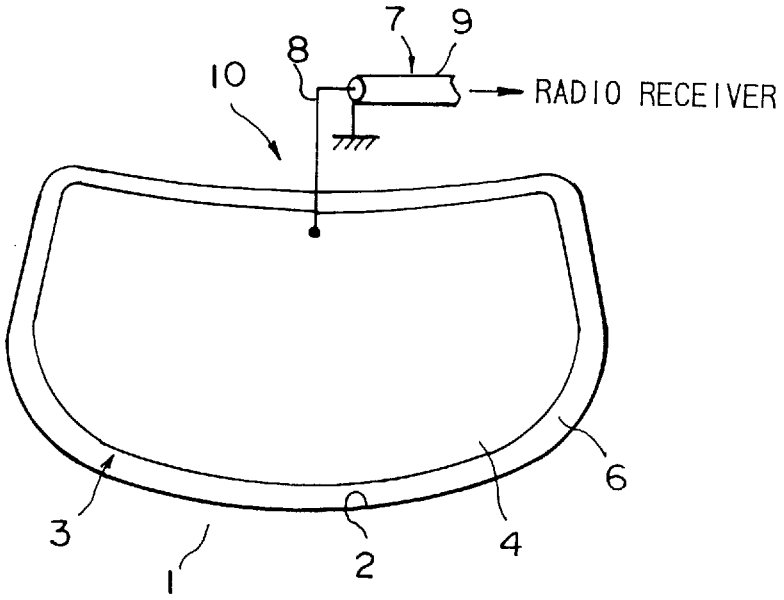
FIG. 1 shows a rear window glass of a vehicle viewed from backward.

Referring now to the drawings, the embodiments of the present invention are discussed. The terms "left-hand side", "right-hand side", "top side", and "bottom side" refer to respective relative positions of a vehicle body.

Embodiment 1

Figure 3:
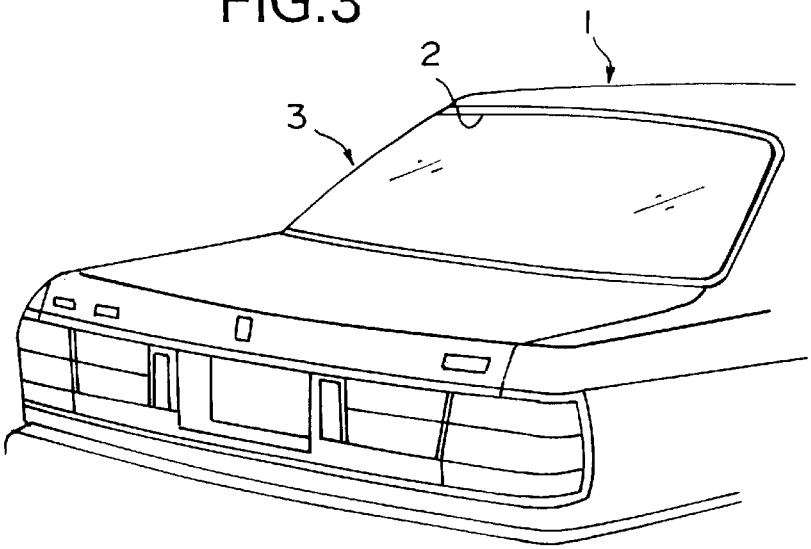
FIG. 3 is a perspective view showing the rear portion of a vehicle according to a first embodiment of the present invention.

FIG. 3 shows the rear portion of a vehicle according to a first embodiment of the present invention. Designated 1 is the vehicle body having an opening as a rear window 2 in its rear portion. The rear window 2 is fitted with a rear window glass 3 (hereinafter referred to as simply "window glass"), which keeps the opening air sealed substantially.

Figure 2:
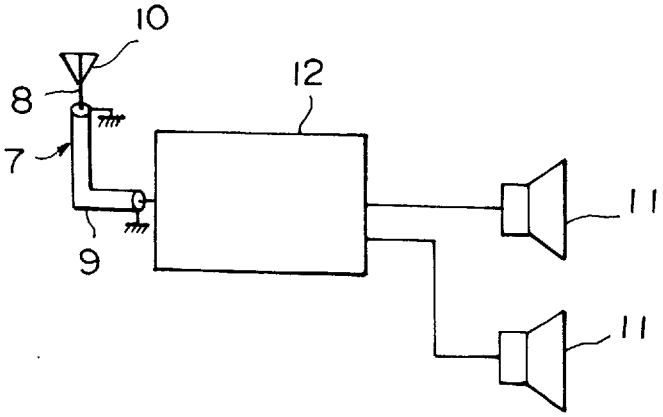
FIG. 2 is a schematic diagram showing the connection of an antenna to a car radio.

As shown in FIG. 1, a transparent film-like conductor 4 (as an inner conductor member) is attached to the inner surface of the window glass 3 around the rim portion of the rear window 2, with a slot portion (gap) 6 of a predetermined width kept to the body 1. A feeder line 8 at one end of a coaxial feeder 7 is connected to the conductor 4 at its top center position across the rear window 2. The shield 9 of the coaxial feeder 7 at the one end is grounded to the body 1 (as an outer conductor member) at the top center position across the rear window 2. A "slot type antenna" (referred to as "slot antenna", hereinafter) 10 having a slot portion 6 is thus constructed. As shown in FIG. 2, the other end of the coaxial feeder 7 is connected to a tuner of a mobile radio receiver 12, and the tuner outputs an audio signal to speakers 11, 11.

In the above embodiment, the film-like conductor 4 is disposed on the vehicle rear window glass 3 with the slot portion 6 formed between the conductor 4 and the body 1, and the feeder line 8 of the coaxial feeder 7 is connected to the conductor 4 to feed a current to the conductor 4 and the body 1. The slot antenna 10 is thus formed by making use of, as antenna, the slot portion 6 between the body 1 and the conductor 4 on the glass 3 as an insulator. This slot antenna is a simple antenna made up of the conductor 4 as an inner conductor member and the vehicle body 1 as an outer conductor member.

The slot antenna 10 thus constructed offers an improved receiving sensitivity characteristic (chiefly including antenna gain), compared with the conventional glass antenna.

By adjusting the width of the slot portion 6, the receiving sensitivity characteristic of the antenna 10 is easily changed, and the tuning of the vehicle antenna is easily performed.

Embodiment 2

Figure 4:
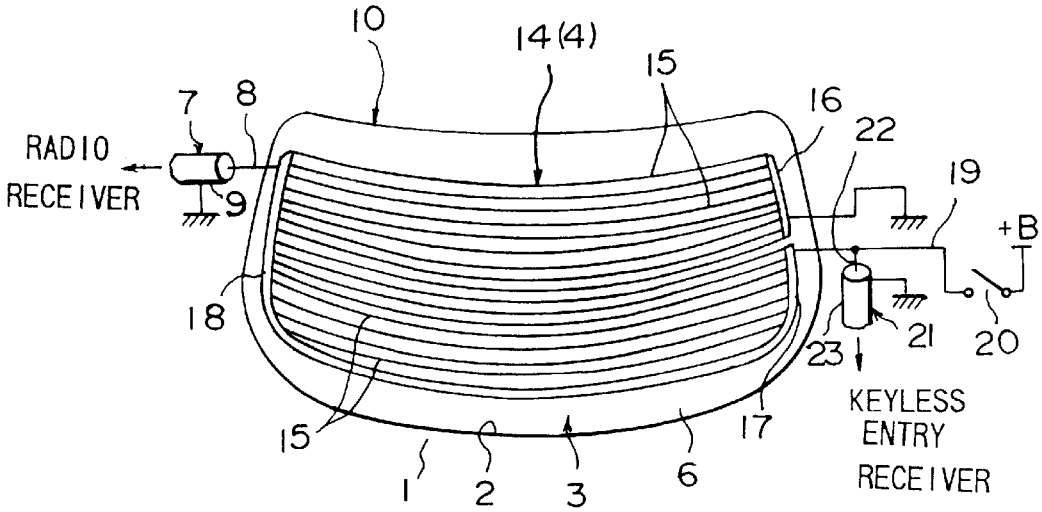
FIG. 4 shows, in the same orientation as in FIG. 1, a second embodiment of the present invention.

FIG. 4 shows a second embodiment according to the present invention. In the second embodiment, components equivalent to those described with reference to FIG. 1 are designated with the same reference numerals, and their description is skipped. In the first embodiment, a dedicated film-like conductor 4 is attached onto the window glass. In the second embodiment, a rear defogger for defogging the window glass 3 is used as a conductor.

In the second embodiment, a rear defogger 14 is disposed onto the inner surface of the window glass 3, with a slot 6 formed between the rim portion of the window 2 and the body 1. The defogger 14 has two sets of plurality of heater wires (hot wires) 15, 15 extending transversely across the width of the vehicle. The heater wires of the upper set are connected together to a split bus bar 16 at their ends on one side (right-hand side), and the heater wires of the lower set are connected together to a split bus bar 17 at their ends on said one side (right-hand side). All the heater wires 15, 15 are connected together to a common bus bar 18 at their ends on the other side (left-hand side) as a folded point. The bottom end of the upper split bus bar 16 is grounded to the body 1, and this grounding point also works as the one for the defogger 14. The top end of the lower split bus bar 17 is connected to the positive power supply side of a car battery (not shown) via a harness 19 and a switch 20. When the switch 20 is set to ON, electric power is supplied to each heater wire 15 of the defogger 14 to heat it, and resulting heat generation defogs the window glass 3.

The feeder line 8 of the coaxial feeder 7, which is routed to a radio receiver (not shown), is connected to the top end of the common bus bar 18 of the defogger 14 (in a folded feeding method). The shield 9 of the coaxial feeder 7 at the antenna 10 side is grounded to the body 1 in the vicinity of the common bus bar 18.

In the harness 19 connected to the upper end of the lower split bus bar 17, the one end of a feeder line 22 of another coaxial cable 21 is connected to the harness 19 at a point a predetermined length (10 cm, for example) apart from the junction where the harness 19 is connected to the lower split bus bar 17 (for positive current feeding). The other end of the feeder line 22 is connected to a keyless entry receiver (not shown). The keyless entry receiver receives from outside a radio signal which activates an actuator for switching between locking and unlocking the vehicle doors. The shield 23 of the coaxial feeder 21 at the one end is grounded to the body 1 in the vicinity of the split bus bar 16.

In the second embodiment as described above, the defogger 14 is disposed along the rim of the window glass 3 with the slot portion 6 kept between the defogger 14 and the body 1. The heater wires 15, 15 and bus bars 16 through 18 function as an uniform conductor equivalent to the conductor 4 of the first embodiment. Consequently, the slot portion 6 is thus constructed between the defogger 14 and the body 1. The slot antenna 10 similar to the first embodiment is thus formed using an existing defogger 14.

In the second embodiment, both the common bus bar 18 and the split upper bus bar 16 work as feeding points for the defogger 14 that constitutes the slot antenna 10. Namely, since two feeding points are available, a single slot antenna 10 may be shared by the radio receiver and the keyless entry receiver.

Embodiment 3

Figure 5:
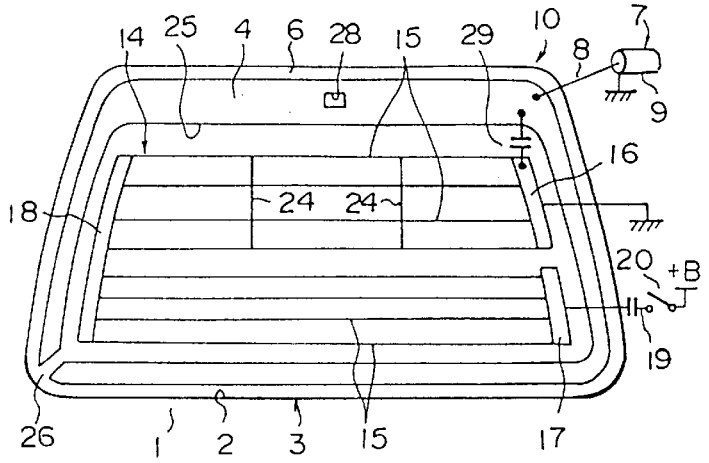
FIG. 5 shows, in the same orientation as in FIG. 1, a third embodiment of the present invention.

FIG. 5 shows an third embodiment of the present invention. As in the first embodiment, an opaque film conductor 4 is mounted on the inner surface of the window glass 3 with a slot portion allowed between the opaque film conductor 4 and the body 1. The conductor 4 makes a loop around the rim of the window glass 3, and no conductor portion is provided in a space 25 surrounded by the loop. The bottom horizontal portion, right-hand vertical portion and left-hand vertical portion of the conductor 4 have the same width, while the top horizontal portion of the conductor 4 has a width wider than the above remaining portions. The wide top horizontal portion of the conductor 4 functions as a sunshade. A slit 26 is formed by cutting partly the loop conductor 4 at a left-bottom corner thereof. The feeder line 8 of the coaxial feeder 7 is connected to the conductor 4 at its top-right corner which is diagonally opposite from the slit 26, and the shield 9 of the coaxial feeder 7 is connected to the body 1 in the vicinity of this feeding point.

A blank space 28 is formed in the top horizontal portion of the conductor 4 at its center transversely across the width of the window glass 3 by partially removing the conductor 4. This blank space 28 serves as an installation space for mobile telephone antenna (not shown).

A defogger 14 is centrally disposed in the space 25 within the loop conductor 4. This defogger 14 is essentially identical to the one described with reference to the second embodiment. Components equivalent to those in FIG. 4 are designated with the same reference numerals, and their description is skipped. Heater wires 15, 15 horizontally extended between an upper split bus bar 16 and a common bus bar 18 are connected together in their midway by a plurality of vertically extending conductor wires (two wires in FIG. 5) 24, 24.

A capacitor 29 functioning as a filter couples the top end of the upper split bus bar 16, disposed on the right-hand side of the window glass 3 and grounded to the body 1, to the top-right corner of the conductor 4, namely the feeding point of the antenna 10. The capacitor 29 thus capacitively couples the conductor 4 to the defogger 14.

According to the third embodiment, the conductor 4 forms therein the space 25 within which the defogger 14 is disposed. The defogger 14 functions as a conductor, and thus the conductor 4 in combination with the defogger 14 functions integrally and equivalently with the conductor 4 as a uniform conductor. By allowing the defogger 14 to function as part of the conductor of the antenna, the space of the conductor 4 itself is reduced, while increasing the receiving sensitivity characteristic of the antenna 10.

The plurality of conductor wires 24, 24 are extended vertically between the upper split bus bar 16 and the common bus bar 18 in the defogger 14, namely on the upper portion of the defogger 14. This effect, along with the wide top horizontal portion of the conductor 4, allows the upper portion of the conductor 4 including the defogger 14 to function as a more equivalent and uniform conductor than the lower portion of the conductor 4. As a result, directivity and performance of the antenna 10 is improved.

Since the capacitor 29 is connected between the defogger 14 and the conductor 4, the conductor 4 that surrounds the defogger 14 makes the antenna 10 function as an antenna in the AM band reception. Thus, an improved receiving sensitivity characteristic is obtained.

The top horizontal portion of the conductor 4 includes the blank space 28 for mobile telephone antenna, and thus no additional installation space outside is required.

The slit 26 disposed at the bottom-left corner of the conductor 4 discontinues the slot portion 6 there, resulting in an improved receiving sensitivity characteristic of the slot antenna 10.

The slit 26 has a predetermined width across it. Changing the width of the slit 26 changes the length of the slot portion 6. As a result, the receiving frequency band of the slot antenna 10 is adjusted at will.

The feeding point of the antenna 10 is disposed at the top of the conductor 4. Furthermore, the feeding point is set close to the junction of the conductor 4 with the capacitor 29 that couples the conductor 4 to the defogger 14. As a result, the receiving sensitivity characteristic of the antenna 10 is even further improved.

Since the feeding point is situated diagonally opposite from the slit 26 at the bottom-left corner of the conductor 4, a directivity characteristic pattern of the antenna 10 is symmetrical in view of left-right relationship. Thus, directivity improvement is sought while improving receiving sensitivity.

The top horizontal portion of the conductor 4, wider than the rest of the conductor 4 portions, makes a sunshade. No extra sunshade is required. Thus, the conductor 4 works as a shade for screening out sunlight.

Alternate Example of Embodiment 3

In the third embodiment, the blank opening 28 for mobile telephone antenna disposed in the conductor 4 does not have to be always positioned to the center transversely across the conductor 4. Other position is also perfectly acceptable. Also, instead of the blank space 28 within the conductor 4, a cutout portion of the conductor 4 may be formed by cutting the conductor 4 from its edge.

Rather than for mobile telephone application, the blank space 28 may be used for other purposes such as for installing a variety of sensors or electronics such as high-mounted stop lamps. The blank space 28 may be used simply as a window.

In FM frequency band, the conductor 4 may be grounded to the body 1. By setting the capacitor 29 to a predetermined capacitance value (100 pF, for example), the conductor 4 may be put into a grounded state in the FM band region. In AM frequency band, the defogger 14 is set floated relative to the conductor 4. As a result, the slot portion 6 serves as an antenna for FM frequency band, and the conductor 4 serves to receive an AM frequency band.

Figure 5A:
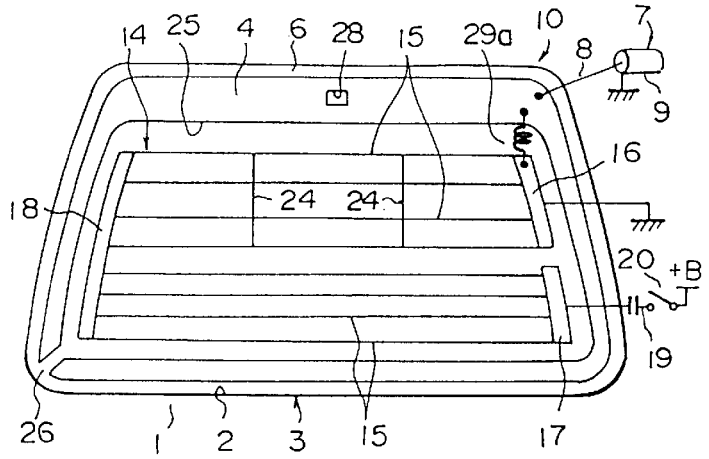
FIG. 5A shows a modification of the third embodiment of the present invention shown in FIG. 5.

In the above embodiment, the conductor 4 is capacitively coupled to the defogger 14 via the capacitor 29. Alternatively, both may be coupled by any other means, for example, by narrowing the gap between both or by permitting direct connection between both. When the conductor 4 is directly connected to the defogger 14, the conductor 4 is preferably connected to the upper split bus bar 16 of the defogger 14 that is grounded to the body 1. Furthermore, as an alternative to the capacitor 29, as shown in FIG. 5A, a coil 29*a* may be used to couple the conductor 4 to the defogger 14. In this case, the coil may be used for impedance matching correction purposes. The coil is preferably connected to the bus bar 16 of the defogger 14 that is grounded to the body 1.

Figure 6:
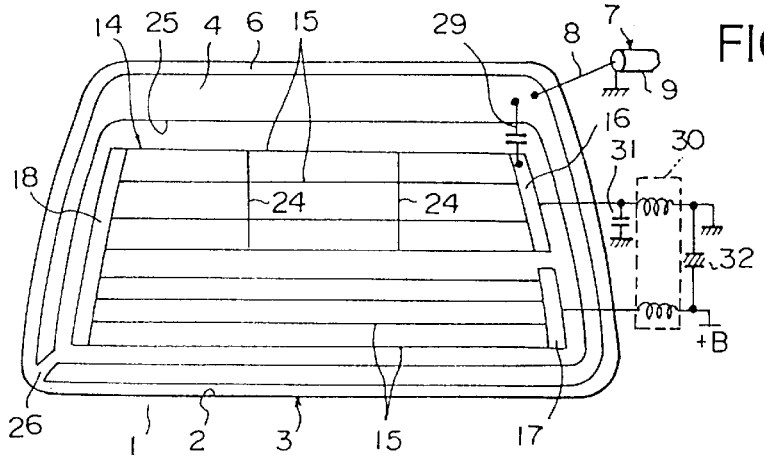
FIG. 6 shows, in the same orientation as in FIG. 1, an alternate example of the second embodiment where choke coils are coupled between a defogger and the power supply of a battery and between the body of the vehicle and ground.

As shown in FIG. 6, choke coils 30 may be connected between the defogger 14 and the power supply of the battery and the body 1. A capacitor 31 (several 100 pF) may be connected between the junction of the defogger 14 with the choke coils 30 and ground.

Since the defogger 14 is connected to the choke coils 30, the defogger 14 is isolated from the conductor 4 in high frequency region and functions as a uniform conductor equivalently with the conductor 4. The defogger 14 may be used as an AM frequency band antenna, providing an improved sensitivity characteristic.

The capacitor of a predetermined capacitance or smaller is connected between the junction of the choke coils 31 with the defogger 14 and ground, and the conductor 4, with the defogger 14 excluded as part of the antenna, thus results in an improved sensitivity characteristic of the slot antenna 10.

In the above embodiments, the slit 26 is formed at the bottom-left corner of the conductor 14. The slit 26 is not limited to this position. It is important to cut a slit 26 in the conductor 4. By shifting the slit 26 in position within the conductor 4, the frequency of maximum sensitivity characteristic may be changed and the tuning of the antenna 10 may be facilitated.

Figure 7:
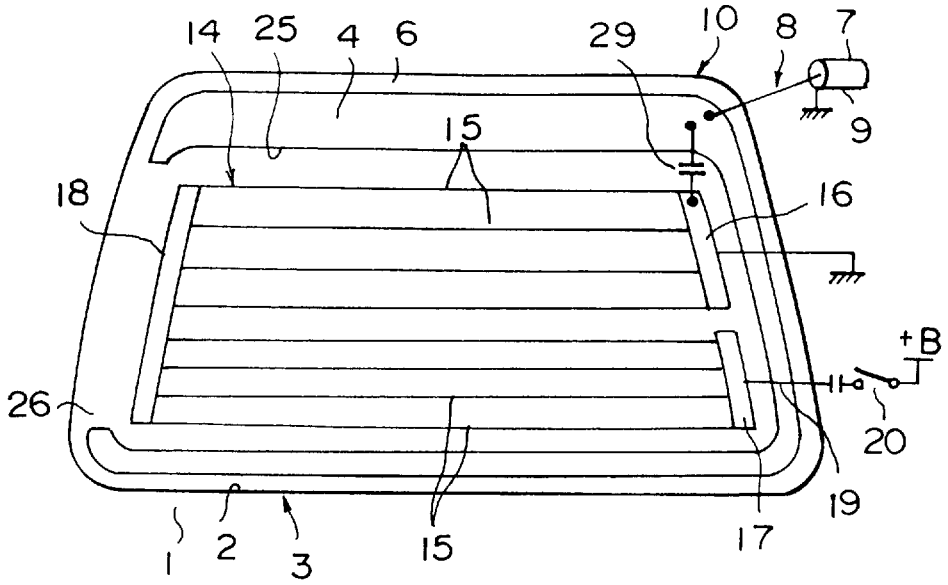
FIG. 7 shows, in the same orientation as in FIG. 1, a horizontally oriented U-shaped conductor as an alternate example.
Figure 8:
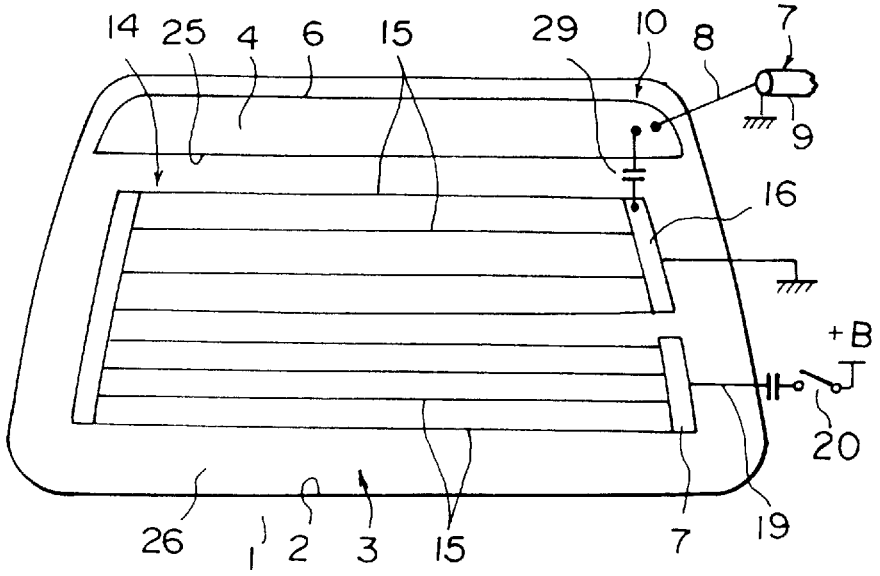
FIG. 8 shows, in the same orientation as in FIG. 1, an alternate example where the conductor is made of the upper portion of the defogger only.

The width of the slit 26 may be changed. As shown in FIG. 7, the slit 26 is expanded by removing either of left-hand vertical portion and right-hand vertical portion (the left-hand vertical portion removed in FIG. 7), and the conductor 4 is thus a horizontally oriented U-shape configuration. Alternatively, as shown in FIG. 8, the slit 26 may be so expanded that only the top horizontal portion only remains as the conductor 4. In this latter case, the defogger 14 is capacitively coupled to the top horizontal portion of the conductor 4.

Figure 9:
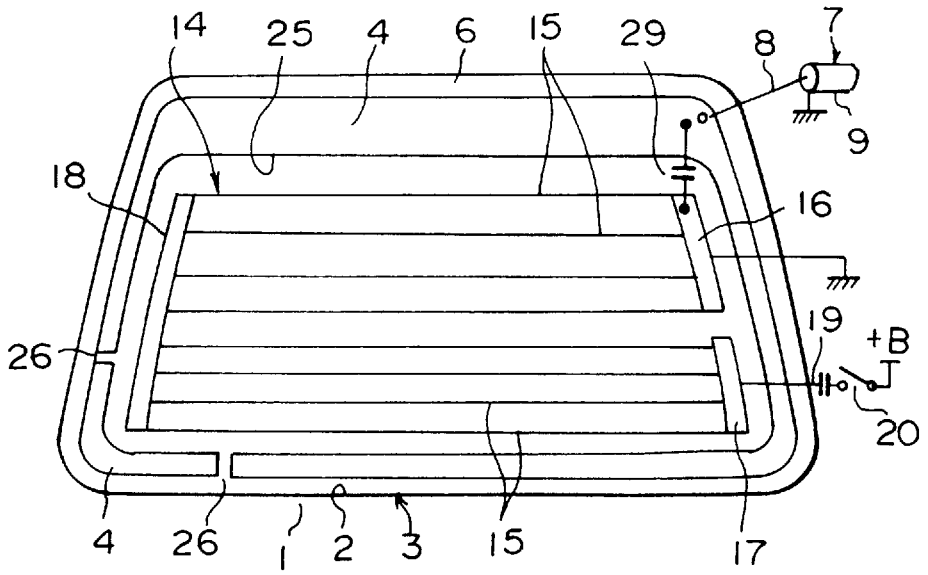
FIG. 9 shows, in the same orientation as in FIG. 1, an alternate example where two slits are formed on the conductor.

In FIG. 9, two slits 26, 26 are cut on the conductor 4 with a predetermined length between the two allowed. This arrangement presents the same receiving performance as the one in which the predetermined length between the two slits 26, 26 is entirely removed. This arrangement therefore presents the same effect as the change of the width across the slit 26. Namely, the gaps in the form of slit on the conductor 4 near the bottom-left corner of the window glass 3 can be made less noticeable and such slits are thus preferred in an aesthetic point of view.

The feeding point to the conductor 4 may be changed from the top-right corner of the conductor to somewhere along the top horizontal portion of the conductor 4, for example to the center point transversely across the conductor 4. Alternatively, the feeding point may be set to the upper end of the conductor 4 at the slot 26 to achieve an improved receiving performance.

Furthermore, a plurality of feeding points may be set to the conductor 4. For example, two feeding points may be symmetrically set, one for the top-right corner and the other for the top-left corner of the conductor 4. A diversity antenna is constituted by feeding the antenna at a plurality of feeding points, considering the directivity pattern of the antenna.

Embodiment 4

Figure 10:
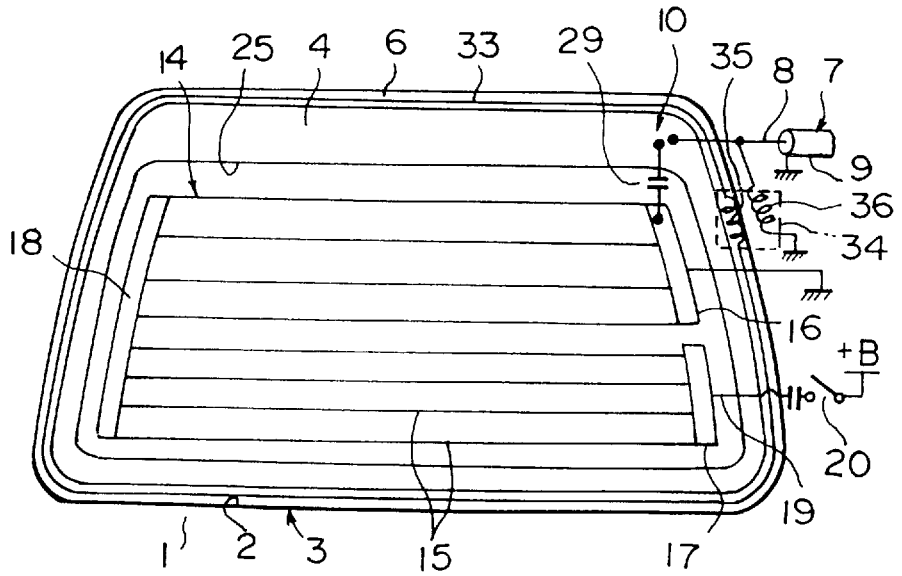
FIG. 10 shows a fourth embodiment in the same orientation as in FIG. 1.

FIG. 10 shows a fourth embodiment of the present invention, wherein an ungrounded loop antenna is formed.

In this embodiment, an AM ungrounded loop antenna 33 is formed in a slot portion 6 between the conductor 4 and the body 1 around the rim portion of the window glass 3, in a manner that the loop antenna 33 surrounds the conductor 4. The loop antenna 33 is connected to a grounded radio receiver (not shown) via balanced-to-unbalanced transformer 34 and a coaxial feeder 7. The balanced-to-unbalanced transformer 34 contains primary and secondary coils 35, 36. The primary coil 35 connects both end of the loop antenna 33 in a manner that the loop antenna 33 and the primary coil 35 in series connection constitute a loop. The one end of the secondary coil 36 is connected to the feeder line 8 (as an inner conductor) of the coaxial feeder 7 of which shield 9 is grounded to the body 1. The other end of the secondary coil 36 is connected to the top-right corner of the conductor 4.

In the transformer 34, the primary coil 35 and the secondary coil 36 are different in their number of turns. The number of turns of the secondary coil 36 is greater than that of the primary coil 35, and turn ratio is 2 to 3 (turn ratio of the primary and secondary coils 35, 36 is 1:2 to 1:3).

In this embodiment, the loop antenna 33 picks up AM radio wave in the form of current signal, and the current signal is converted into a voltage signal by the transformer 34, and the voltage signal is sent to the radio receiver (not shown) via the feeder line 8 of the coaxial feeder 7.

The loop antenna 33 is coupled to the grounded radio receiver via the transformer 34, and the secondary coil 36 of the transformer 34 is connected to the grounded radio receiver and thus grounded through the radio receiver. The primary coil 35 is electrically insulated from the secondary coil 36. Even if the secondary coil 36 is grounded through the radio receiver, the loop antenna 33 remains ungrounded. Namely, the loop antenna 33 is coupled to the grounded radio receiver without grounding the loop antenna 33. The ungrounded loop antenna 33 disposed on the window glass 3 is easily adaptable to the grounded receiver system, and an increased gain is obtained.

In the fourth embodiment, the ungrounded loop antenna 33 is coupled to the grounded slot antenna 10. This arrangement is obtained by disposing the loop antenna 33 with the transformer 34 as an ungrounded antenna in the slot portion 6 of the slot antenna 10 and by connecting the feeder side of the secondary coil 36 of the transformer 34 to the conductor 4 as the feeder side of the slot antenna 10. Since the conductor 4 is fed, it is possible to change the position of the transformer 34. As a result, by changing the position of the transformer 34, an increased sensitivity characteristic in the AM band results.

The fourth embodiment employs the loop antenna 33 as an ungrounded antenna. Other type of ungrounded antenna is acceptable instead of the loop antenna 33.

Test Data

Test data for each embodiment and alternative examples above described is now discussed. The test data includes antenna gain versus frequency data relative to the gain of the dipole antenna as a standard antenna.

FIG. 11B through FIG. 14 show receiving sensitivity characteristic of a slot antenna wherein a complete loop conductor without a slit is disposed on the window glass as described with reference to the fourth embodiment (FIG. 10) (or of a slot antenna shown in FIG. 11A).

Figure 11A:
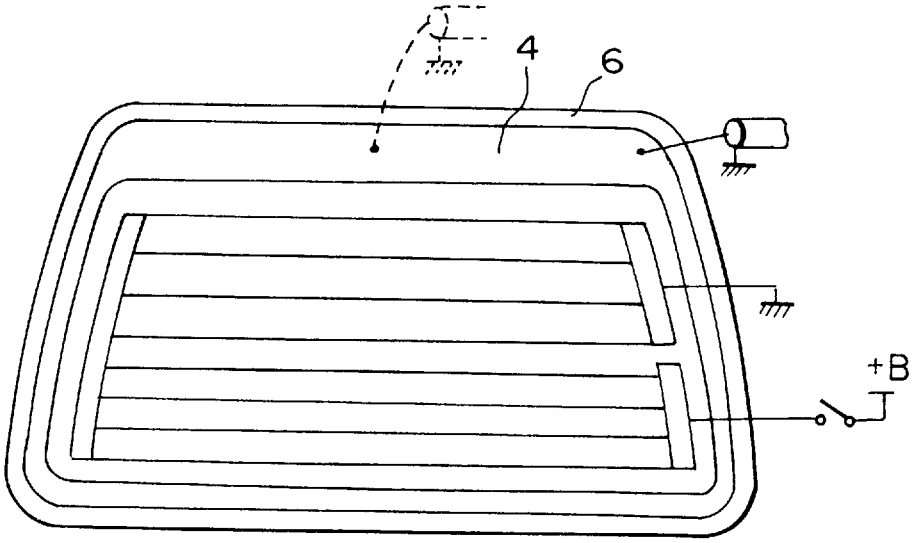
FIG. 11A shows a setting of the slot antenna that resulted in the test data presented in FIG. 11B and FIG. 12.
Figure 11B:
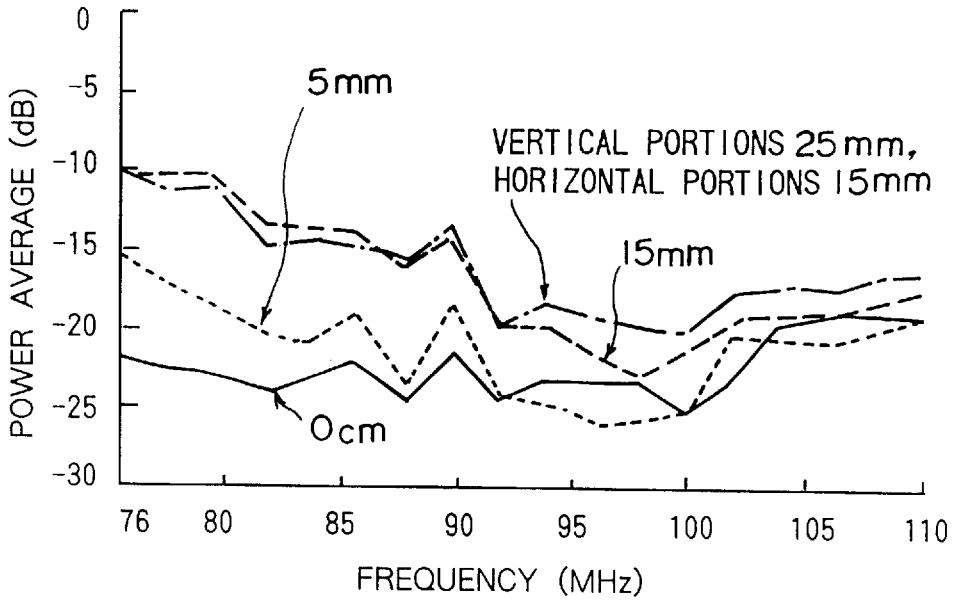
FIG. 11B shows a horizontally polarized wave receiving sensitivity characteristic of the slot antenna in FIG. 11A, wherein the width of the slot portion was varied.
Figure 12:
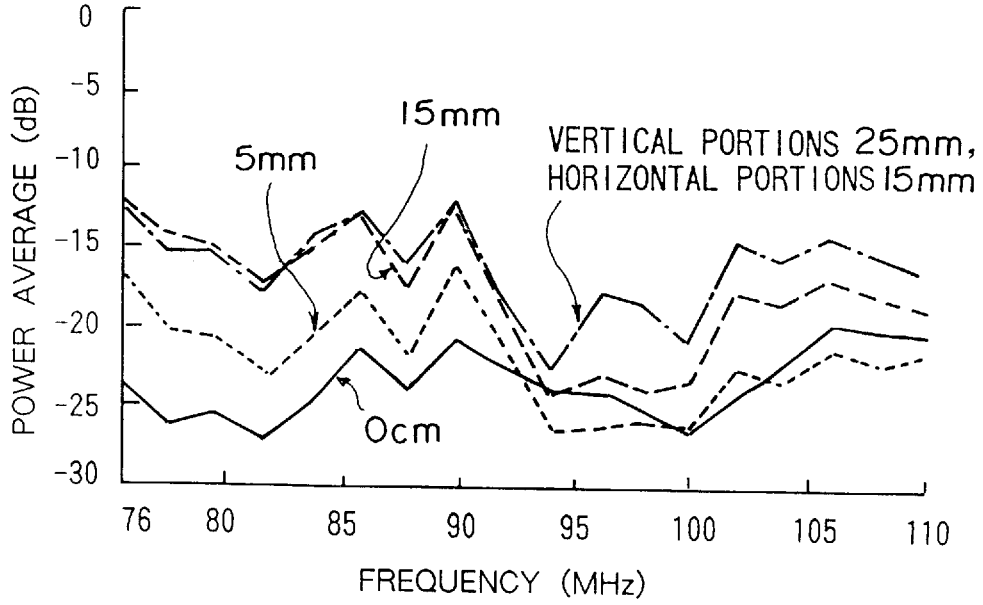
FIG. 12 shows a vertically polarized wave receiving sensitivity characteristic of the slot antenna in FIG. 11A corresponding to the characteristic shown in FIG. 11B.

FIG. 11B shows a receiving sensitivity characteristic in the slot antenna, with its conductor 4 fed at its top-right corner as shown in FIG. 1A, when the slot antenna receives horizontally polarized wave. FIG. 11B shows, in particular, variations when the slot portion is changed. FIG. 12 shows a receiving sensitivity characteristic of the same slot antenna when it receives vertically polarized wave. In FIG. 11B and FIG. 12, the solid lines represent a receiving sensitivity characteristic derived from a slot antenna with zero width (namely, no slot antenna), the dotted line the sensitivity characteristic from a 5 mm slot antenna, the dashed line the sensitivity characteristic from a 15 mm slot antenna and the dash-dot line the sensitivity characteristic from a slot antenna having 25 mm width at its top and bottom portions and 15 mm width at its left-hand vertical and right-hand vertical portions. As seen from FIG. 11B and FIG. 12, as the slot becomes wider the receiving sensitivity characteristic becomes higher. The difference between the slot antenna in FIG. 11A and the slot antenna in FIG. 10 is that the slot antenna in FIG. 11A has an ungrounded conductor 4 and is without the capacitor 29.

Figure 13:
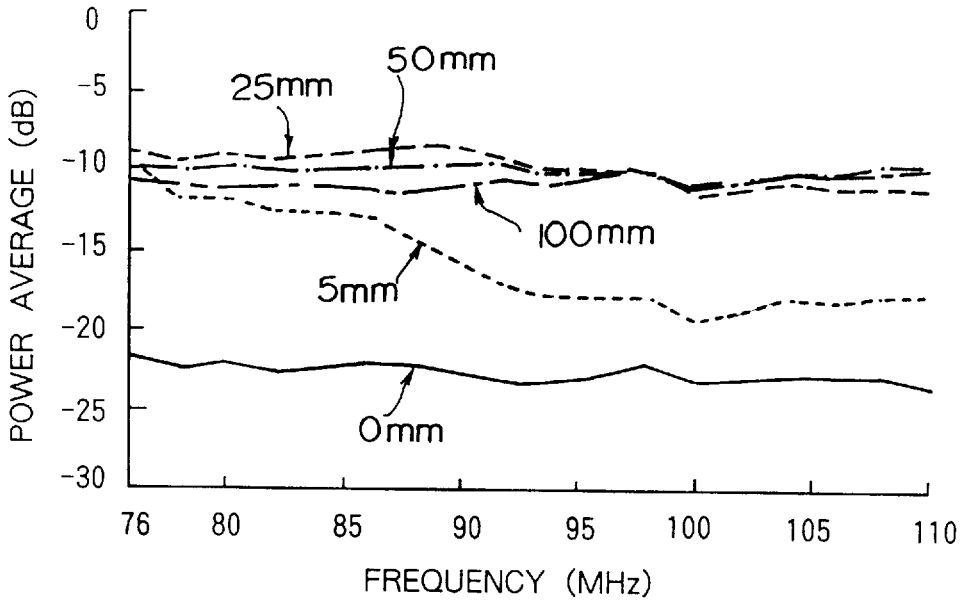
FIG. 13 shows a horizontally polarized wave receiving sensitivity characteristic of the slot antenna in FIG. 11A, wherein the width of the slot portion surrounding the conductor was varied.
Figure 14:
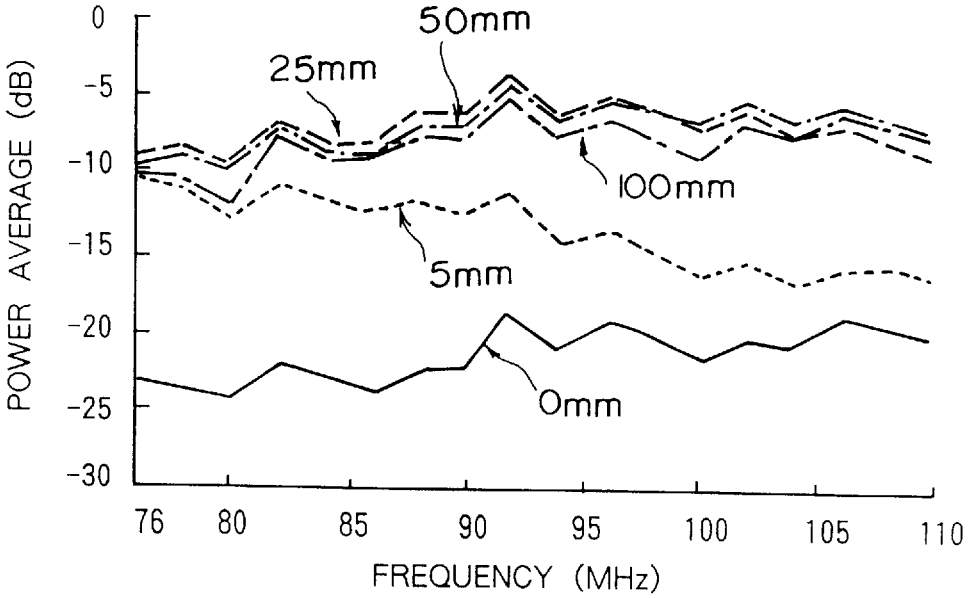
FIG. 14 shows a vertically polarized wave receiving sensitivity characteristic of the slot antenna in FIG. 11A corresponding to the characteristic of FIG. 13.

FIG. 13 shows a receiving sensitivity characteristic of the slot antenna of FIG. 11A, in which the conductor 4 is fed at its top center point transversely across the conductor 4 instead of being fed at its top-right corner and the conductor 4 is left ungrounded. The receiving sensitivity characteristic was obtained by changing the slot width (0 mm, 5 mm, 25 mm, 50 mm, and 100 mm) when horizontally polarized wave is received. FIG. 14 shows a receiving sensitivity characteristic on the same slot antenna when it receives vertically polarized wave. As seen from FIG. 13 and FIG. 14, a the slot becomes wider the receiving sensitivity characteristic becomes higher.

Figure 15:
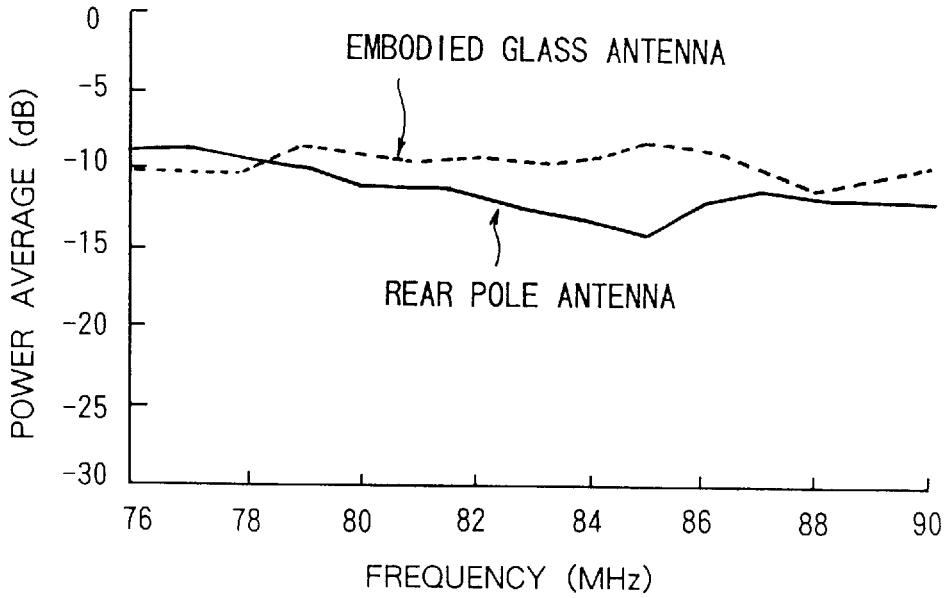
FIG. 15 shows a horizontally polarized wave receiving sensitivity characteristic of the slot antenna wherein the feeding point is set to the top-right corner of the conductor with a slit at its bottom-left corner and a capacitor couples the top-right corner of the conductor to the defogger.
Figure 16:
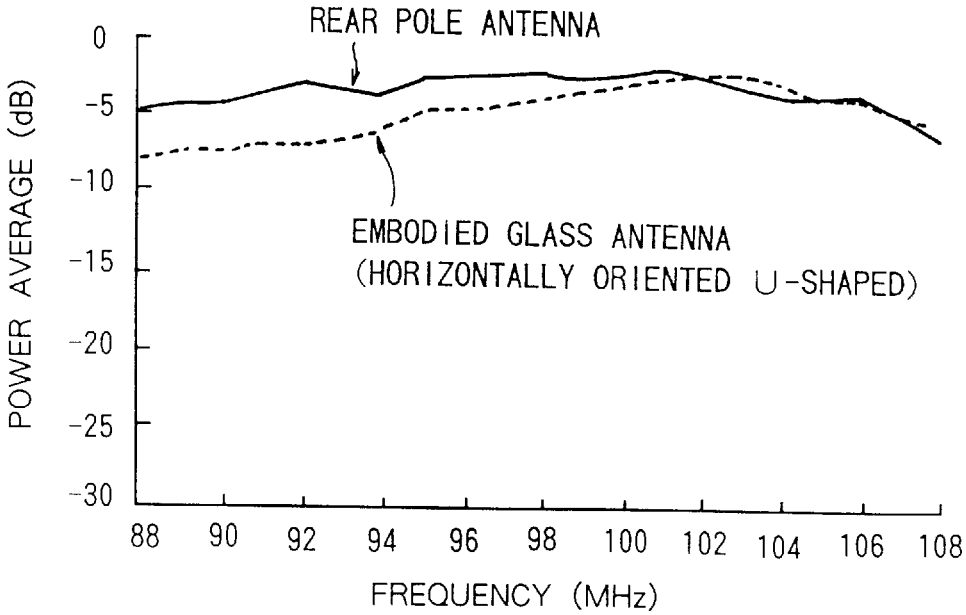
FIG. 16 shows a vertically polarized wave receiving sensitivity characteristic of the slot antenna.

FIG. 15 and FIG. 16 show the receiving sensitivity characteristics derived from a slot antenna having a slit at its bottom-left corner. The slot antenna here has a conductor fed at its top-right corner and the top-right corner is coupled to a defogger via a capacitor (as in the slot antenna in FIG. 5). FIG. 15 shows a receiving sensitivity characteristic when the slot antenna receives horizontally polarized wave. FIG. 16 shows a receiving sensitivity characteristic when the slot antenna receives vertically polarized wave. As seen from FIG. 15 and FIG. 16, the embodied glass antenna (slot antenna) presents a higher receiving sensitivity characteristic than a rear pole antenna (which is a rod antenna mounted on the rear portion of a vehicle).

Figure 17:
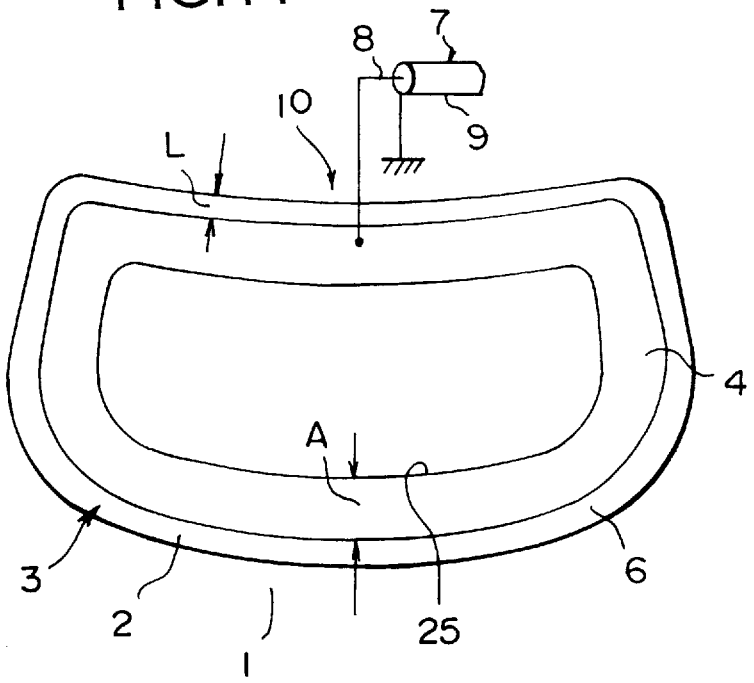
FIG. 17 shows, in the same orientation as in FIG. 1, the test setup wherein the width of the conductor loop is varied.
Figure 18:
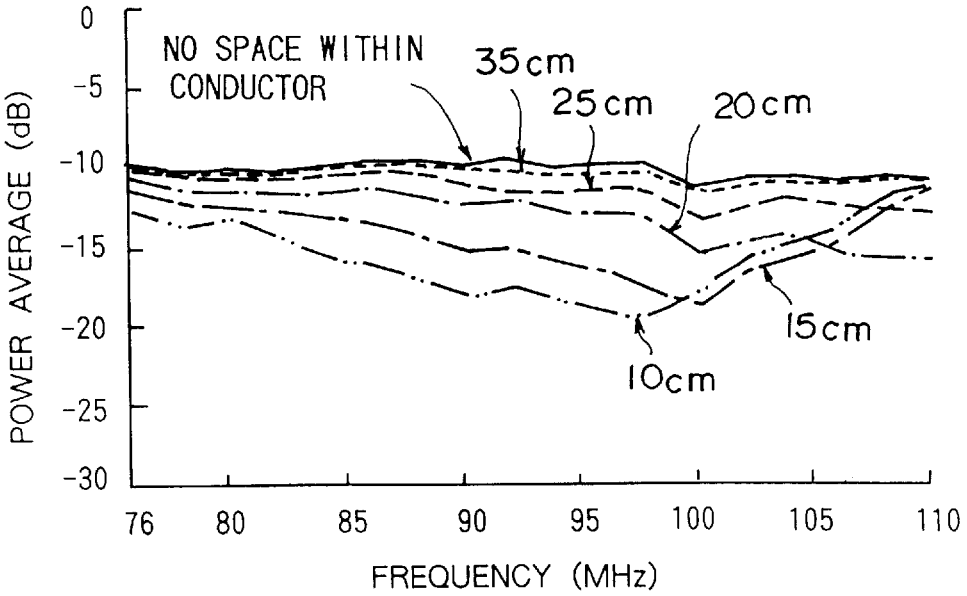
FIG. 18 shows a horizontally polarized wave receiving sensitivity characteristic of the slot antenna wherein the width of the conductor loop is varied.
Figure 19:
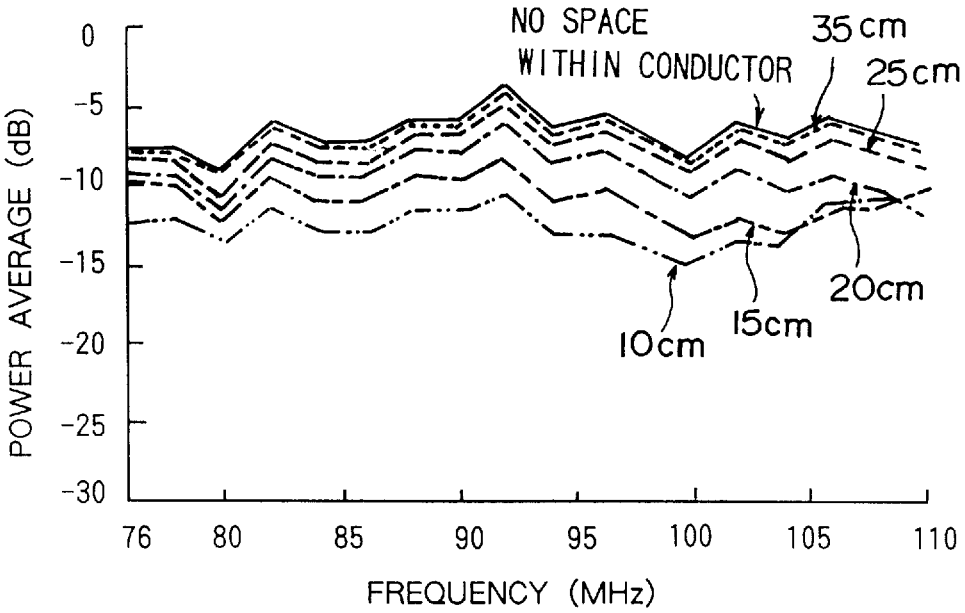
FIG. 19 shows a vertically polarized wave receiving sensitivity characteristic of the slot antenna setting corresponding to FIG. 18.

FIG. 18 and FIG. 19 show the receiving sensitivity characteristics of the slot antenna shown in FIG. 17, wherein the slot antenna comprises no slit, complete loop conductor 4 disposed on a window glass 3. The conductor 4 having a width of A surrounds an space 25 into which no portion of the conductor 4 extends. The receiving sensitivity characteristics in FIG. 18 and FIG. 19 were obtained on the slot antenna in FIG. 17 with the width L of the slot portion 6 L=30 mm, the conductor 4 fed at its top center transversely across the conductor 4, and the conductor 4 left ungrounded. The loop conductor 4 was tested at the following widths A: 10 cm, 15 cm, 20 cm, 25 cm, 35 cm and the maximum width (namely, the space 25 is filled with the conductor 4). FIG. 18 shows a receiving sensitivity characteristic of the slot antenna at each of the above conditions when horizontally polarized wave is received. FIG. 19 shows a receiving sensitivity characteristic of the slot antenna at each of the above conditions when vertically polarized wave is received. As seen from FIG. 18 and FIG. 19, as the width A of the conductor 4 becomes narrower the receiving sensitivity characteristic becomes lower.

Figure 20:
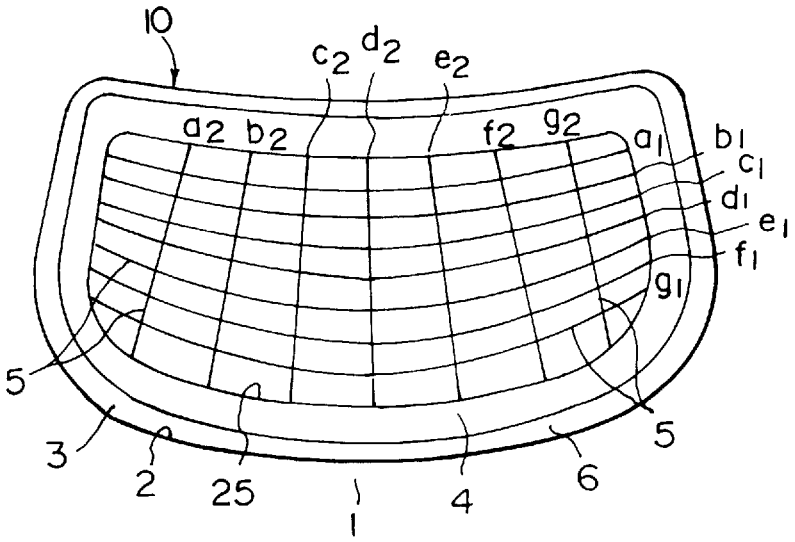
FIG. 20 shows, in the same orientation as in FIG. 1, the test setting wherein wires are extended within the space in the conductor loop.
Figure 21:
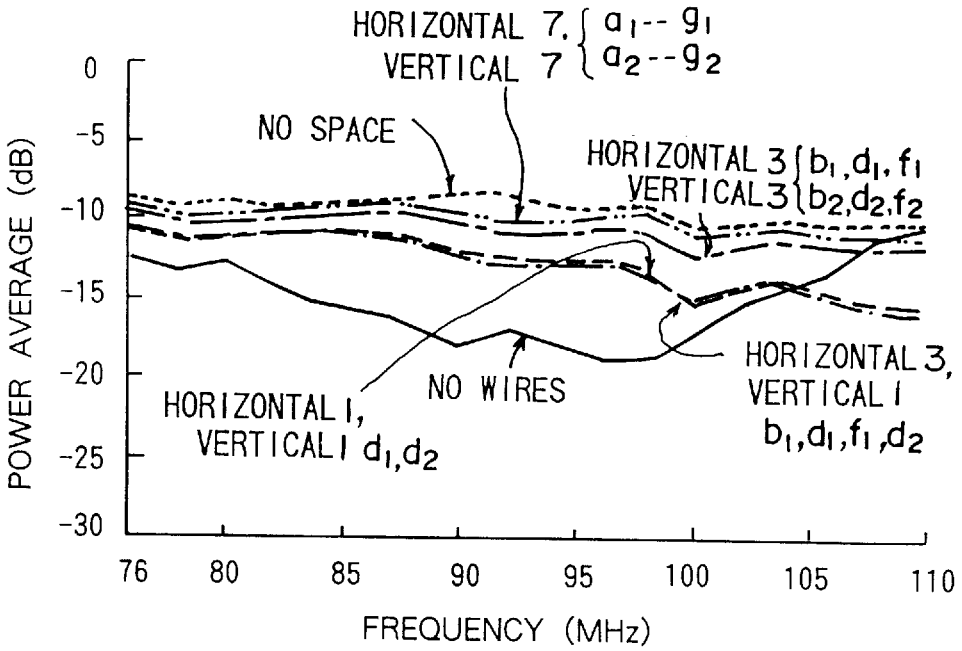
FIG. 21 shows a horizontally polarized wave receiving sensitivity characteristic of the slot antenna wherein wires are extended within the space in the conductor loop.
Figure 22:
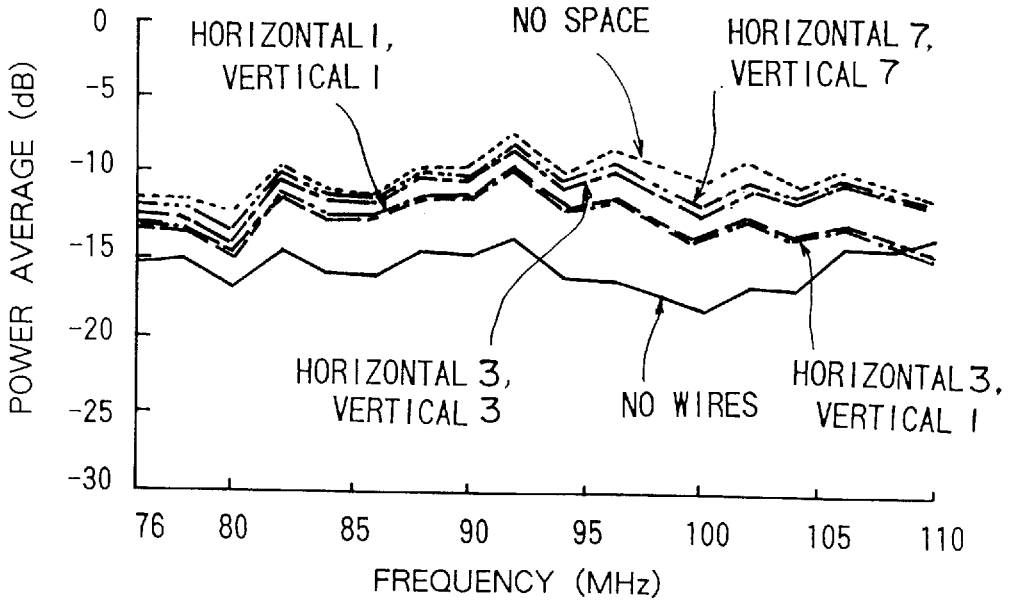
FIG. 22 shows a vertically polarized wave receiving sensitivity characteristic of the slot antenna setting corresponding to FIG. 21.

In the slot antenna shown in FIG. 20, a loop conductor 4 of 10 cm width surrounds a central space 25. A slot portion 6 of 30 mm width (fixed) circles the conductor 4. The conductor 4 is fed at its top center transversely across the conductor 4. A plurality of copper wires 5, 5 are horizontally and vertically extended in a grid pattern within the space 25. The conductor 4 is left ungrounded. FIG. 21 shows a receiving sensitivity characteristic of the slot antenna in FIG. 20 in horizontally polarized wave when positions and the number of copper wires within the space 25 are varied. FIG. 22 shows a receiving sensitivity characteristic of the slot antenna in vertically polarized wave. In FIG. 20, the positions of the five copper wires horizontally extended are respectively represented by a1, b1, c1, d1, e1, f1, and g1, and the positions of the five wires vertically extended are respectively represented by a2, b2, c2, d2, e2, f2, and g2. In FIG. 21 and FIG. 22, the solid line labeled "No wire" represents a sensitivity for the slot antenna having no wire in the space 25. The two-dot chain line labeled "Horizontal 7, Vertical 7" represents a sensitivity for the slot antenna having the horizontally extended copper wires 5 at a1, b1, c1, d1, f1, and g1, and the vertically extended copper wires 5 at a2, b2, c2, d2, e2, f2 and g2 within the space 25. The dotted line labeled "Horizontal 1, Vertical 1" represents a sensitivity for the slot antenna having the horizontally extended copper wire 5 at d1 and the vertically extended copper wire 5 at d2 with in the space 25. The dot-dash line labeled "Horizontal 3, Vertical 1" represents a sensitivity for the slot antenna having the horizontally extended copper wires 5 at b1, d1, and f1, and the vertically extended copper wire 5 at d2. The two-dot chain line labeled "Horizontal 3, Vertical 3" represents a horizontally extended copper wires 5 at b1, d1, and f1 and the vertically extended copper wires 5 at b2, d2, and f2 within the space 25. As seen from FIG. 21 and FIG. 22, the conductor 4 with the space 25 allowed as in FIG. 20 achieves substantially the same sensitivity as the slot antenna with no space allowed (the entire area filled with the conductor 4), as long as wires are extended within the space 25. As the number of copper wires 5, 5, becomes larger the sensitivity of the slot antenna becomes to more approximate the entirely conductor covered antenna with no space allowed in.

FIG. 11B, FIG. 12 through FIG. 14, FIG. 18, FIG. 19, FIG. 21, FIG. 22 all show the receiving sensitivity characteristics of the slot antennas which are left ungrounded. FIG. 23B and FIG. 24 show the receiving sensitivity characteristics of a slot antenna that is grounded (as in the slot antenna in FIG. 23A, for example).

Figure 23A:
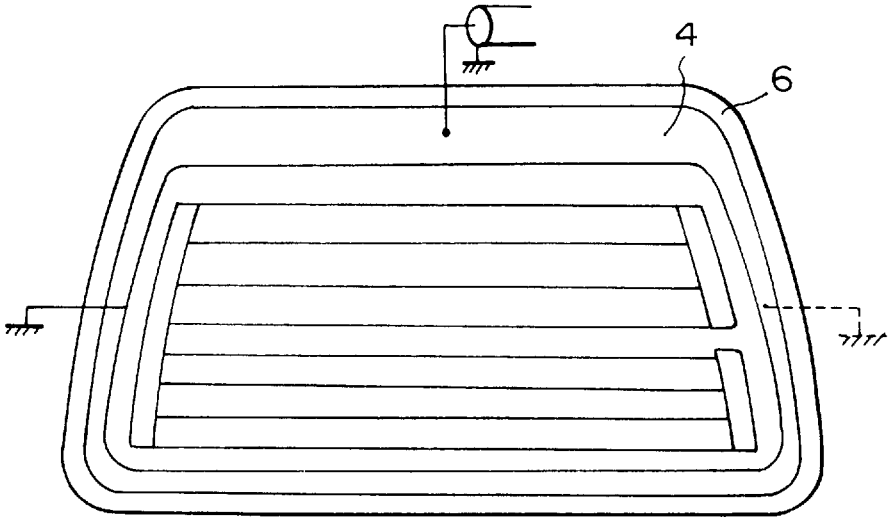
FIG. 23A shows a setting of the slot antenna that resulted in the test data presented in FIG. 23B and FIG. 24.
Figure 23B:
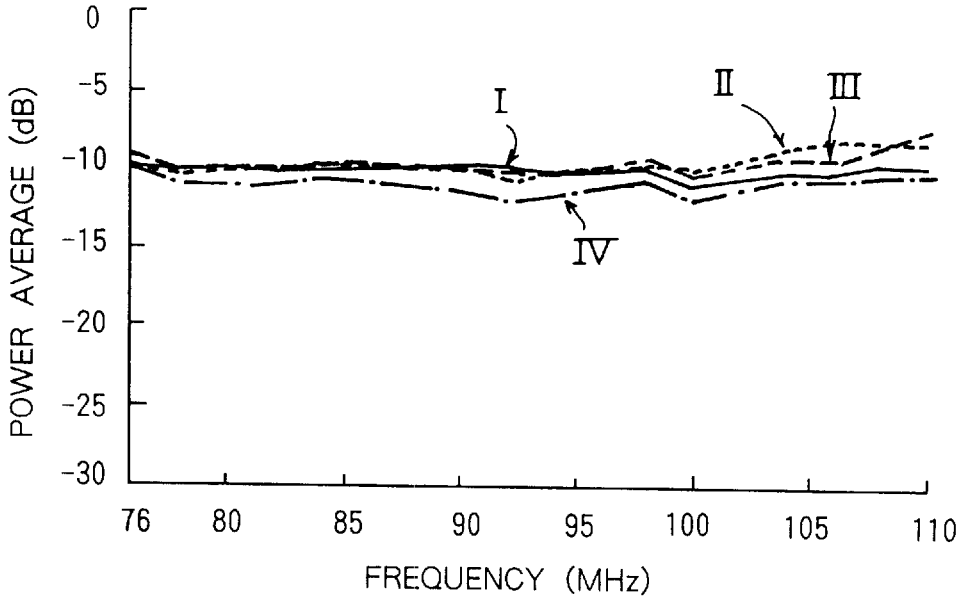
FIG. 23B shows a horizontally polarized wave receiving sensitivity characteristic of the slot antenna in FIG. 23A, wherein the conductor is grounded at a different position.
Figure 24:
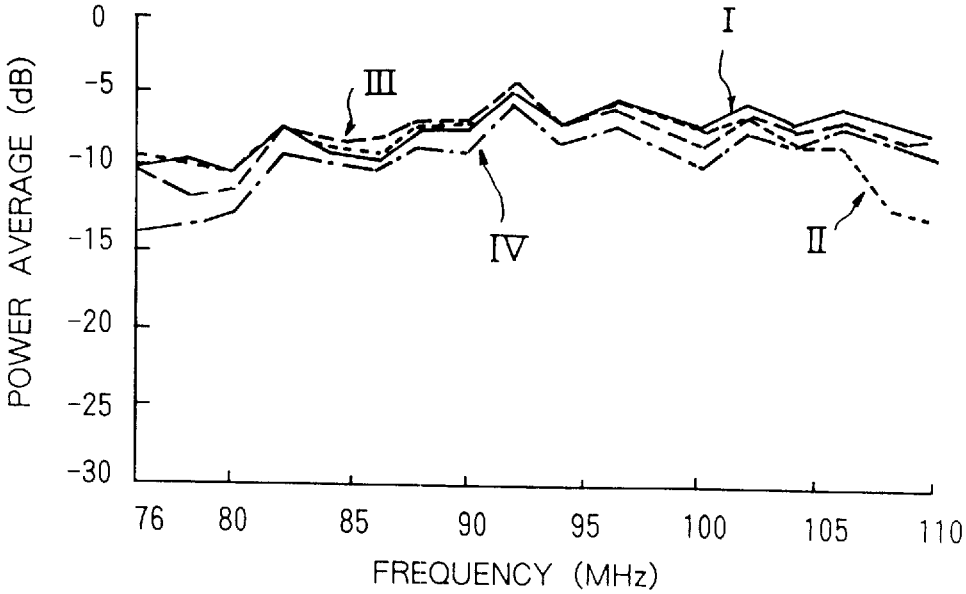
FIG. 24 shows a vertically polarized wave receiving sensitivity characteristic of the slot antenna setting corresponding to FIG. 23B.

FIG. 23B shows a receiving sensitivity characteristic of the slot antenna, of a type shown in FIG. 23A, wherein the slot portion 6 is 50 mm wide, the conductor 4 is fed at its top center point transversely across it, and the conductor 4 is grounded at other position than its top center. FIG. 23B shows a receiving sensitivity characteristic when horizontally polarized wave is received. FIG. 24 shows a receiving sensitivity characteristic when vertically polarized wave is received. In FIG. 23B and FIG. 24, the solid line I represents a comparable receiving sensitivity characteristic with no grounding provided, the dotted line II the sensitivity characteristic for the slot antenna where the conductor is grounded at its left hand side, the dotted line III the sensitivity characteristic for the slot antenna where the conductor is grounded at its right hand side, and the dotted line IV the sensitivity characteristic for the slot antenna where the conductor is grounded at both left and right hand sides. As seen from FIG. 23B and FIG. 24, the receiving sensitivity characteristics are substantially unchanged regardless of whether the conductor is grounded or not, regardless of grounding position and regardless of the number of grounded points. The characteristics shown in FIG. 23B and FIG. 24 tell that the embodied antenna is so-called slot antenna which makes use of radio wave radiation from the slot.

Figure 25:
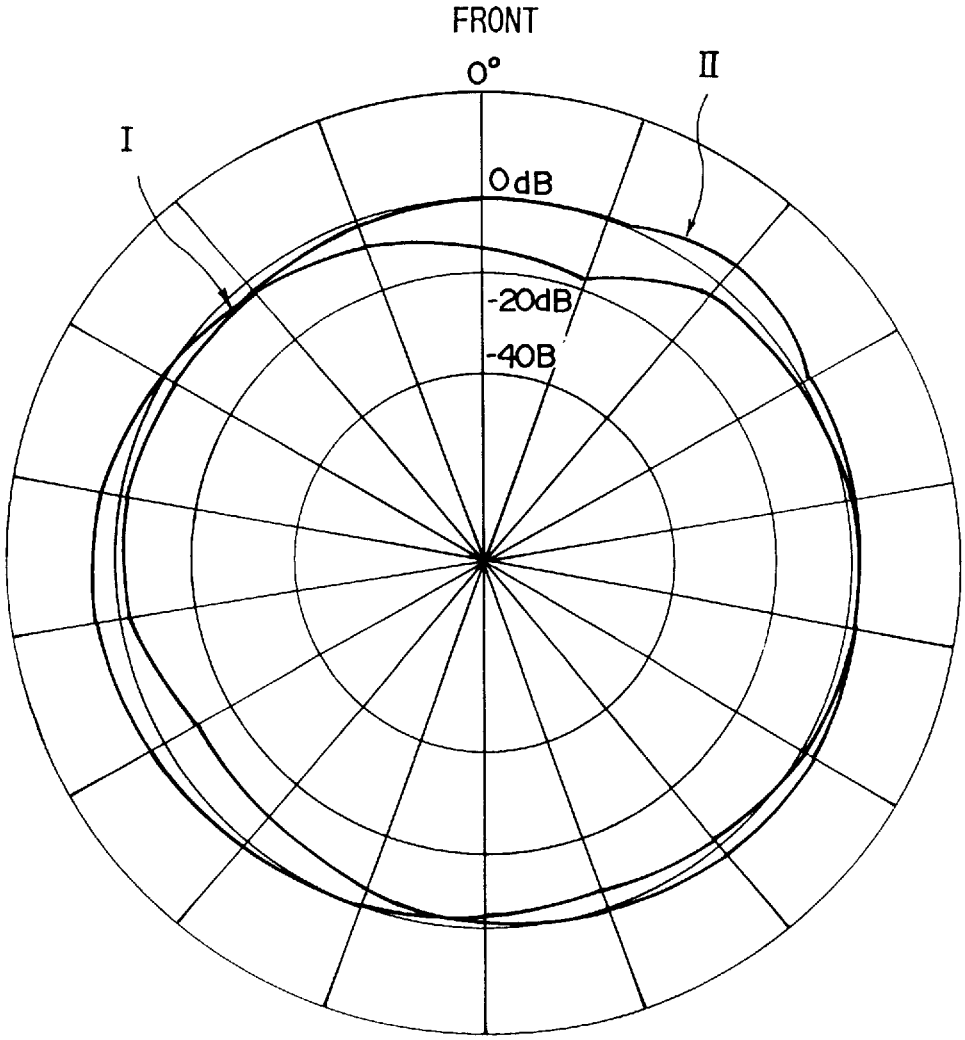
FIG. 25 shows a directivity patterns of the sensitivity with different feeding points set on the defogger.

FIG. 25 shows a directivity pattern of a receiving sensitivity characteristic of the second embodiment (refer to FIG. 4) at each feeding point when 60 MHz radio wave is received. In FIG. 25, the solid line I represents a directivity pattern with the feeding point set to the positive supply terminal, and the solid line II represents a directivity pattern with the feeding point set to the folded portion of the defogger (namely, the bus bar 18 in FIG. 4). As seen from FIG. 25, both feeding points provide an excellent directivity pattern.

Figure 26:
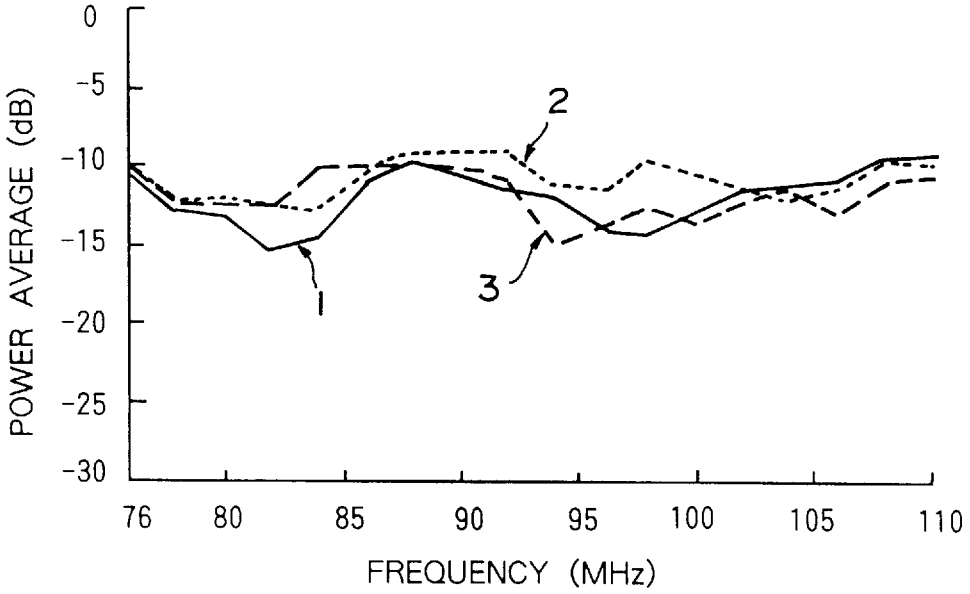
FIG. 26 shows a horizontally polarized wave receiving sensitivity characteristic of the slot antenna wherein the position of the slit is changed on the conductor.
Figure 27:
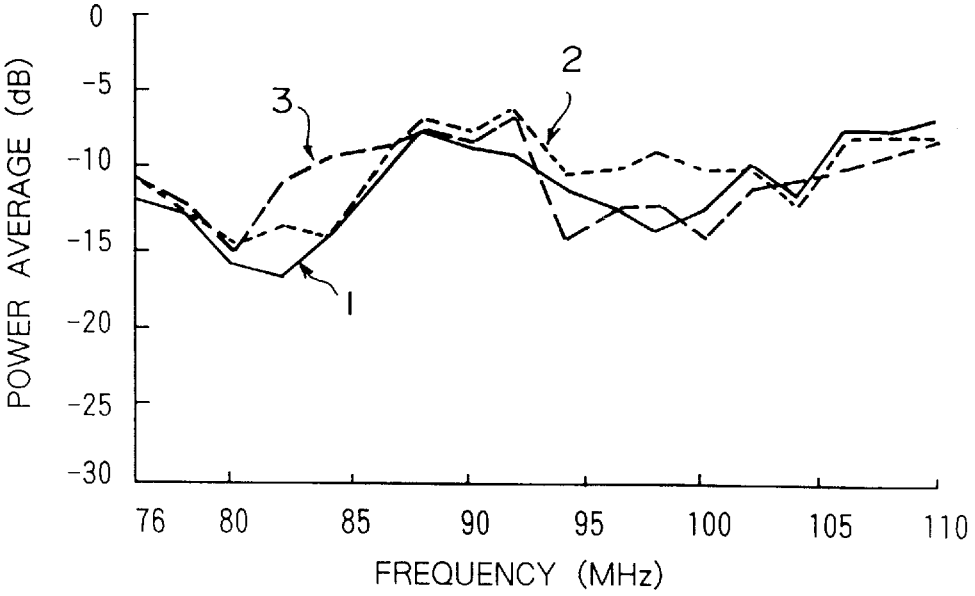
FIG. 27 shows a vertically polarized wave receiving sensitivity characteristic of the slot antenna setting corresponding to FIG. 26.

FIG. 26 shows a receiving sensitivity characteristic of the slot antenna of a type shown in FIG. 17, wherein a slit is cut through the conductor 4 in different positions, and the feeding point is set to the conductor 4 at its top center transversely across it. FIG. 26 shows a receiving sensitivity characteristic when horizontally polarized wave is received. FIG. 27 shows a receiving sensitivity characteristic when vertically polarized wave is received. In FIG. 26 and FIG. 27, "1" represents a sensitivity characteristic for the slot antenna where the slit is cut at the bottom-right corner of the conductor 4, "3" the sensitivity characteristic for the slot antenna where the slit is cut at the bottom center of the conductor transversely across it, and "2" the sensitivity characteristic for the slot antenna where the slit is cut between the bottom-right corner of the conductor 4 and the bottom center of the conductor 4 transversely across it. As seen from these graphs in FIG. 26 and FIG. 27, the frequency of peak receiving sensitivity characteristic shifts according to the position of the slit. This suggests that changing the position of the slit facilitates tuning.

Figure 28:
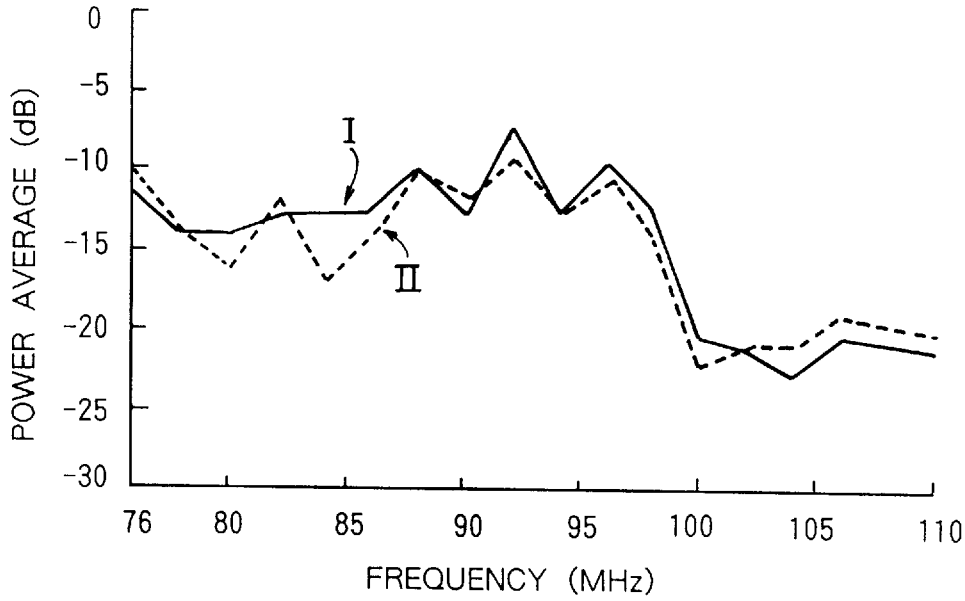
FIG. 28 shows a vertically polarized wave receiving sensitivity characteristic of the slot antenna wherein a shifted feeding point is set with the conductor having a slit at its bottom-left corner.

FIG. 28 shows a receiving sensitivity characteristic of the slot antenna of a type shown in FIG. 5, wherein a slit is cut at the bottom-left corner of the conductor 4, and no coupling capacitor 29 is inserted between the top-right corner of the conductor 4 and the bus bar 16. FIG. 28 shows a receiving sensitivity characteristic responsive to vertically polarized wave when the feeding point is set to the top-right corner of the conductor (as represented by the solid line I) and when the feeding point is set to the top-left corner of the conductor (as represented by the dotted line II). As seen from FIG. 28, by setting the feeding point diagonally opposite from the slit, the receiving sensitivity characteristic is enhanced.

Figure 29:
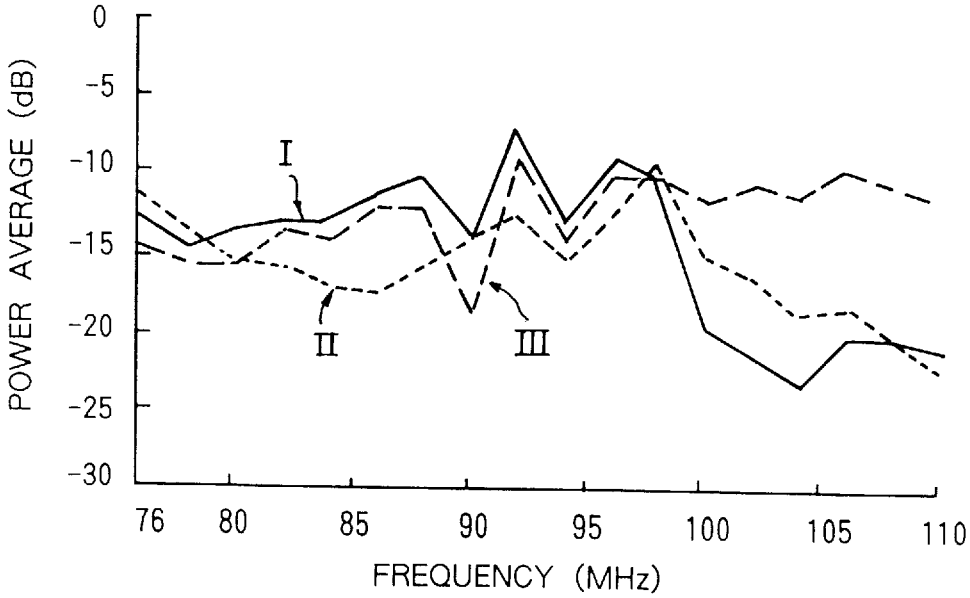
FIG. 29 shows a vertically polarized wave receiving sensitivity characteristic of the slot antenna wherein a shifted feeding point is set on the conductor which has a slit at the bottom-left corner and a capacitor connected to the center of its right-hand vertical portion.

FIG. 29 shows a receiving sensitivity characteristic of the slot antenna of a type shown in FIG. 5, wherein a slit is cut at the bottom-left corner of the conductor 4, and a coupling capacitor 29 is inserted between the top-right corner of the conductor 4 and the bus bar 16. FIG. 29 shows a receiving sensitivity characteristic responsive to vertically polarized wave when the feeding point is set to the top-right corner of the conductor (as represented by the solid line I), when the feeding point is set to the right-hand side of the conductor (as represented by the dotted line II), and when the feeding point is set to the left-hand side of the conductor (as represented by the dotted line III). As seen from FIG. 29, by setting the feeding point diagonally opposite from the slit, the receiving sensitivity characteristic is enhanced even with the capacitor 29 included.

Figure 30:
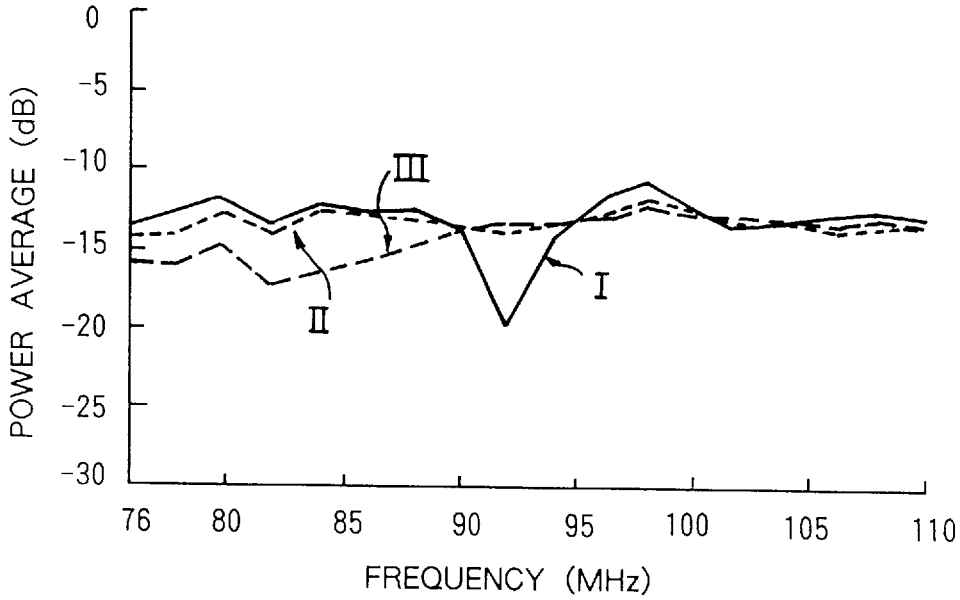
FIG. 30 shows a horizontally polarized wave receiving sensitivity characteristic of the slot antenna wherein a shifted feeding point is set on the conductor which is a horizontally oriented U-shaped configuration with its left-hand portion opened as a slit.

FIG. 30 shows a receiving sensitivity characteristic, responsive to horizontally polarized wave, of the slot antenna (like the one in FIG. 7, for example), wherein the slit is expanded by removing the entire left-hand vertical portion of the conductor and the resulting conductor is a horizontally oriented U-shape configuration. The receiving sensitivity characteristics are measured with the feeding point changed to different positions and the number of feeding points increased. In FIG. 30, the solid line I represents a sensitivity characteristic when the conductor is fed at its top-left corner only, the dotted line II represents a sensitivity characteristic when the conductor is further fed at the top-right corner in addition to the case for the solid line I, and the dotted line III represents a sensitivity characteristic when the conductor is further fed at its bottom-left corner in addition to the case of the dotted line II. FIG. 30 shows that no substantial improvement in the receiving sensitivity characteristic results from increasing the feeding points.

Figure 31:
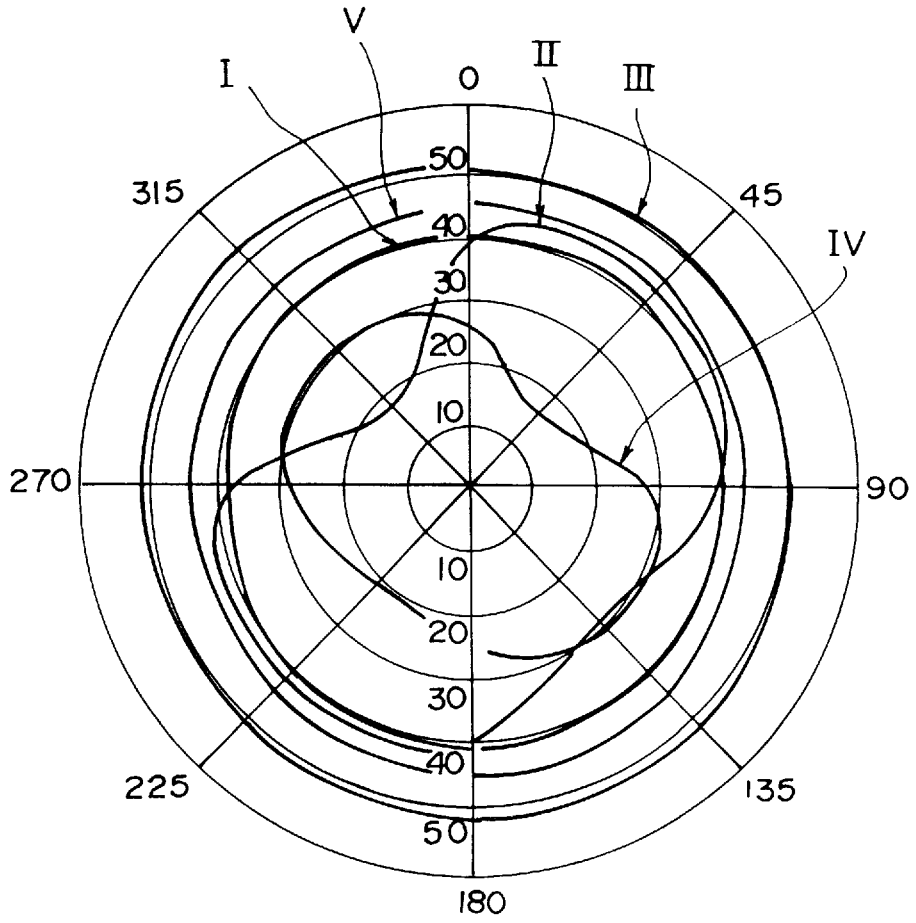
FIG. 31 shows a antenna directivity patterns at 702 kHz in AM band.
Figure 32:
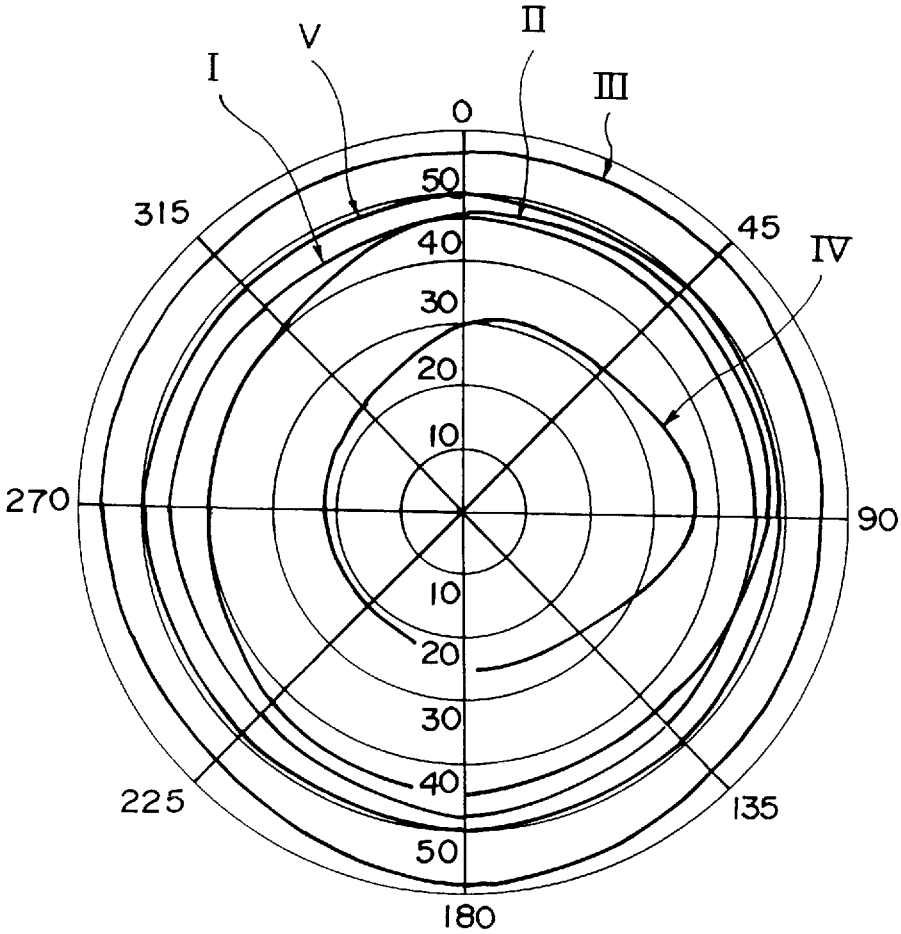
FIG. 32 shows a antenna directivity patterns at 1071 kHz in AM band.
Figure 33:
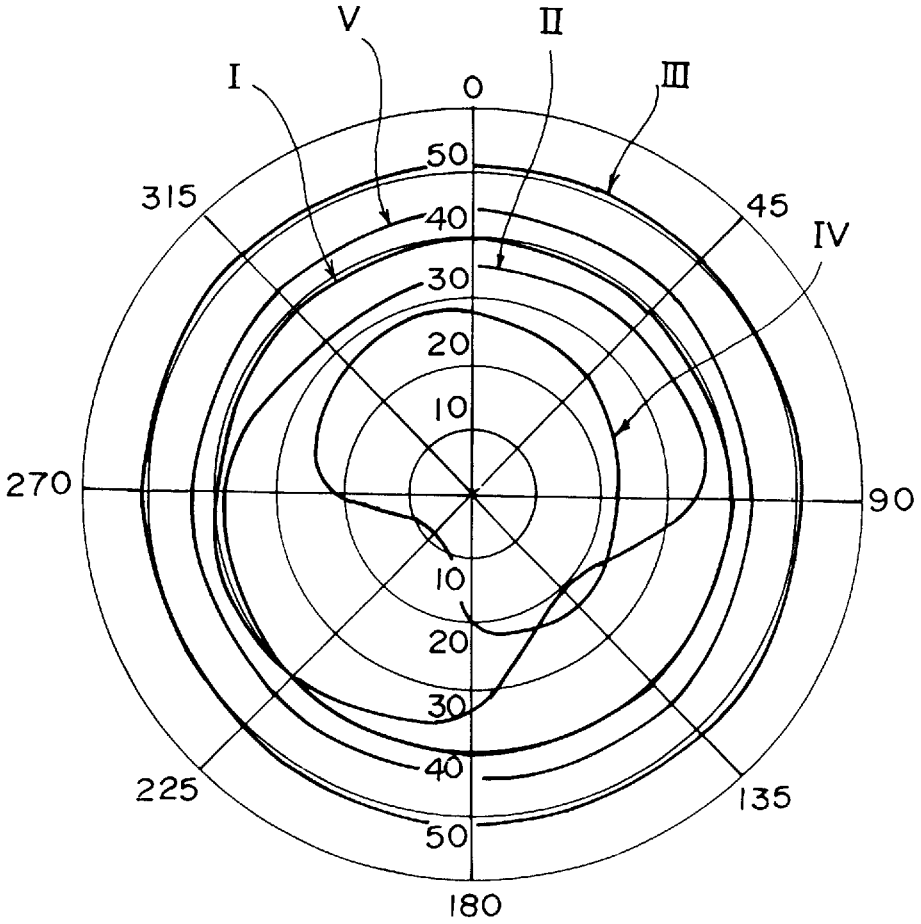
FIG. 33 shows a antenna directivity patterns at 1350 kHz in AM band.
Figure 34:
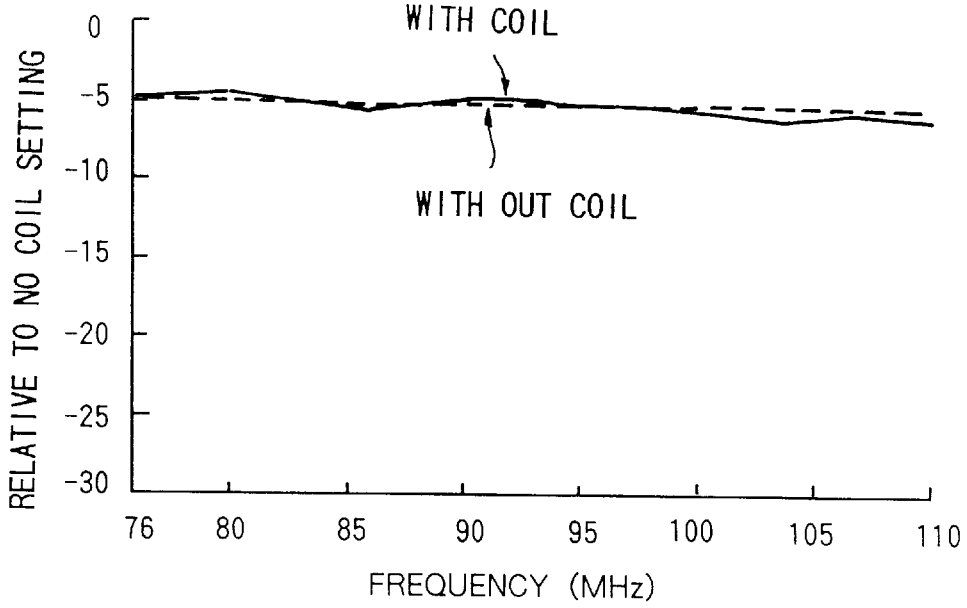
FIG. 34 shows a vertically polarized wave receiving sensitivity characteristic of the slot antenna wherein a coil is coupled between the top-right corner of the conductor and the defogger, with the corresponding characteristic of the slot antenna with the coil removed for reference purpose.

FIG. 31 through FIG. 33 show the directivity patterns in comparison of embodied slot antennas (having film conductor as in FIG. 1) to a rear pole antenna (as represented by the solid line V) and a 1 mm diameter wire loop antenna (as represented by the solid line IV), when AM bands are received. In FIG. 31, the solid line I represents a sensitivity characteristic derived from the slot antenna without choke coils (like the coil 30 in FIG. 6, for example) and a capacitor filter (like the capacitor 29 in FIG. 6), the solid line III represents a sensitivity characteristic derived from the slot antenna with the capacitor filter and with the defogger directly connected to a battery (as in the slot antenna in FIG. 5), and the solid line III represents a sensitivity characteristic derived from the slot antenna having choke coils as shown in FIG. 6. FIG. 31 shows directivity patterns in 702 kHz radio wave, FIG. 32 shows directivity patterns in 1071 kHz radio wave, and FIG. 33 shows directivity patterns in 1350 kHz radio wave. As seen from these figures, embodied slot antennas offer substantially the same directivity as the rear pole antenna.

FIG. 31 shows a receiving sensitivity characteristic, responsive to vertically polarized wave, of the slot antenna of a type having a slit on the left-bottom corner of the conductor, wherein the conductor is fed at its top-right corner, and a coil (100 $\mu$H), instead of a capacitor, is inserted between the top-right corner of the conductor and the upper split bus bar connected to the defogger. In FIG. 31, the sensitivity characteristic of the slot antenna with the coil is referenced to the level (=0) of the slot antenna without coil (as represented by the dotted line). No substantial difference results in receiving sensitivity characteristic between the slot antenna with and without coil.

Figure 35:
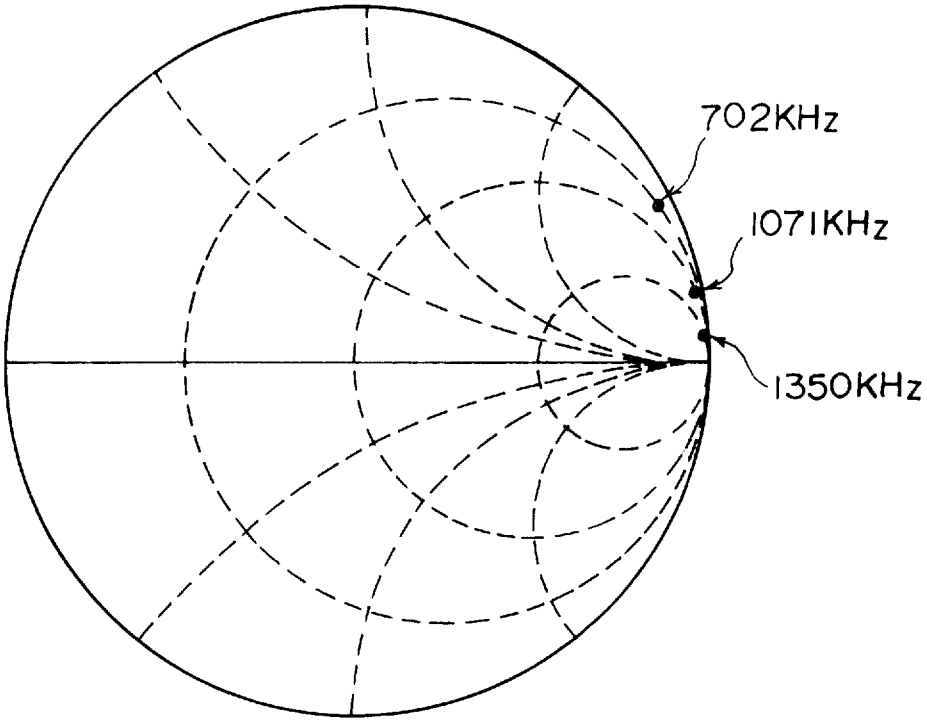
FIG. 35 is a Smith chart showing impedance of the slot antenna in AM band when a 30 $\mu$H coil is coupled between the top-right corner of the conductor and the defogger.
Figure 36:
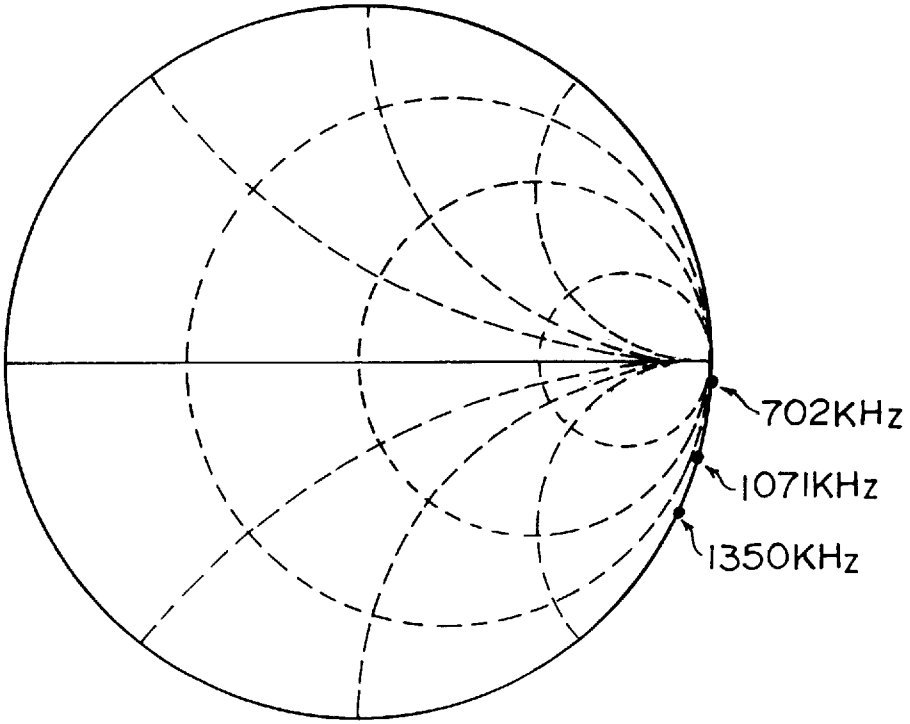
FIG. 36 is a Smith chart showing impedance of the slot antenna in AM band when a 100 $\mu$H coil is coupled between the top-right corner of the conductor and the defogger.
Figure 37:
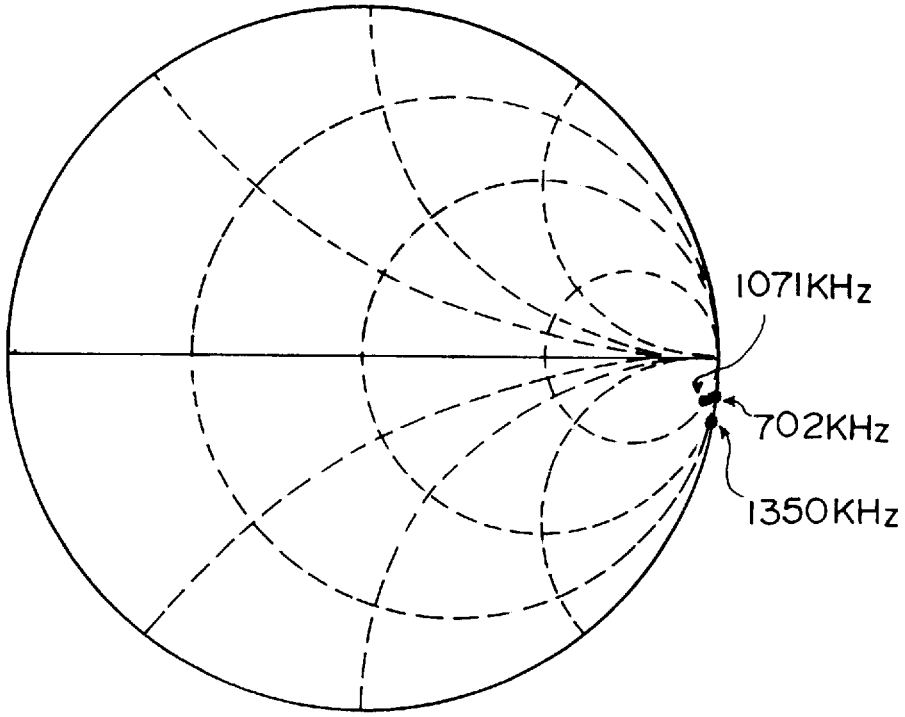
FIG. 37 is a Smith chart showing impedance of a rear pole antenna in AM band.

FIG. 35 and FIG. 36 are Smith charts showing impedance characteristics responsive to AM band frequencies 702, 1071, and 1350 kHz, of the slot antenna having a coil between the top-right corner of the loop conductor and the upper split bus bar of a defogger (namely, the slot antenna of a type shown in FIG. 9 and FIG. 10, having a loop conductor 4 and a coil instead of the capacitor). In FIG. 35, a 30 $\mu$H coil is used, and in FIG. 36, a 100 $\mu$H coil is used. FIG. 37 is a Smith chart of a rear pole antenna. As seen from these Smith charts, impedance matching correction is possible in the embodied slot antennas.

Figure 38B:
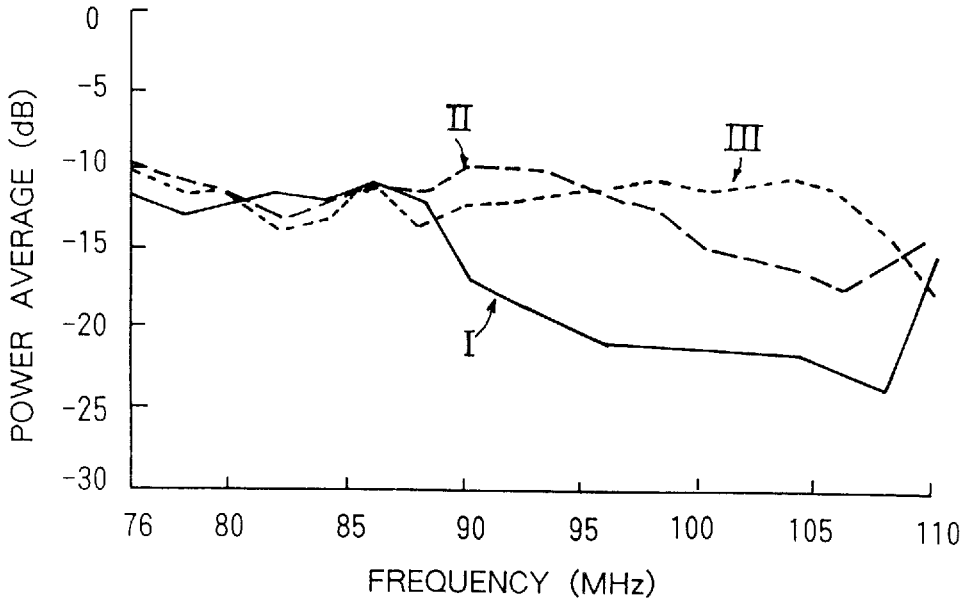
FIG. 38B shows a horizontally polarized wave receiving sensitivity characteristic of the slot antenna shown in FIG. 38A.
Figure 38A:
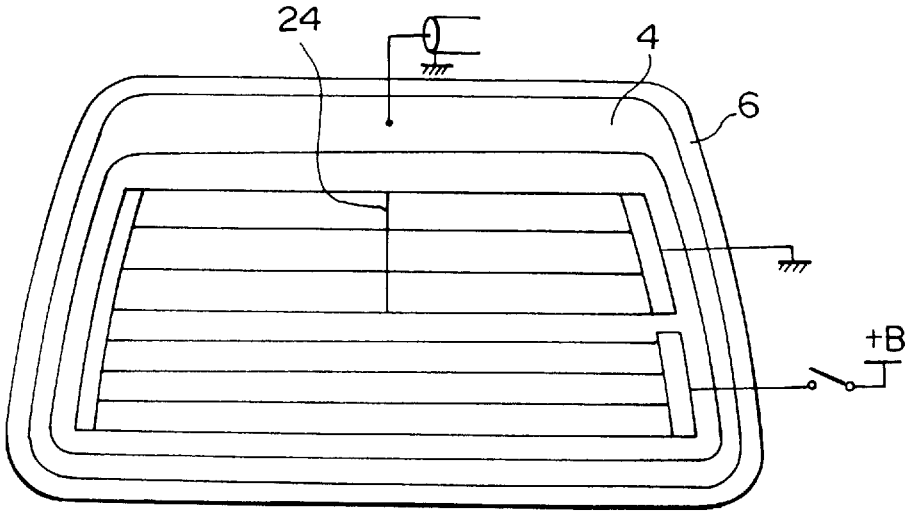
FIG. 38A shows a slot antenna setting that resulted in the test data presented in FIG. 38B, FIG. 39, FIG. 42, FIG. 43, FIG. 74, FIG. 83, and FIG. 84.
Figure 39:
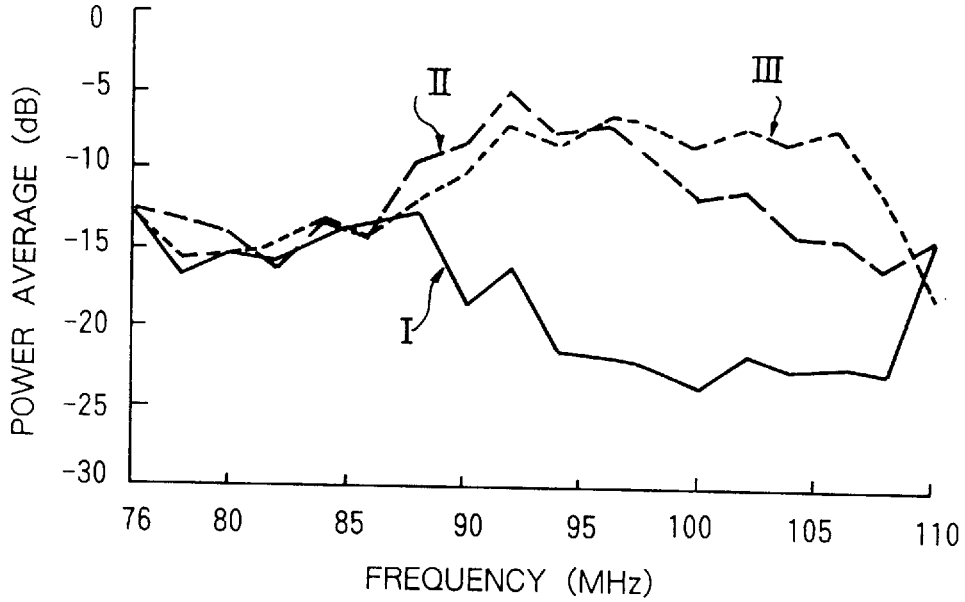
FIG. 39 shows a vertically polarized wave receiving sensitivity characteristic of the slot antenna shown in FIG. 38A.

FIG. 38B and FIG. 39 show variations in the characteristic of the slot antenna when copper wires are varied in length wherein the slot antenna comprises a complete loop conductor without a slit (like the conductor 4 in FIG. 10, for example), and a defogger (like the defogger in FIG. 5, for example) and said copper wires vertically oriented between the left-hand and right-hand sides of the defogger (like the copper wires 24 in FIG. 5). The above slot antenna has a construction such as the one in FIG. 38A.

In FIG. 38B, the solid line I represents a receiving sensitivity characteristic derived from the slot antenna without copper wires (such as the copper wires 24 in FIG. 38A), the dotted line II represents a sensitivity characteristic for the slot antenna with the copper wires vertically extended from the top to the bottom of the defogger, and the dotted line III represents a sensitivity characteristic for the slot antenna with copper wires extended over the upper half of the defogger. The feeding point is set to the top center of the conductor transversely across the conductor. FIG. 38 shows a receiving sensitivity characteristic responsive to horizontally polarized wave and FIG. 39 shows a receiving sensitivity characteristic responsive to vertically polarized wave.

Figure 40:
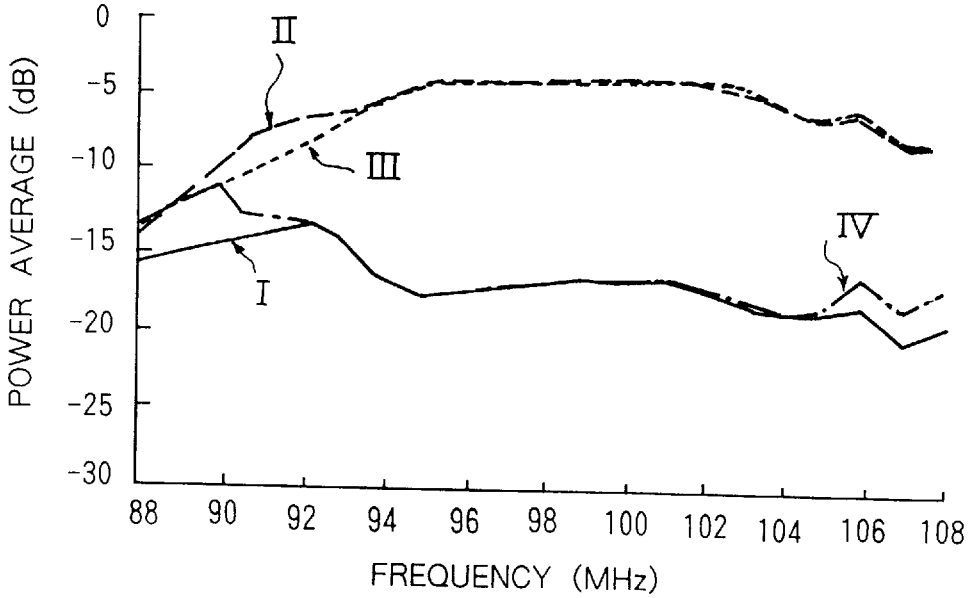
FIG. 40 shows a vertically polarized wave receiving sensitivity characteristic on a receiving frequency range of 88 MHz to 108 MHz.
Figures 4A, 4B, 4C, 4D, 4E, 4F, 4G, 4H, 4I, 4J, 4K, 4L, 4M, 4N, 4O, 4P, 4Q, 4R, 4S, 4T, 4U:
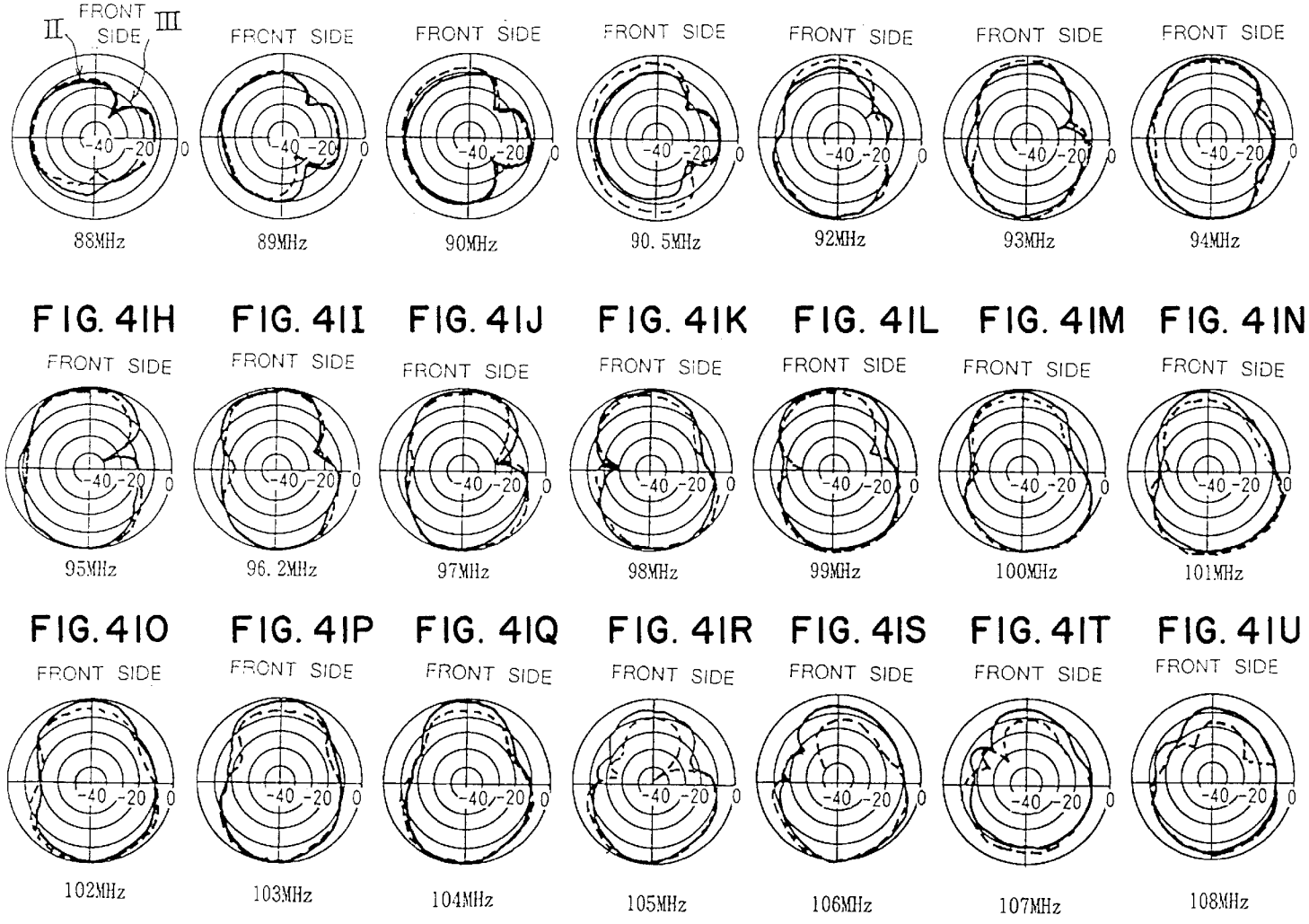

FIG. 40 shows a receiving sensitivity characteristic of the slot antenna of a type shown in FIG. 38A, wherein the slot antenna further comprises a capacitor between the top-right corner of the conductor and the upper split bus bar of the defogger. FIG. 40 shows a receiving sensitivity characteristic when vertically polarized wave in the receiving frequency band ranging from 88 MHz to 108 MHz is received. FIG. 41 shows a directivity pattern of the slot antenna. In FIG. 40, the dot-dash line IV represents a sensitivity characteristic for the slot antenna with the copper wires vertically extended over the lower half of the defogger only.

Figures 42A, 42B, 42C, 42D, 42E, 42F, 42G, 42H, 42I, 42J, 42K, 42L, 42M, 42N, 42O, 42P, 42Q, 42R:
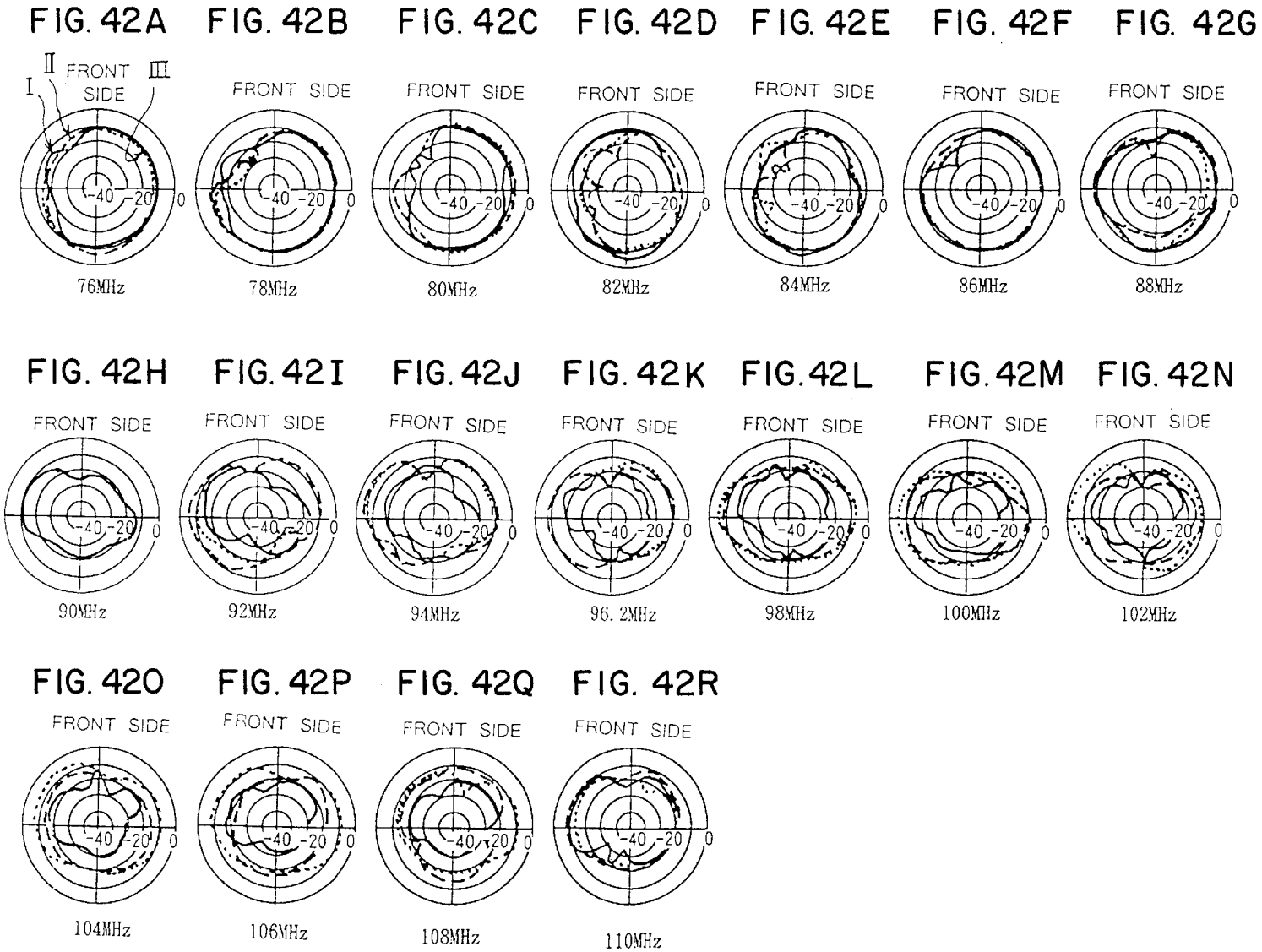
FIG. 42 shows a horizontally polarized wave directivity pattern of the slot antenna in FIG. 38A, wherein shorting bars are added onto the defogger.
Figures 43A, 43B, 43C, 43D, 43E, 43F, 43G, 43H, 43I, 43J, 43K, 43L, 43M, 43N, 43O, 43P, 43Q, 43R:
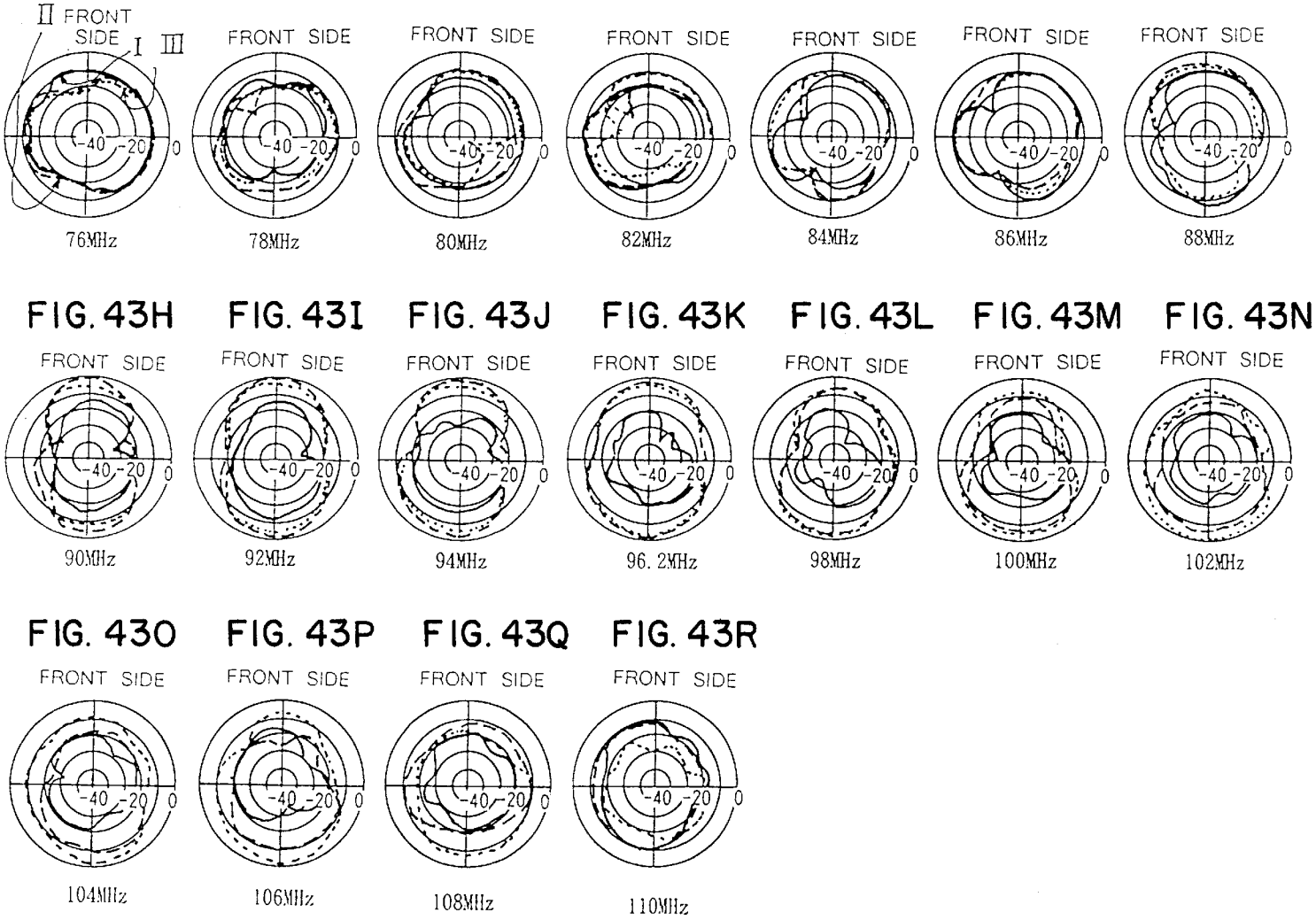
FIG. 43 shows a vertically polarized wave directivity pattern of the slot antenna setting corresponding to FIG. 42.

FIG. 42 shows directivity patterns of the slot antenna of a type shown in FIG. 38A, responsive to horizontally polarized wave, wherein the slot antenna further comprises a feeding point disposed at the top center of the loop conductor transversely across it and the length of the copper wires disposed within the defogger is changed. FIG. 43 shows directivity patterns responsive to vertically polarized wave.

The graphs plotted in FIG. 38B through FIG. 43 indicate that the receiving sensitivity and directivity are improved by extending copper wires at least over the upper half of the defogger.

Figure 44:
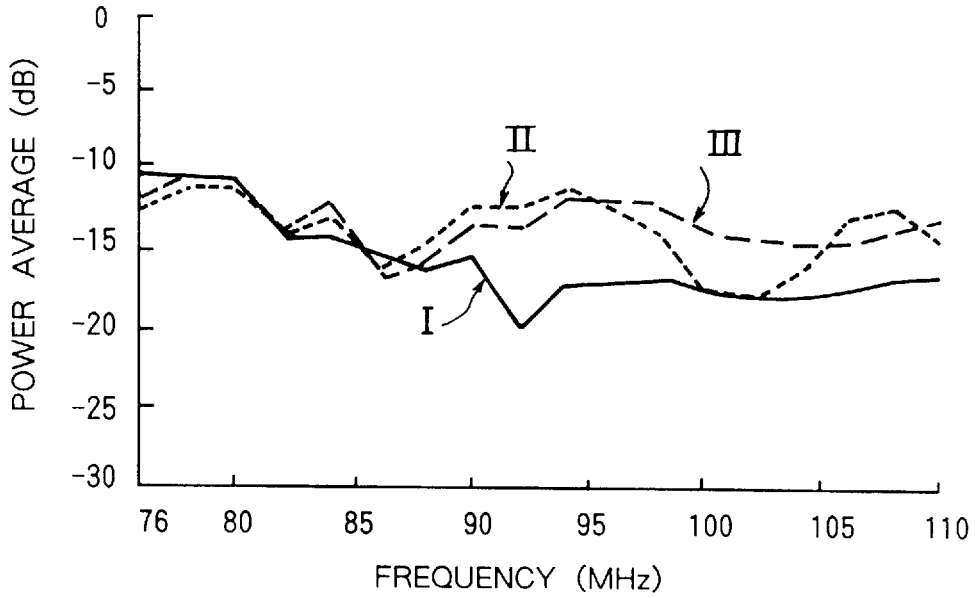
FIG. 44 shows a horizontally polarized wave receiving sensitivity characteristic of the slot antenna wherein the number of shorting bars added onto the defogger is changed.
Figure 45:
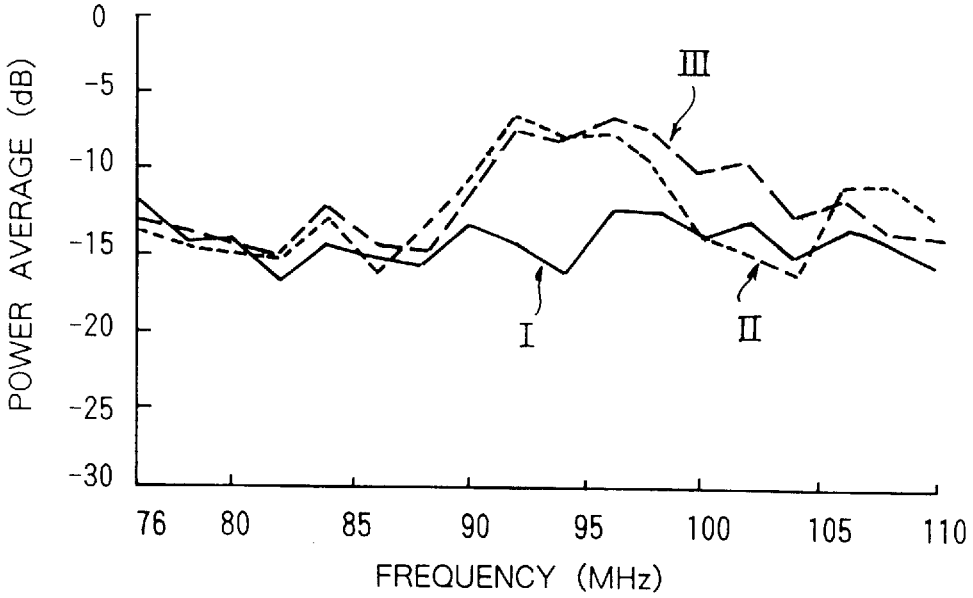
FIG. 45 shows a vertically polarized wave receiving sensitivity characteristic of the slot antenna setting corresponding to FIG. 44.

FIG. 44 shows a receiving sensitivity characteristic of the slot antenna of a type shown in FIG. 42, responsive to horizontally polarized wave, wherein the number of copper wires extended within the defogger is changed. FIG. 45 shows a receiving sensitivity characteristic of the same slot antenna responsive to vertically polarized wave. In this case, the copper wires are extended from the top to the bottom of the defogger. In FIG. 44 and FIG. 45, the solid line I represents a sensitivity characteristic for the slot antenna with no copper wires employed, the dotted line II represents a sensitivity characteristic for the slot antenna with a single copper wire vertically extended between the left-hand and right-hand sides of the defogger, and the dotted line III represents a sensitivity characteristic for the slot antenna with three copper wires vertically extended one in the center and two on both sides of the center copper wire. As seen from FIG. 44 and FIG. 45, the larger the number of copper wires the higher the receiving sensitivity characteristic.

Figure 46:
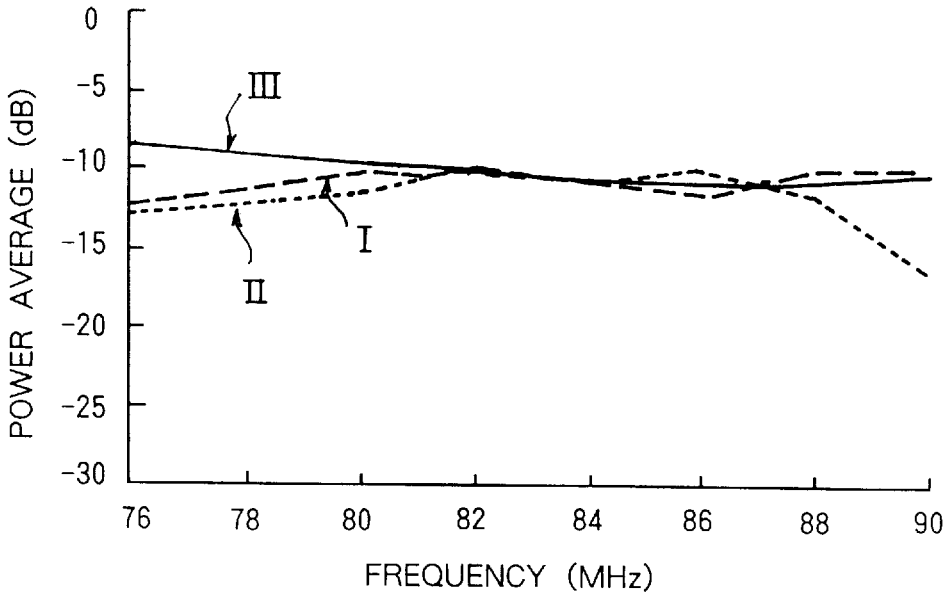
FIG. 46 shows a horizontally polarized wave receiving sensitivity characteristic of the slot antenna with and without capacitor.

FIG. 46 shows a receiving sensitivity characteristic of the slot antenna of a type having no choke coil (like the one shown in FIG. 5), responsive to horizontally polarized wave. In FIG. 46, the slot antenna having the capacitor 29 connected between the top-right corner of the conductor and the defogger gives the receiving sensitivity characteristic as represented by the dotted line I, and the slot antenna without the capacitor 29 gives the receiving sensitivity characteristic as represented by the dotted line II. The slot antenna with the capacitor 29 outperforms the slot antenna without the capacitor 29 over a wide frequency range, and achieves substantially the same receiving sensitivity characteristic as that of a rear pole antenna (solid line I).

Figure 47B:
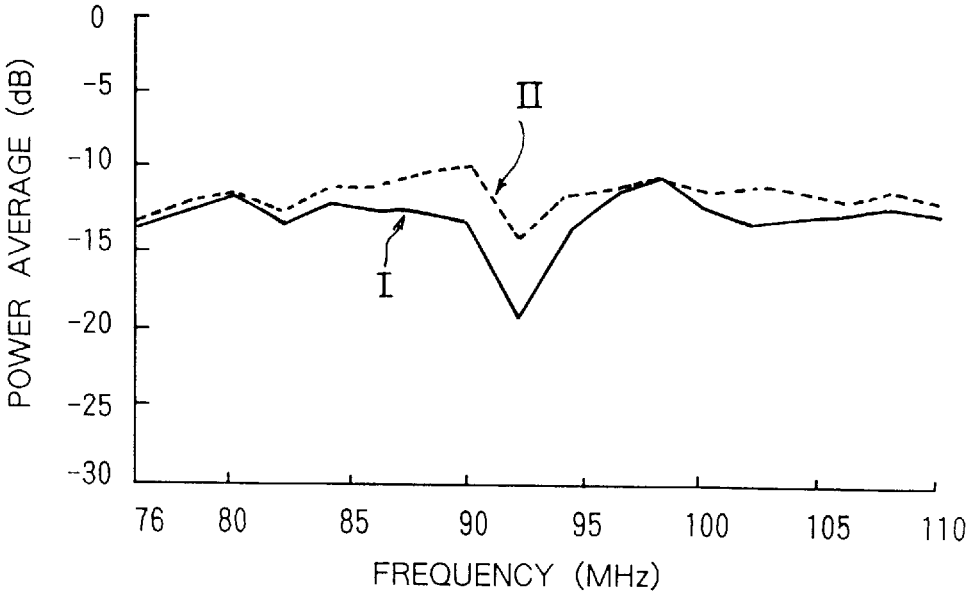
FIG. 47B shows a horizontally polarized wave receiving sensitivity characteristic of the slot antenna in FIG. 47A.

FIG. 47B shows a receiving sensitivity characteristic, responsive to horizontally polarized wave, of the slot antenna wherein a defogger is positioned inside a horizontally oriented U-shaped conductor and choke coils are connected to the defogger. FIG. 48 shows a receiving sensitivity characteristic of the same slot antenna responsive to vertically polarized wave. The slot antenna shown in FIG. 47A is considered as one example of the above slot antenna.

Figure 47A:
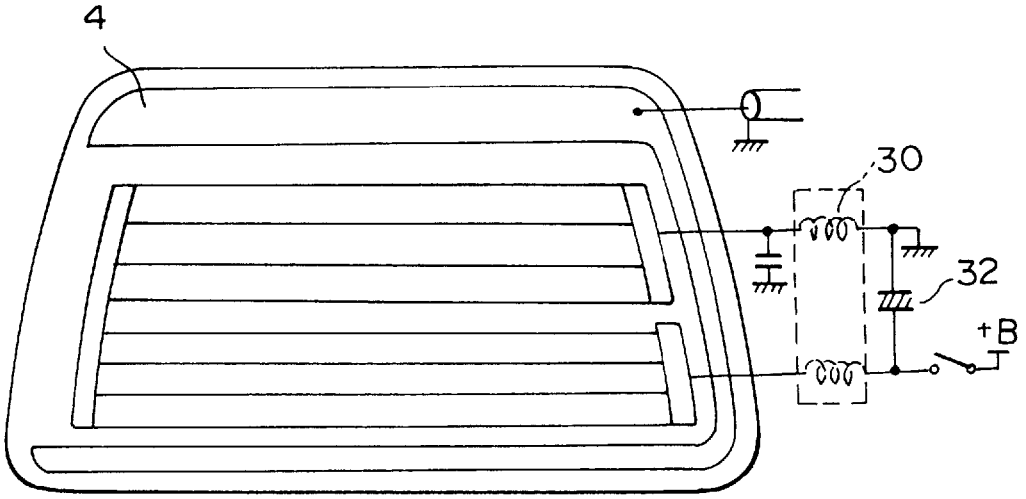
FIG. 47A shows a slot antenna setting that resulted in the test data presented in FIG. 47B and FIG. 48.
Figure 48:
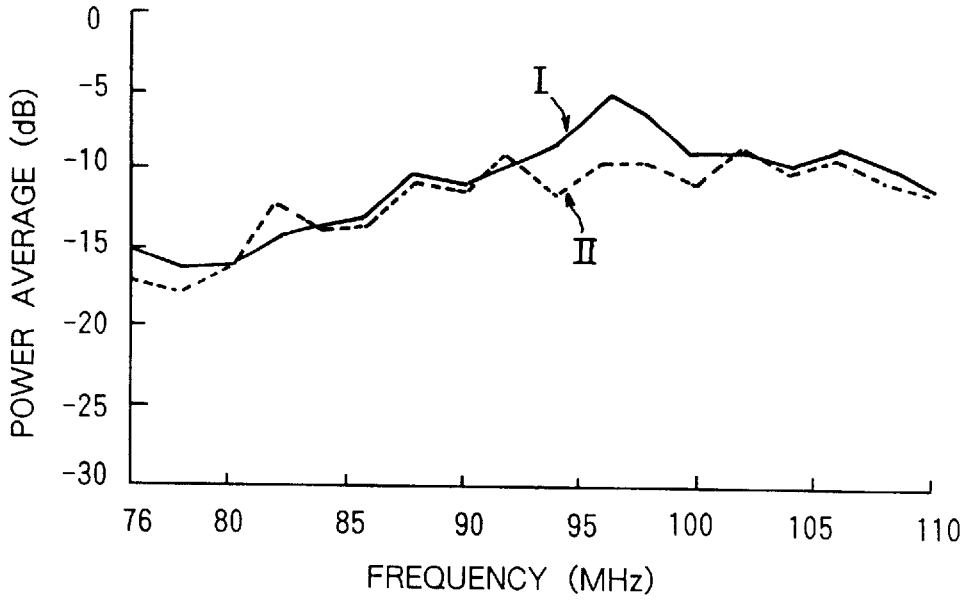
FIG. 48 shows a vertically polarized wave receiving sensitivity characteristic of the slot antenna setting corresponding to FIG. 47B.

In FIG. 47B and FIG. 48, the solid line I represents a receiving sensitivity characteristic of the slot antenna having a capacitor for use as a noise filter (like the capacitor 32 in FIG. 6) as in FIG. 47A, and the dotted line II represents a receiving sensitivity characteristic of the slot antenna having a choke coil 30 in addition to the capacitor as the noise filter. As seen from FIG. 47B and FIG. 48, receiving sensitivity characteristics are substantially identical regardless of whether the choke is used or not.

Figure 49:
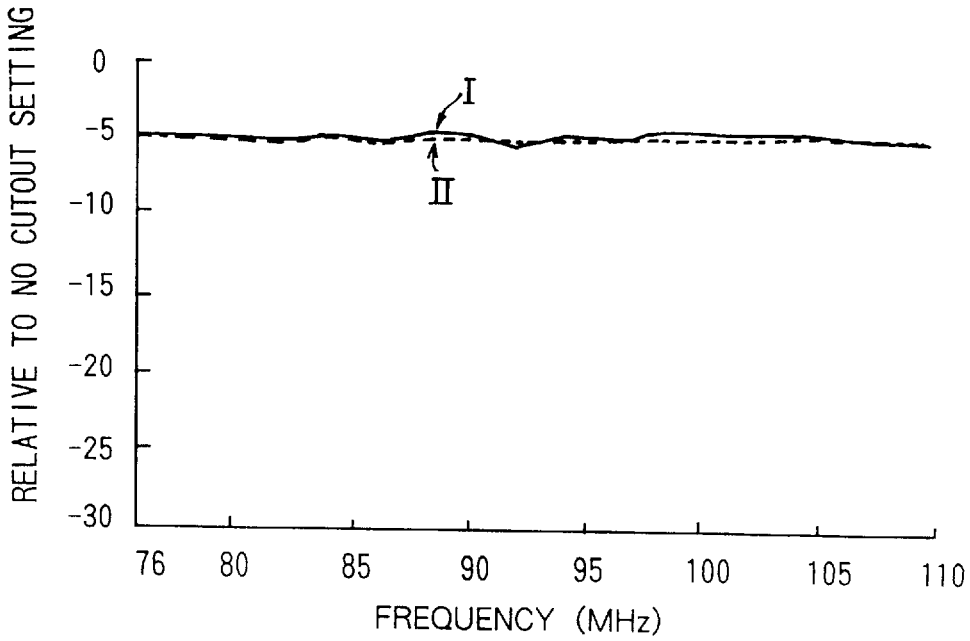
FIG. 49 shows a vertically polarized wave receiving sensitivity characteristic of the slot antenna wherein a square cutout is formed on the top portion of the conductor, with the characteristic of the slot antenna without cutout as a reference.

FIG. 49 shows a receiving sensitivity characteristic of a slot antenna responsive to vertically polarized wave wherein the slot antenna has a square opening (hole) of 4 cm by 4 cm at the center of the top conductor portion (10 cm wide) transversely across the conductor, with the top side of the opening disposed 2 mm below the top edge of the top conductor portion. In FIG. 49, the solid line I represents a receiving sensitivity characteristic of the slot antenna with the opening, and the dotted line II represents a receiving sensitivity characteristic of the slot antenna without the opening. As seen from FIG. 49, regardless whether the opening is disposed or not, the same receiving sensitivity characteristic results.

Figure 52:
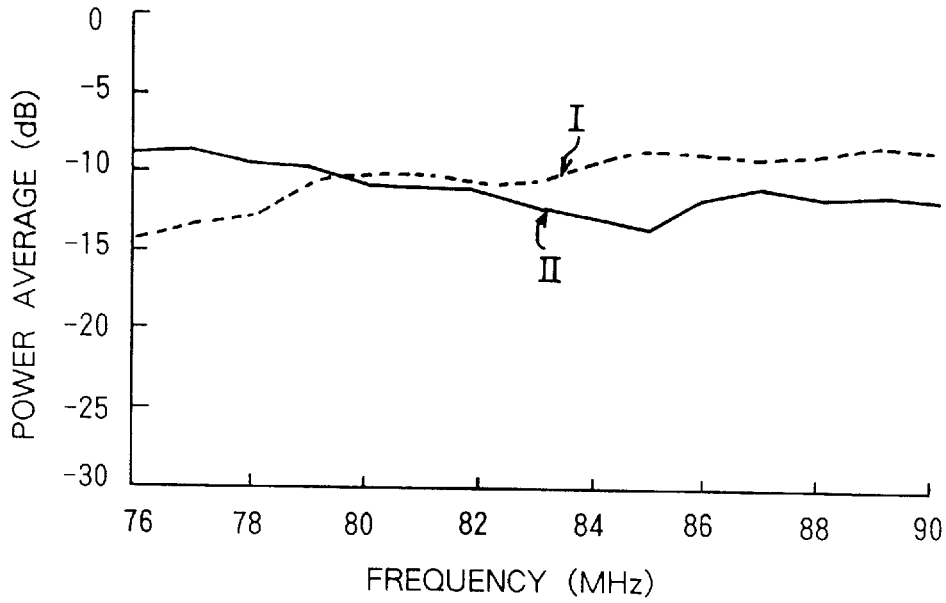
FIG. 52 shows a horizontally polarized wave receiving sensitivity characteristic of the slot antenna with choke coils, wherein the feeding point is set to the top-right corner of the conductor having a slit at its bottom-left corner and a capacitor is coupled to the top-right corner of the conductor.

FIG. 52 shows a receiving sensitivity characteristic of the slot antenna of a type shown in FIG. 6, wherein the slot antenna has a slit at the bottom-left corner of the conductor, the capacitor 31 is removed, a feeding point is set to the top-right corner of the conductor, and the capacitor 29 is connected to the top-right corner of the conductor. In FIG. 52, the dotted line I represents a receiving sensitivity characteristic of the slot antenna responsive to horizontally polarized wave and the solid line II shows a comparative characteristic of a rear pole antenna.

Figure 53:
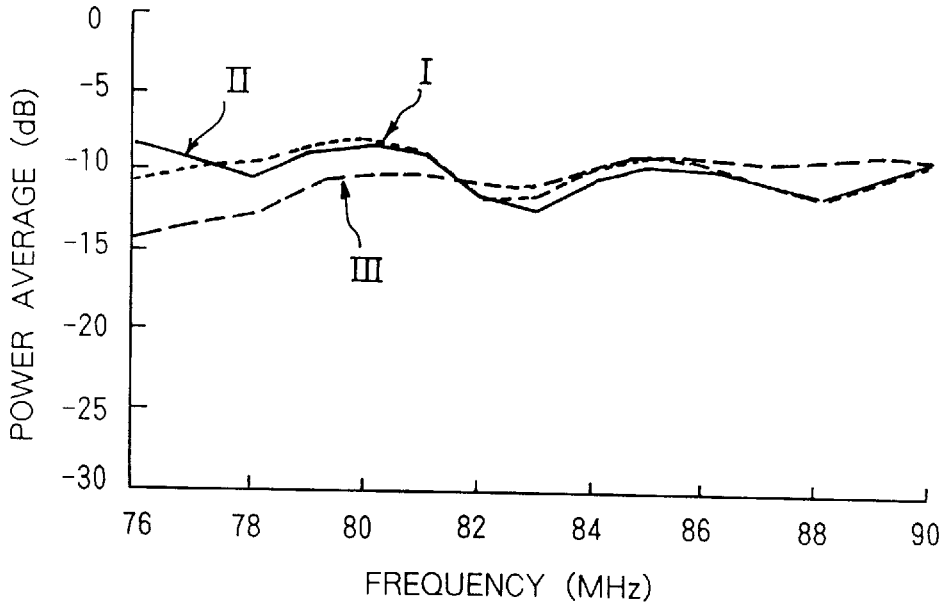
FIG. 53 shows a horizontally polarized wave receiving sensitivity characteristic of the slot antenna wherein a capacitor is coupled in parallel with the choke coil coupled to the defogger.

FIG. 53 shows a horizontally polarized wave receiving sensitivity characteristic (as represented by the solid line I) of the slot antenna (of a type shown in FIG. 6) wherein a choke coil is connected to the defogger and further the capacitor 31 is connected in parallel with the choke coil. For comparison, FIG. 53 shows a receiving sensitivity characteristic (as represented by the solid line II) of the slot antenna with the capacitor only connected, and the receiving sensitivity characteristic (as represented by the dotted line III) of the slot antenna with the choke coil only connected. As seen from FIG. 53, the addition of the capacitor effectively prevents the receiving sensitivity characteristic from changing greatly over the FM band, compared with the slot antenna with the choke coil only.

Effect of Slit on Test Data

Figure 54:
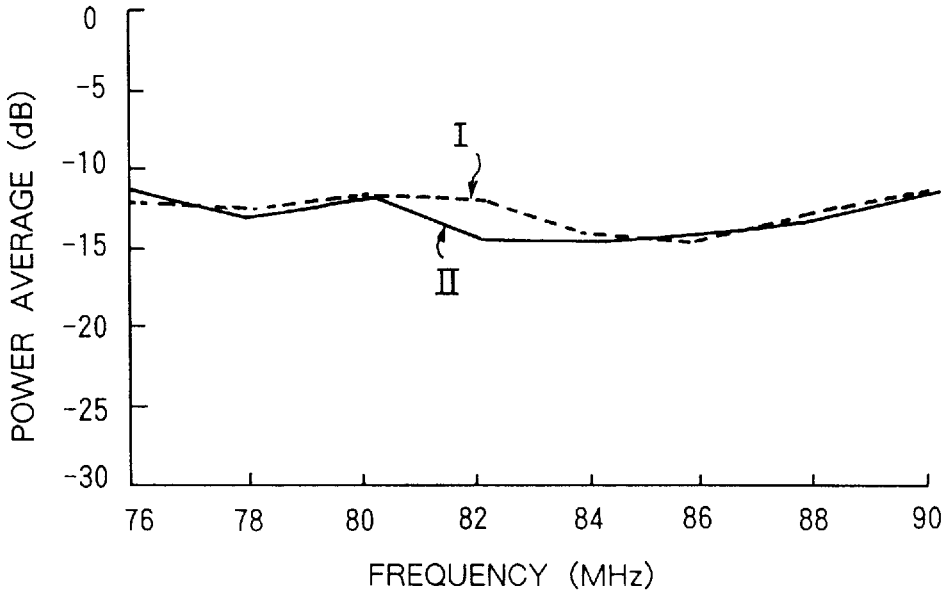
FIG. 54 shows a horizontally polarized wave receiving sensitivity characteristic of the slot antenna (FIG. 50), wherein a slit is formed at the bottom-left corner of the conductor loop which has its feeding point at its top-right corner.

FIG. 54 shows a horizontally polarized wave receiving sensitivity characteristic (as represented by the dotted line I) of the slot antenna (of a type shown in FIG. 50), wherein the slot antenna has the conductor loop with a feeding point at its top-right corner and a slit at its bottom-left corner. Shown there for comparison is the receiving sensitivity characteristic (as represented by the solid line II) of the slot antenna without slit.

Figure 50:
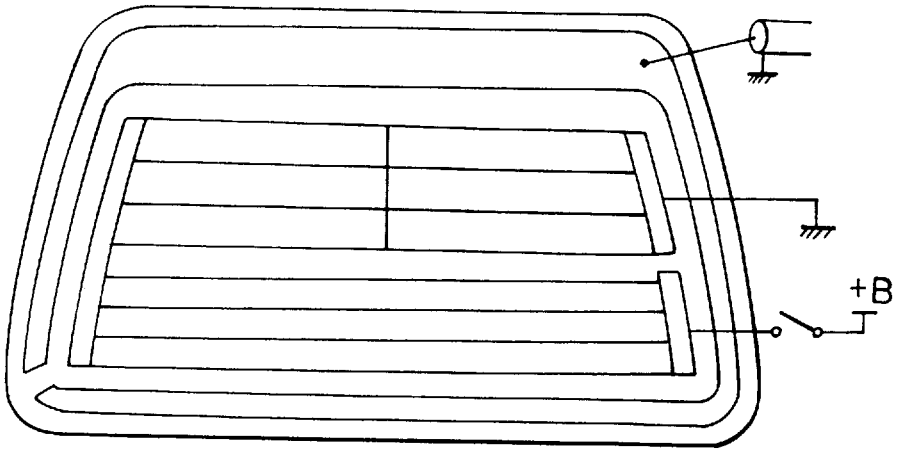
FIG. 50 shows a slot antenna setting that resulted in the test data presented in FIG. 55 through FIG. 71, FIG. 76, FIG. 80 through FIG. 82.
Figure 55:
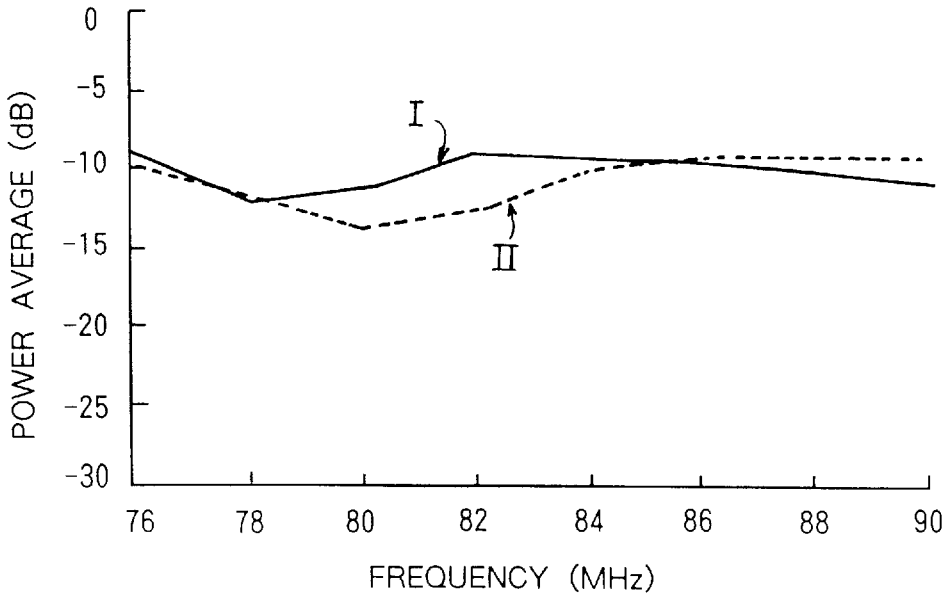
FIG. 55 shows a horizontally polarized wave receiving sensitivity characteristic of the slot antenna that has the feeding point and the slit shifted from those in the slot antenna in FIG. 50.
Figure 56:
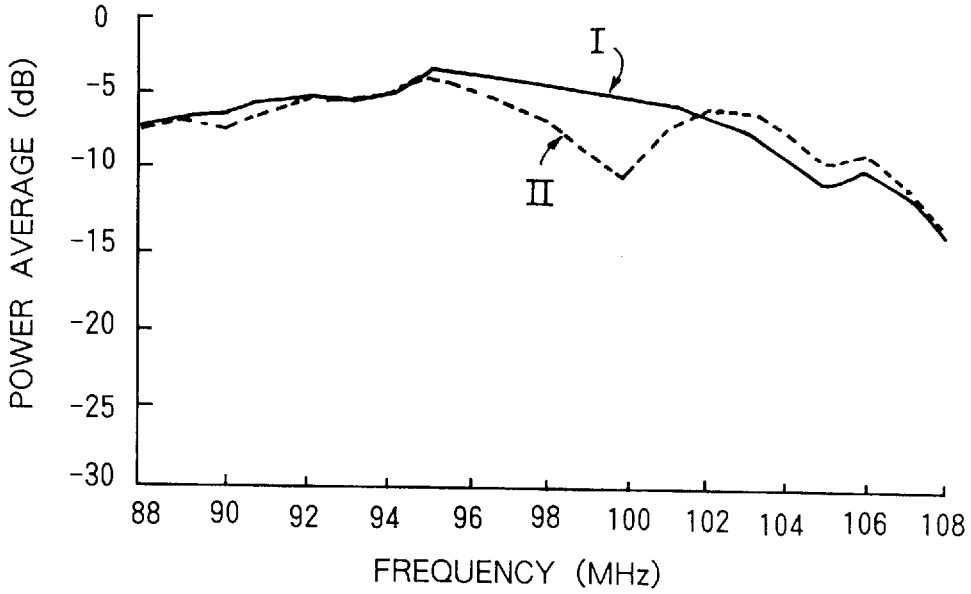
FIG. 56 shows a vertically polarized wave receiving sensitivity characteristic of the slot antenna setting corresponding to FIG. 55.

FIG. 55 shows a horizontally polarized wave receiving sensitivity characteristic (as represented by the solid line I) of the slot antenna of a type shown in FIG. 50, wherein the slit is shifted to the center of the bottom conductor portion and the feeding point is shifted to the center of the top conductor portion. Shown there for comparison is the receiving sensitivity characteristic (as represented by the dotted line II) of the slot antenna without slit. FIG. 56 shows a vertically polarized wave receiving sensitivity characteristic of the slot antenna having the same arrangement as above. As seen from FIG. 55 and FIG. 56, the use of the slit achieves an enhanced sensitivity characteristic.

Figure 57:
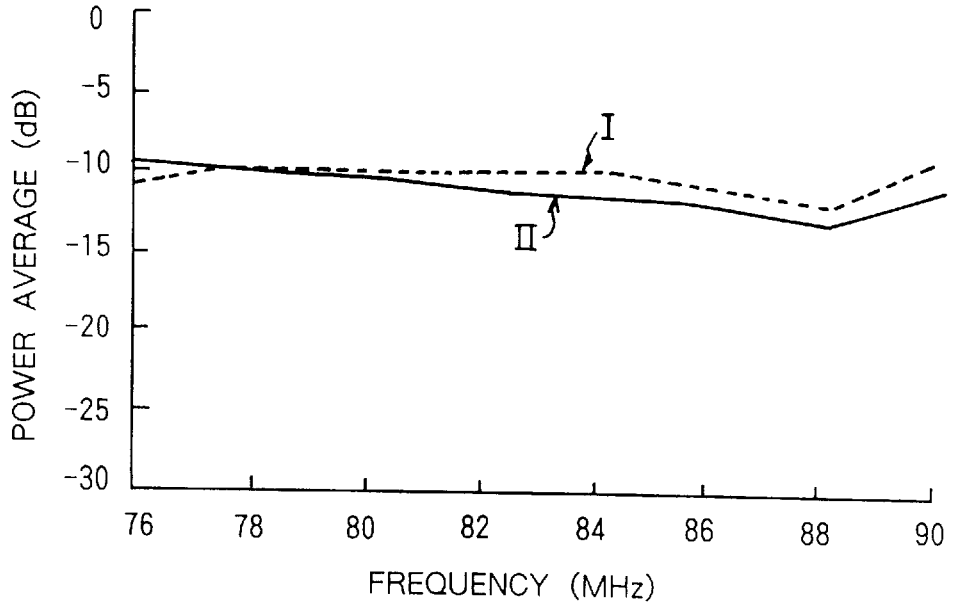
FIG. 57 shows a horizontally polarized wave receiving sensitivity characteristic of the slot antenna that has the feeding point shifted from that in the slot antenna in FIG. 50.
Figure 58:
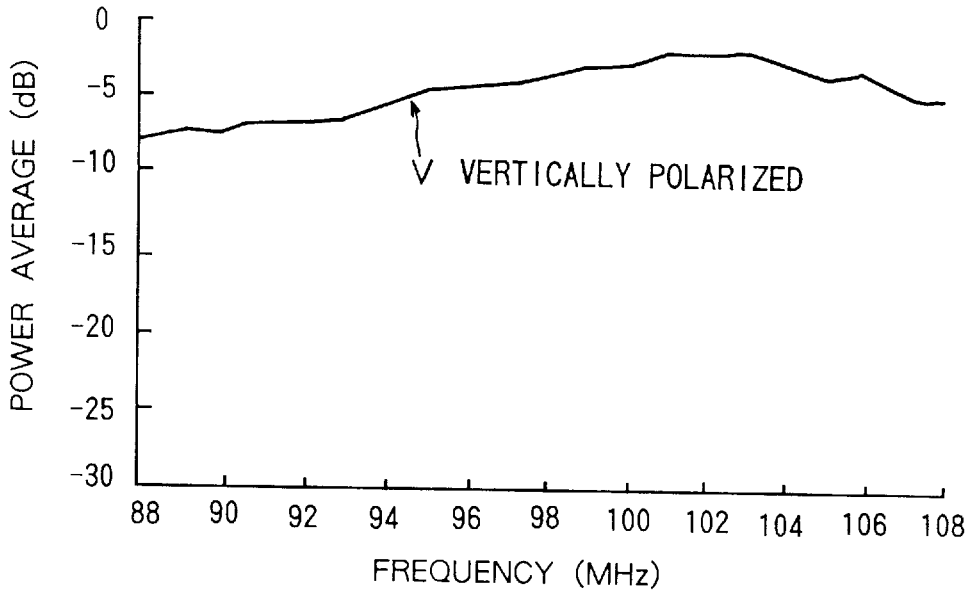
FIG. 58 shows a vertically polarized wave receiving sensitivity characteristic of the slot antenna setting corresponding to FIG. 57.

FIG. 57 shows a horizontally polarized wave receiving sensitivity characteristic (as represented by the solid line I) of the slot antenna of a type having a slit at the bottom-left corner of the conductor and a feeding point at the center of the top conductor portion (namely, equivalent to the slot antenna in FIG. 50 except that the feeding point is set to the center of the top conductor portion). FIG. 58 shows a vertically polarized wave receiving sensitivity characteristic of the same slot antenna. As seen from FIG. 57 and FIG. 58, the embodied slot antenna achieves substantially the same performance as that of a rear pole antenna (as represented by the solid line).

Figure 59:
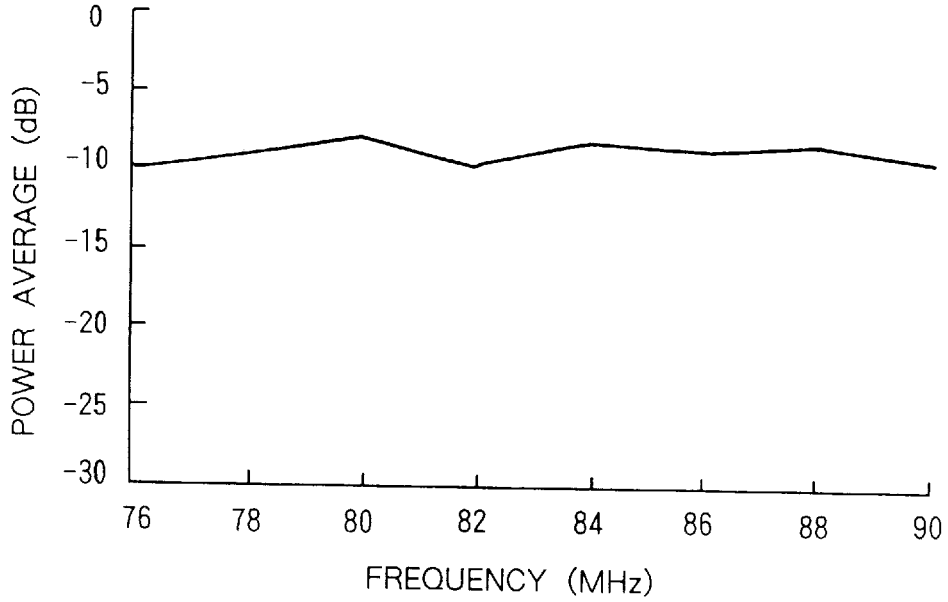
FIG. 59 shows a horizontally polarized wave receiving sensitivity characteristic of the slot antenna that has the feeding point shifted from that in the slot antenna in FIG. 50.
Figure 60:
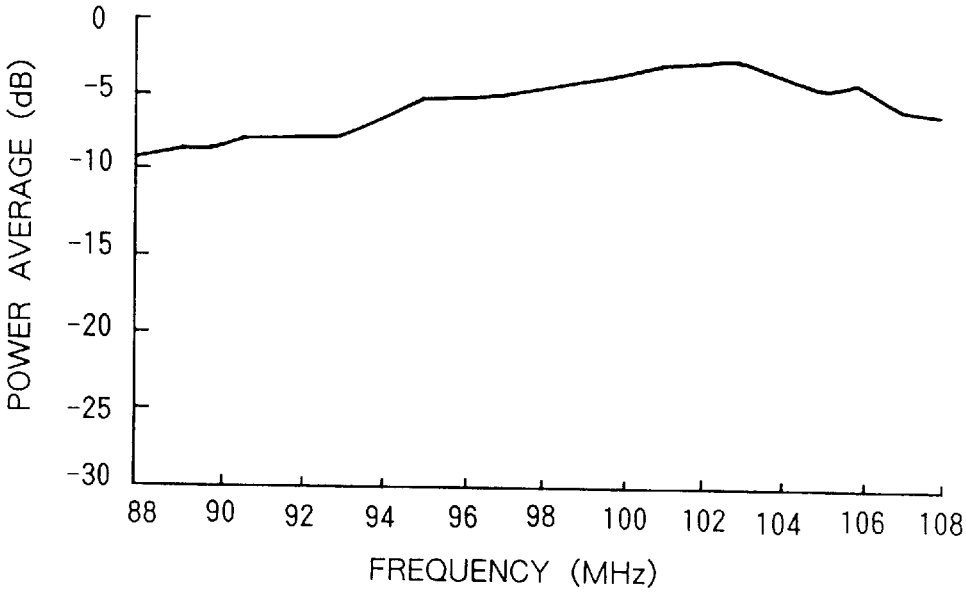
FIG. 60 shows a vertically polarized wave receiving sensitivity characteristic of the slot antenna setting corresponding to FIG. 59.

FIG. 59 shows a horizontally polarized wave receiving sensitivity characteristic of the slot antenna which has no choke coils, a slit at the bottom-left corner of the conductor and a feeding point at the top-left corner of the conductor (namely, equivalent to the slot antenna in FIG. 50 except that the feeding point is set to the top-left corner of the conductor). FIG. 60 shows a vertically polarized wave receiving sensitivity characteristic of the same slot antenna.

Figure 61:
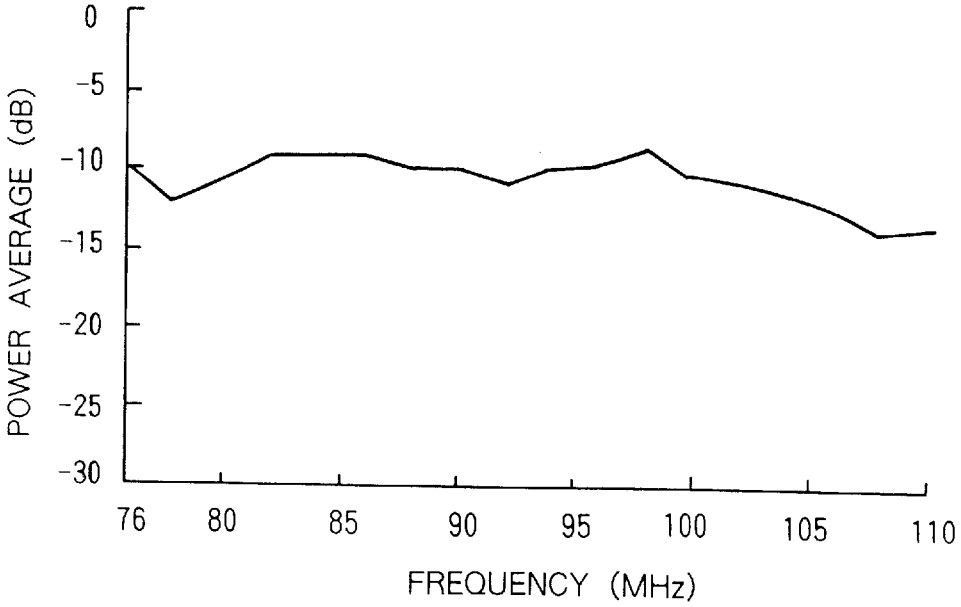
FIG. 61 shows a horizontally polarized wave receiving sensitivity characteristic of the slot antenna that has the feeding point and the slit shifted from those in the slot antenna in FIG. 50.
Figure 62:
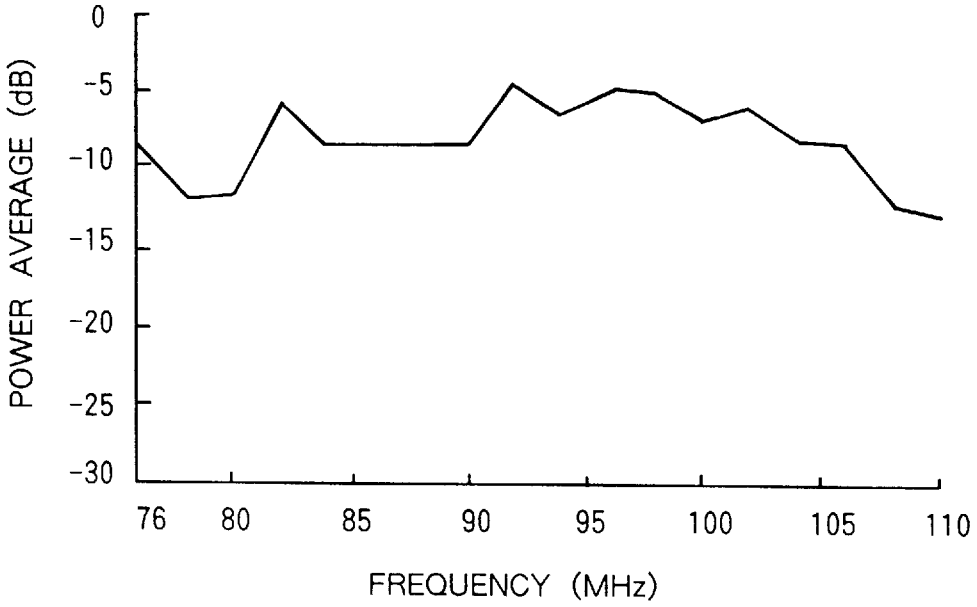
FIG. 62 shows a vertically polarized wave receiving sensitivity characteristic of the slot antenna setting corresponding to FIG. 61.

FIG. 61 shows a horizontally polarized wave receiving sensitivity characteristic of the slot antenna wherein slits are disposed, each at both left-hand and right-hand vertical portions and the bottom portion of the conductor so that the upper half portion of the conductor surrounding the upper half defogger thus effectively functions, and a feeding point is set to the center of the top portion of the conductor (namely, difference from the slot antenna in FIG. 50 lies in the positions of the feeding point and the slits). FIG. 62 shows a vertically polarized wave receiving sensitivity characteristic of the same slot antenna as above.

Figure 63:
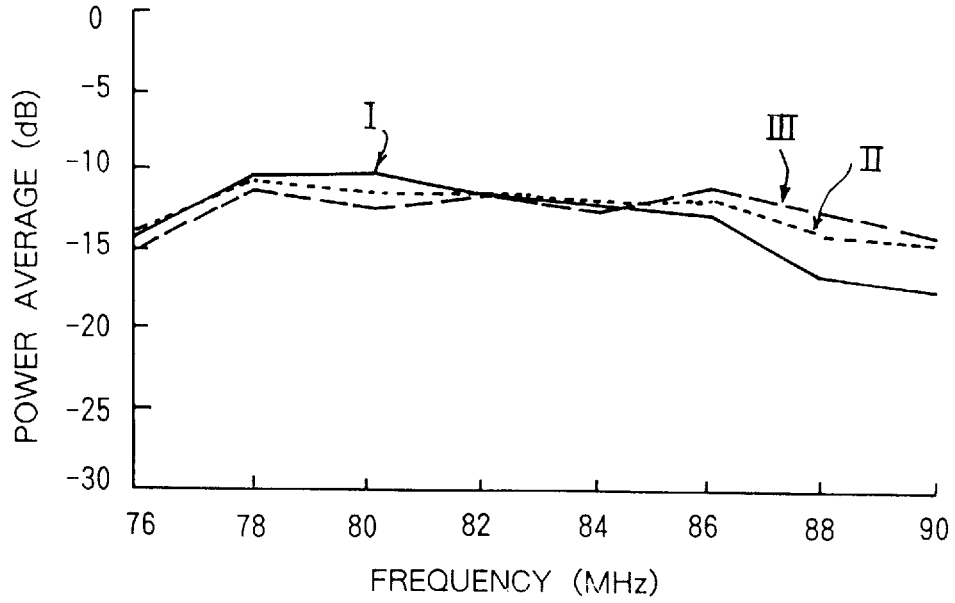
FIG. 63 shows a horizontally polarized wave receiving sensitivity characteristic of the slot antenna that has a feeding point position, and the position and width of a slit modified from those in the slot antenna in FIG. 50.

FIG. 63 shows a horizontally polarized wave receiving sensitivity characteristic of the slot antenna, as represented by the dotted line II, wherein a feeding point is set to the top-right corner of the conductor, and a slit is disposed at the bottom-left corner of the conductor (namely, the difference from the slot antenna in FIG. 50 lies in the positions of the feeding point and the slit and the width of the slit). In FIG. 63, the solid line I represents a sensitivity characteristic of the slot antenna in which the slit is shifted upward by 5 cm from its original position in the slot antenna represented by the dotted line II, and the dotted line III represents a sensitivity characteristic of the slot antenna in which the slit is shifted downward by 5 cm from its original position in the slot antenna represented by the dotted line II. Position change of the slit shifts the peak value in the receiving sensitivity characteristic. Namely, the position change of the slit allows the slot antenna to tune to a desired frequency for a peak receiving sensitivity characteristic.

Figure 64:
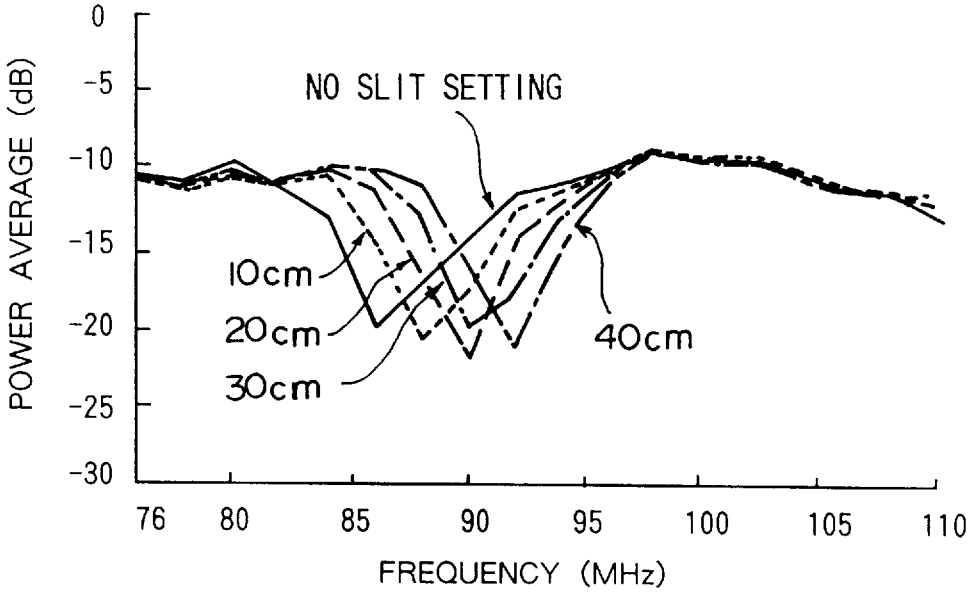
FIG. 64 shows a horizontally polarized wave receiving sensitivity characteristic of the slot antenna shown in FIG. 50, wherein a variety of slit width ranging from 0 to 40 cm were tested.
Figure 65:
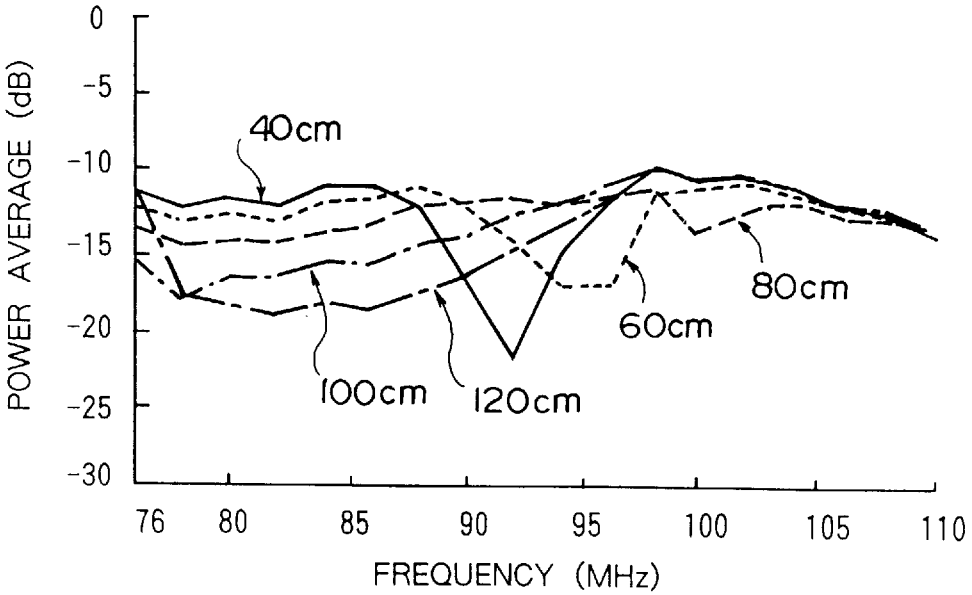
FIG. 65 shows a horizontally polarized wave receiving sensitivity characteristic of the slot antenna in FIG. 64, wherein a variety of slit width ranging from 40 to 120 cm were tested.
Figure 66:
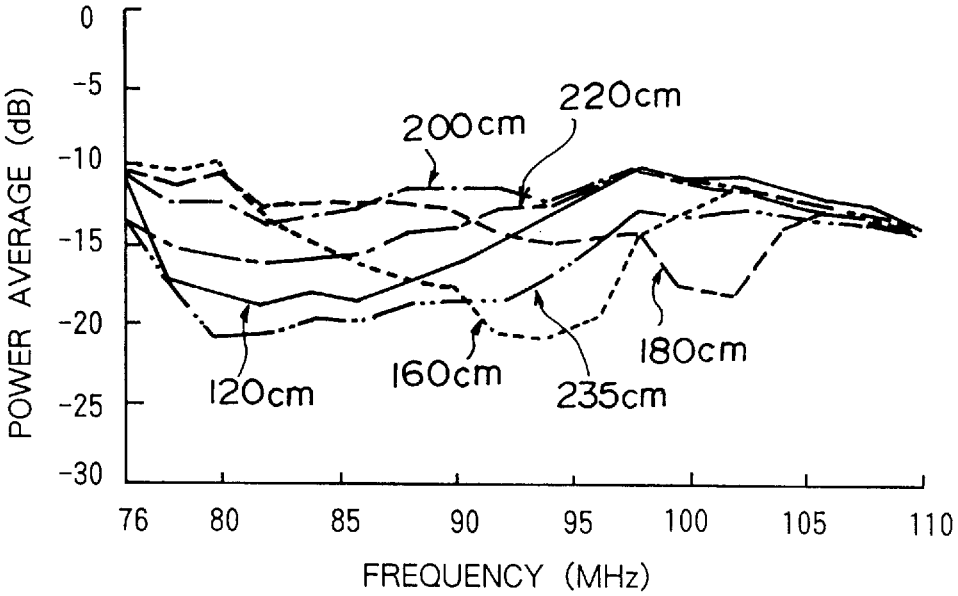
FIG. 66 shows a horizontally polarized wave receiving sensitivity characteristic of the slot antenna in FIG. 64, wherein a variety of slit width ranging from 120 to 235 cm were tested.

FIG. 64 shows a horizontally polarized wave receiving sensitivity characteristic of the slot antenna which comprises a feeding point at the top-left corner of the conductor and a slit at the bottom-left corner of the conductor wherein the widths of the slit of 0 cm, 10 cm, 20 cm, 30 cm, and 40 cm are tested. FIG. 65 shows a horizontally polarized wave receiving characteristic of the same slot antenna wherein the widths of the slit of 40 cm, 60 cm, 80 cm, 100 cm and 120 cm are tested. FIG. 66 shows a horizontally polarized wave receiving characteristic of the same slot antenna wherein the widths of the slit of 120 cm, 160 cm, 180 cm, 200 cm, 220 cm and 230 cm are tested.

Figure 67:
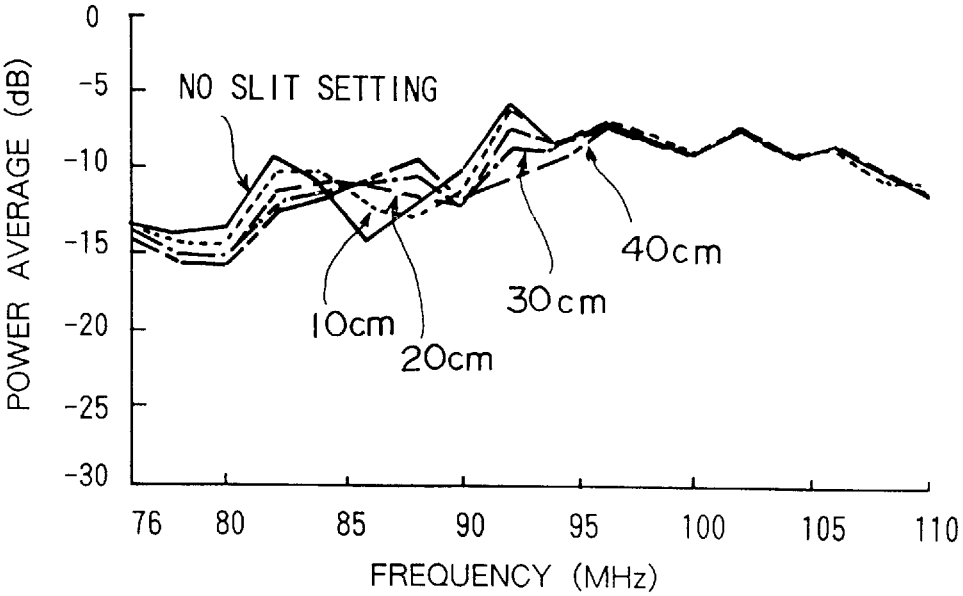
FIG. 67 shows a vertically polarized wave receiving sensitivity characteristic of the slot antenna in FIG. 50, wherein a variety of width of the slit at the top-left corner of the conductor, ranging from 0 to 40 cm, were tested.
Figure 68:
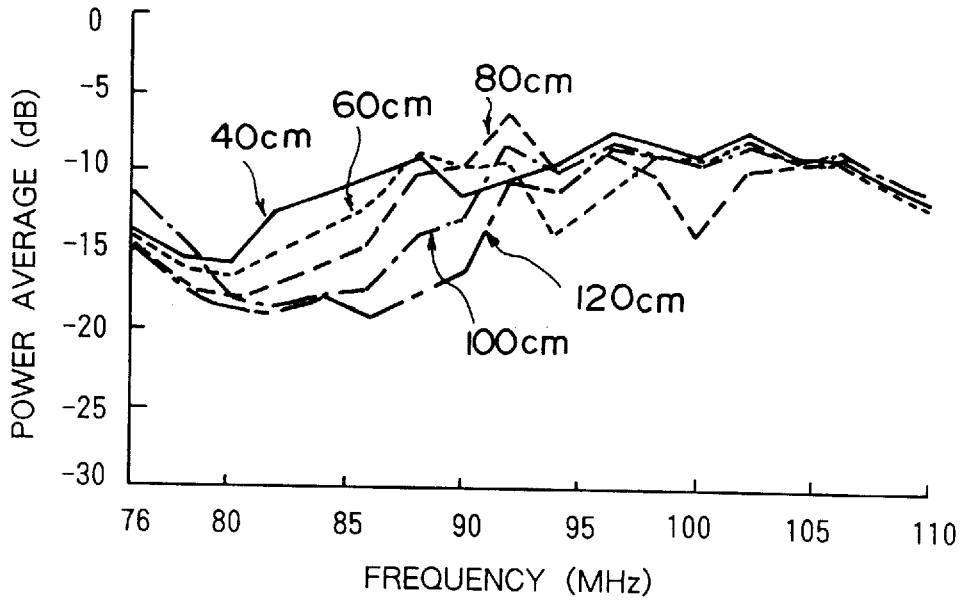
FIG. 68 shows a vertically polarized wave receiving sensitivity characteristic of the slot antenna in FIG. 67, wherein a variety of slit width, ranging from 40 to 120 cm, were tested.
Figure 69:
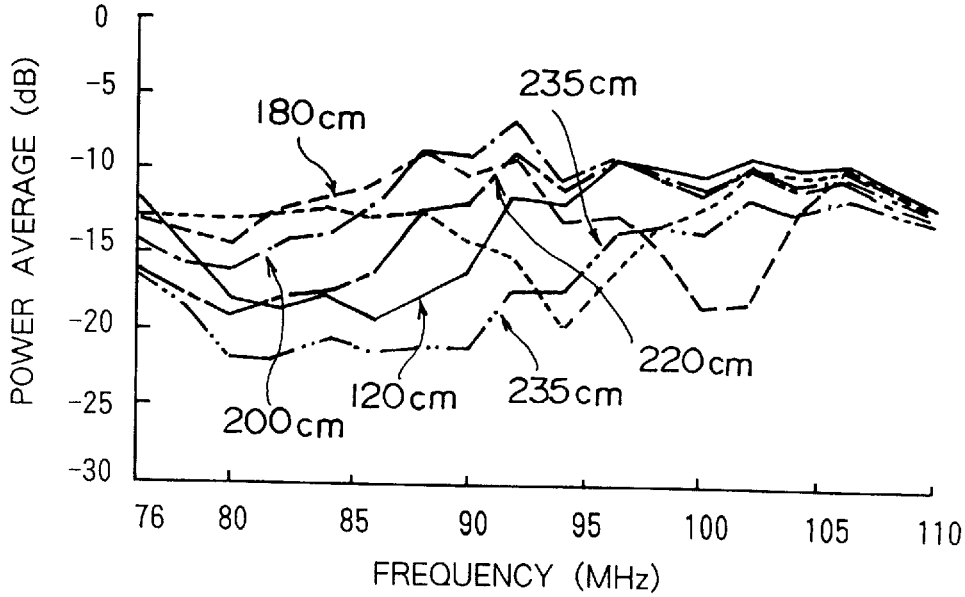
FIG. 69 shows a vertically polarized wave receiving sensitivity characteristic of the slot antenna in FIG. 67, wherein a variety of slit width, ranging from 120 to 235 cm, were tested.

FIG. 67, FIG. 68 and FIG. 69 show the vertically polarized wave receiving sensitivity characteristics of the respective slot antennas shown in FIG. 64, FIG. 65, and FIG. 66 under the same test conditions described with reference to FIG. 64, FIG. 65, and FIG. 66, respectively. As seen from FIG. 67 through FIG. 69, the change of slit width shifts the peak in the sensitivity characteristic. Therefore, the frequency of the peak receiving sensitivity characteristic can be adjusted.

Figure 70:
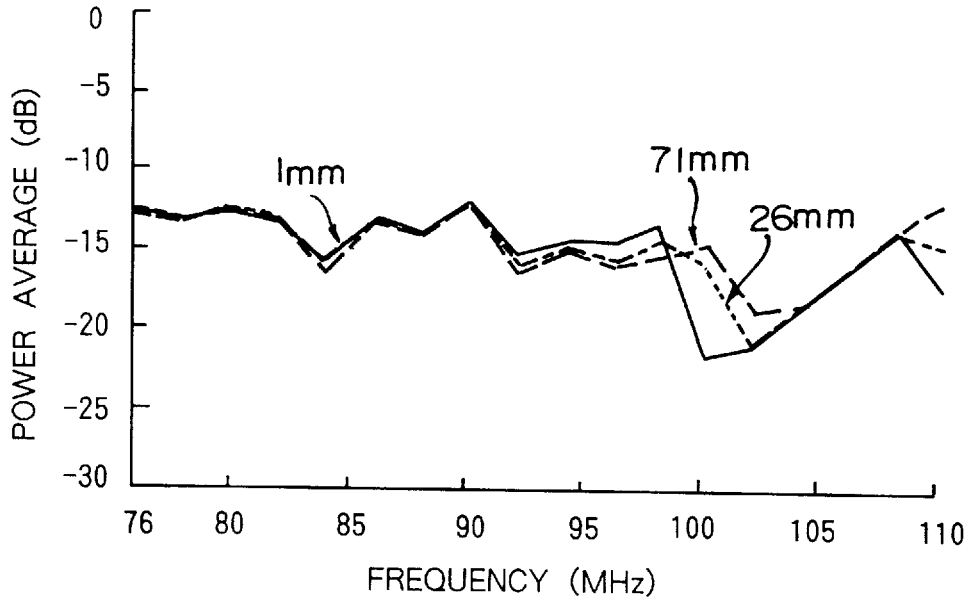
FIG. 70 shows a horizontally polarized wave receiving sensitivity characteristic of the slot antenna in FIG. 50, wherein the width of the slit at the bottom-left corner of the conductor was varied.
Figure 71:
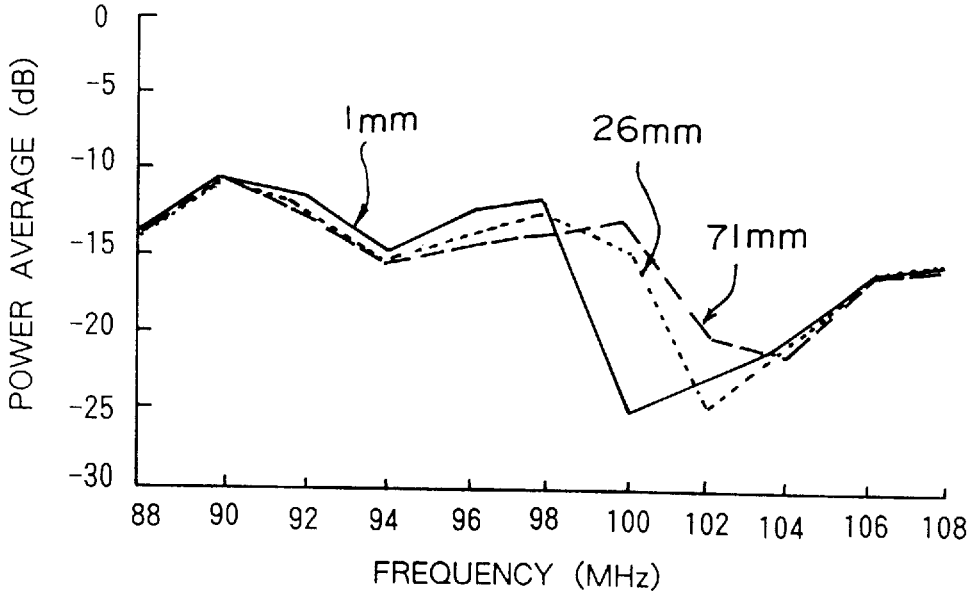
FIG. 71 shows a vertically polarized wave receiving sensitivity characteristic of the slot antenna setting corresponding to FIG. 70.

FIG. 70 shows a horizontally polarized wave receiving sensitivity characteristic of the slot antenna which comprises a feeding point at the top-right corner of a loop conductor and a slit at the bottom-left corner of the conductor, wherein the widths of the slit of 1 mm, 26 mm and 71 mm are tested. FIG. 71 shows a vertically polarized wave receiving sensitivity characteristic under the same slot antenna setting. As seen from FIG. 70 and FIG. 71, the change of slit width shifts the peak in the sensitivity characteristic. Therefore, the frequency of the peak receiving sensitivity characteristic can be adjusted.

Figure 51:
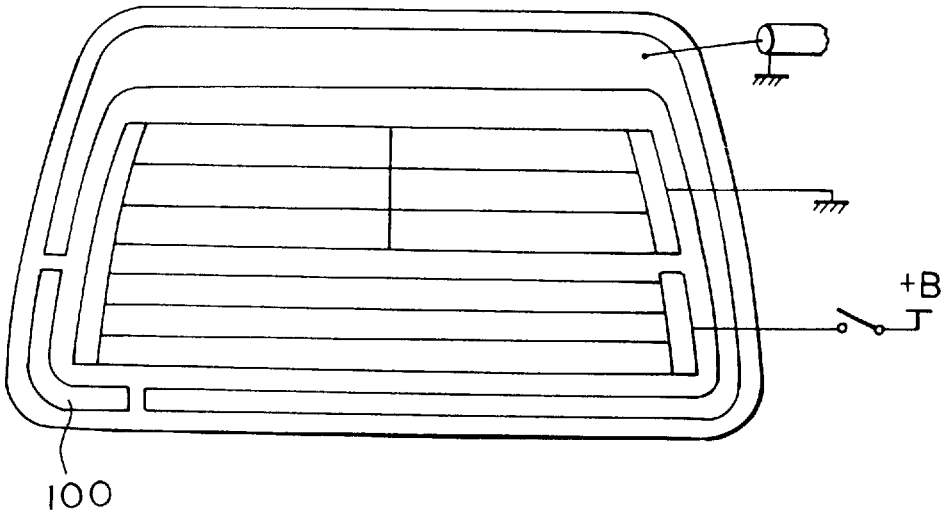
FIG. 51 shows a slot antenna setting that resulted in the test data presented in FIG. 72 and FIG. 73.
Figure 72:
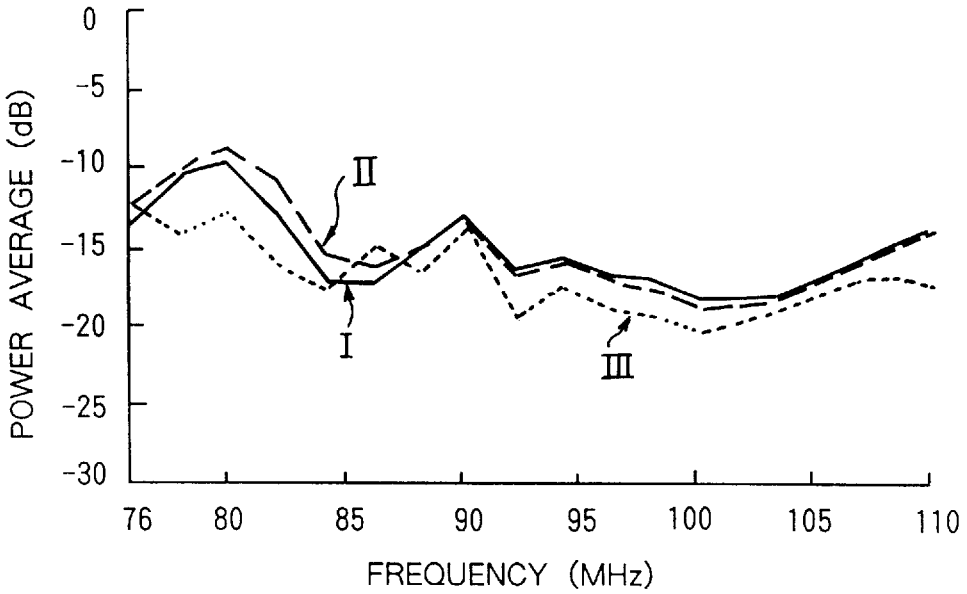
FIG. 72 shows a horizontally polarized wave receiving sensitivity characteristic of the slot antenna in FIG. 50, wherein two settings are compared: one setting in which a slit is formed on the conductor with the feeding point at the top-right corner and the other setting in which a copper sheet is disposed within the slit.
Figure 73:
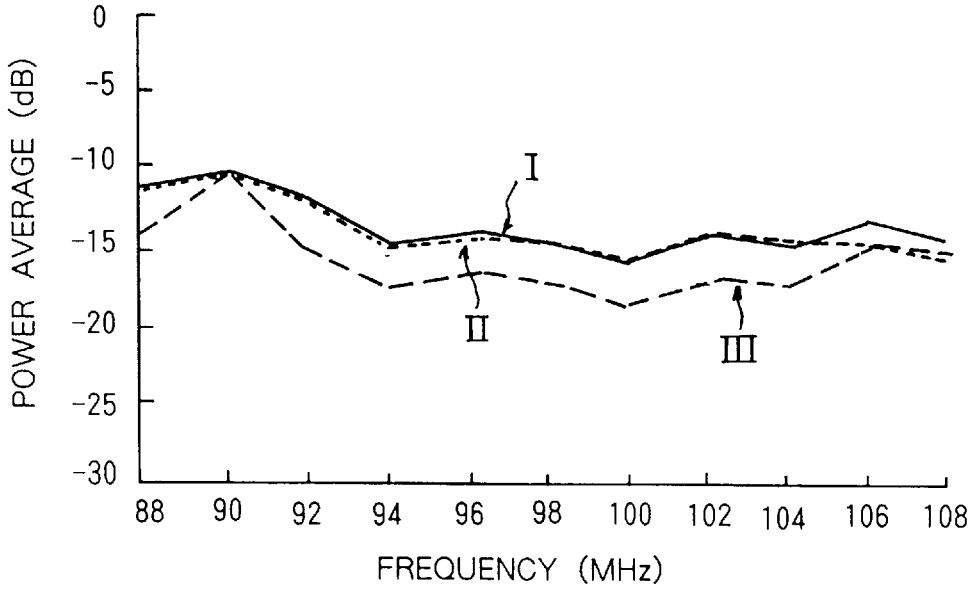
FIG. 73 shows a vertically polarized wave receiving sensitivity characteristic of the slot antenna setting corresponding to FIG. 72.

FIG. 72 shows a horizontally polarized wave receiving sensitivity characteristic of the slot antenna of a type shown in FIG. 51, wherein the feeding point is set to the top-right corner of the conductor 4, a slit is formed on the conductor, and a copper sheet 100 as part of the conductor 4 is disposed within the slit. FIG. 73 shows a vertically polarized wave receiving sensitivity characteristic under the same slot antenna setting. FIG. 51 shows such a slot antenna as described above. In FIG. 72 and FIG. 73, the solid line I represents a sensitivity characteristic of the slot antenna with the copper sheet within the slit, the dotted line II represents a sensitivity characteristic of the slot antenna with no copper sheet within the slit, and the dotted line III represents a sensitivity characteristic of the slot antenna with no slit at all for comparison. As seen from FIG. 72 and FIG. 73, whether or not the copper sheet is disposed within the slit does not make any substantial difference in the receiving sensitivity characteristic. This suggests that the slot antenna having two slits that are cut with a predetermined length allowed therebetween on the conductor is functionally equivalent to the slot antenna having a slit as wide as the predetermined length.

Effect of Position Change of Feeding Point on Test Data

Figure 74:
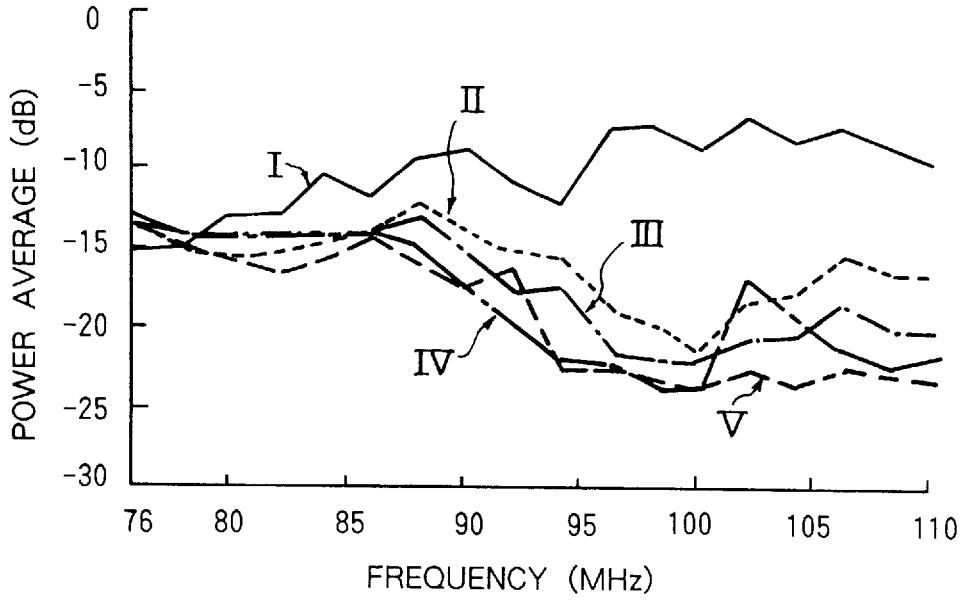
FIG. 74 shows a vertically polarized wave receiving sensitivity characteristic of the slot antenna in FIG. 38A, wherein a plurality of feeding points were tested on the conductor.
Figure 75:
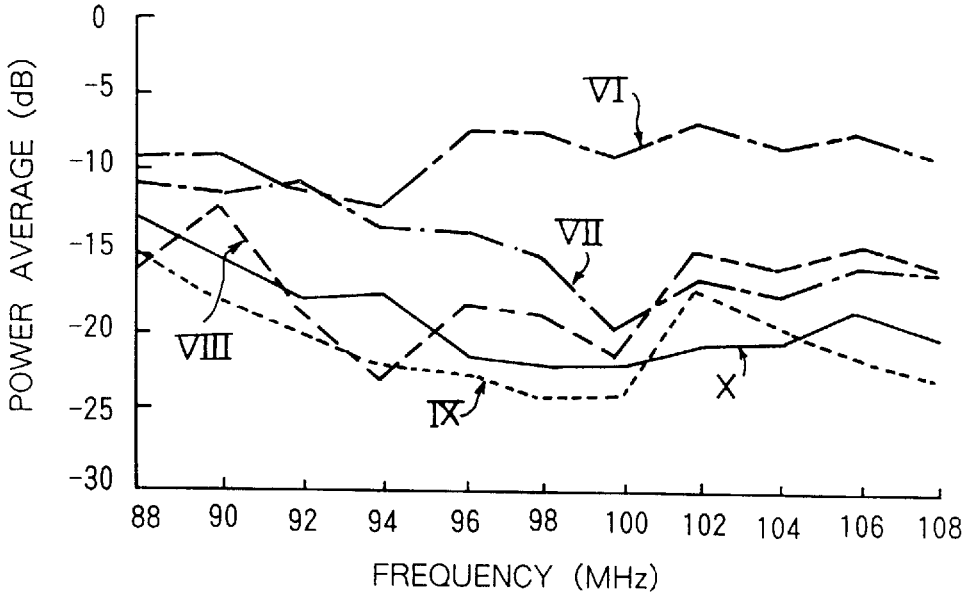
FIG. 75 shows a vertically polarized wave receiving sensitivity characteristic of the slot antenna wherein the feeding point position was changed on the conductor on the glass.

FIG. 74 shows a vertically polarized wave receiving sensitivity characteristic of the slot antenna having a complete conductor loop, wherein different positions are tested as the feeding point. FIG. 75 shows a vertically polarized wave receiving sensitivity characteristic of the slot antenna in which the glass window is entirely covered with the film conductor of FIG. 1, wherein the feeding point position is changed on the conductor in the same manner as above. In FIG. 74, the solid line I represents a sensitivity characteristic of the slot antenna where the feeding point is set to the top center of the conductor transversely across the conductor, the dotted line II represents a sensitivity characteristic of the slot antenna where the feeding point is set to the left-hand side of the conductor, the dotted line III represents a sensitivity characteristic of the slot antenna where the feeding point is set to the bottom-left corner of the conductor, the dot-dash line III represents a sensitivity characteristic of the slot antenna where the feeding point is set to the bottom-left corner of the conductor, the dot-dash line IV represents a sensitivity characteristic of the slot antenna where the feeding point is set to the bottom-right corner of the conductor, and the dotted line V represents a sensitivity characteristic of the slot antenna where the feeding point is set to the right-hand side of the conductor. In FIG. 75, the dot-dash line VI represents a sensitivity characteristic of the slot antenna where the feeding point is set to the top center of the conductor, the dot-dash line VII represents a sensitivity characteristic of the slot antenna where the feeding point is set to the top-left corner of the conductor, the dotted line VIII represents a sensitivity characteristic of the slot antenna where the feeding point is set to the top-right corner, the dotted line IX represents a sensitivity characteristic of the slot antenna where the feeding point is set to the bottom-right corner of the conductor, and the solid line X represents a sensitivity characteristic of the slot antenna where the feeding point is set to the bottom-left corner. As seen from FIG. 74 and FIG. 74, the feeding point set to the center of the conductor transversely across the conductor works excellently.

Figure 76:
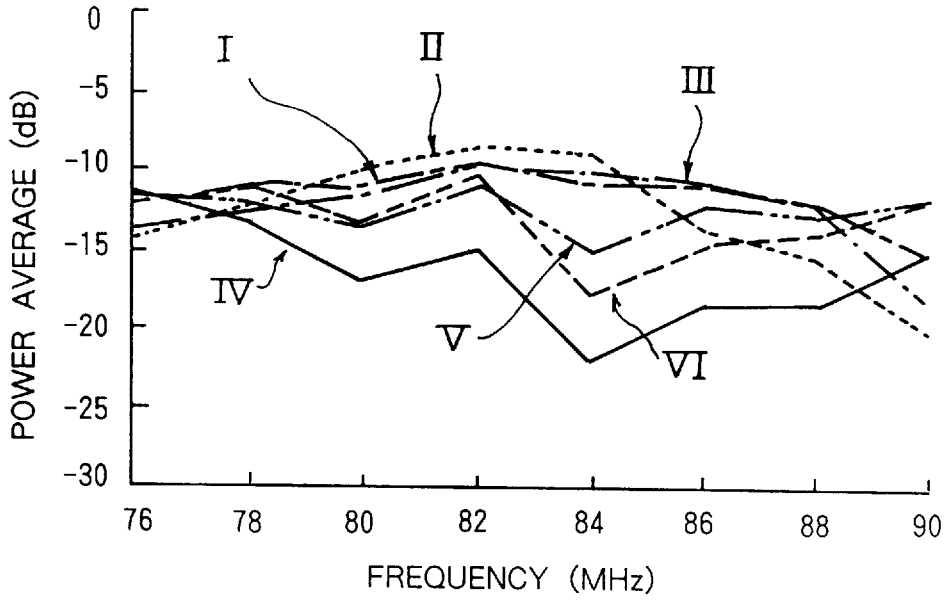
FIG. 76 shows a horizontally polarized wave receiving sensitivity characteristic of the slot antenna in FIG. 50.

FIG. 76 shows a horizontally polarized wave receiving sensitivity characteristic of the slot antenna having a slit at the bottom-left corner of the conductor loop (namely, like the slot antenna in FIG. 50), wherein the feeding point position is changed on the conductor. In FIG. 76, the dot-dash line I represents a sensitivity characteristic of the slot antenna where the feeding point is set to the top-right corner of the conductor, the dotted line II the sensitivity characteristic of the slot antenna where the feeding point is set to the upper end of the conductor at the slit cut at the bottom-left corner of the conductor, the dot-dash line III the sensitivity characteristic of the slot antenna where the feeding point is set to the left-hand side of the conductor, the solid line IV the sensitivity characteristic of the slot antenna where the feeding point is set to the lower end of the conductor at the slit cut at the bottom-left corner of the conductor, the two-dot chain line V the sensitivity characteristic for the slot antenna where the feeding point is set to the top-left corner of the conductor, and the dotted line VI the sensitivity characteristic of the slot antenna where the feeding point is set to the left-hand side of the conductor.

Figure 77B:
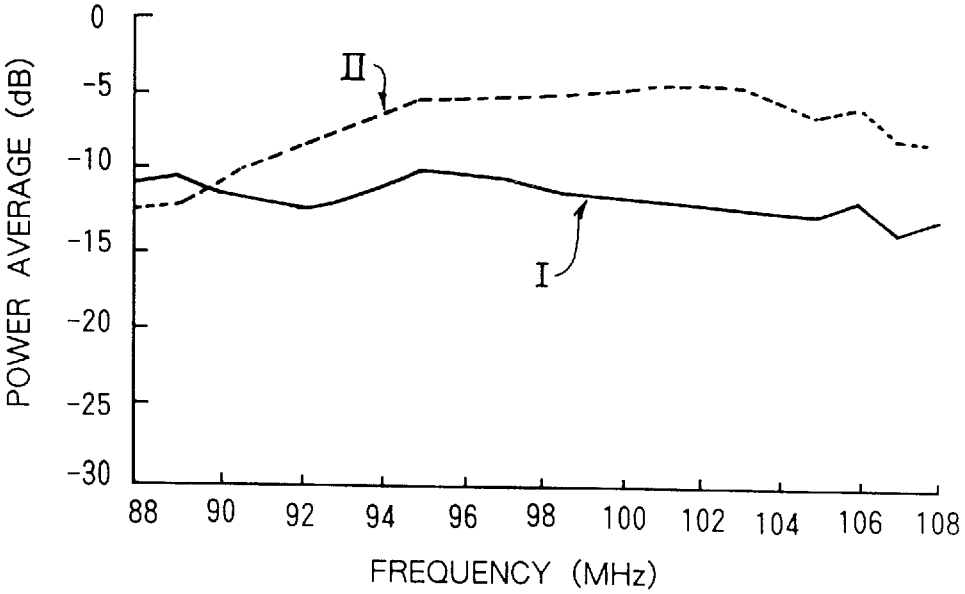
FIG. 77B shows a vertically polarized wave receiving sensitivity characteristic of the slot antenna in FIG. 77A, wherein the feeding point position was changed.
Figure 77A:
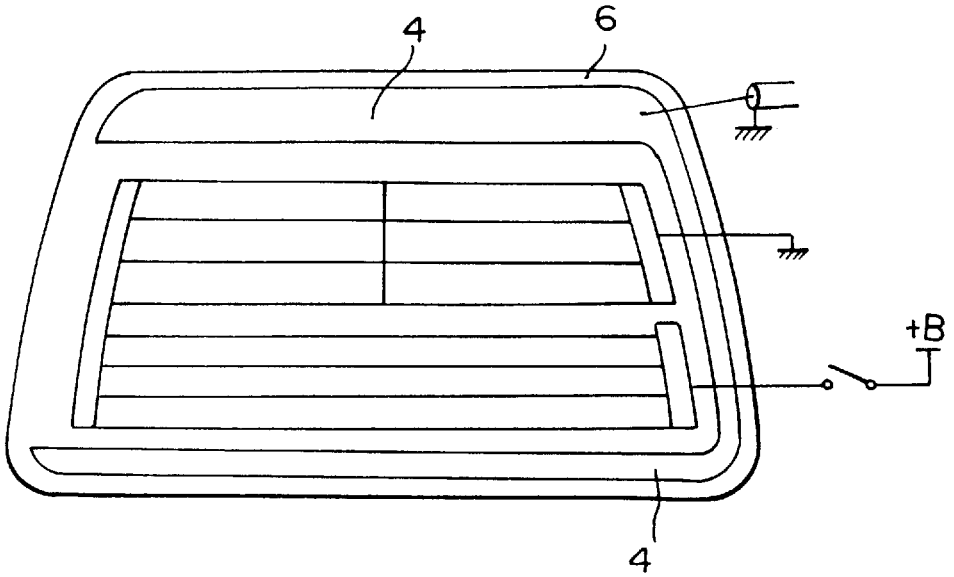
FIG. 77A shows a slot antenna setting that resulted in the test data presented in FIG. 77B.

FIG. 77B shows a vertically polarized wave receiving sensitivity characteristic of the slot antenna as shown in FIG. 77A, wherein a slot 6 is formed in a manner that surrounds a horizontally oriented U-shaped conductor 4 on a glass window with the top portion of the slot 25 mm wide, the right-hand side portion 15 mm wide and the bottom portion 40 mm wide. In FIG. 77B, the solid line I represents a sensitivity characteristic with the feeding point set to the top-right corner of the conductor 4, and the dotted line II represents a sensitivity characteristic with the feeding point set to the bottom-left corner of the connector. As seen from FIG. 76 and FIG. 77B, an improved sensitivity characteristic results if the conductor is fed at its top portion.

Figure 78A:
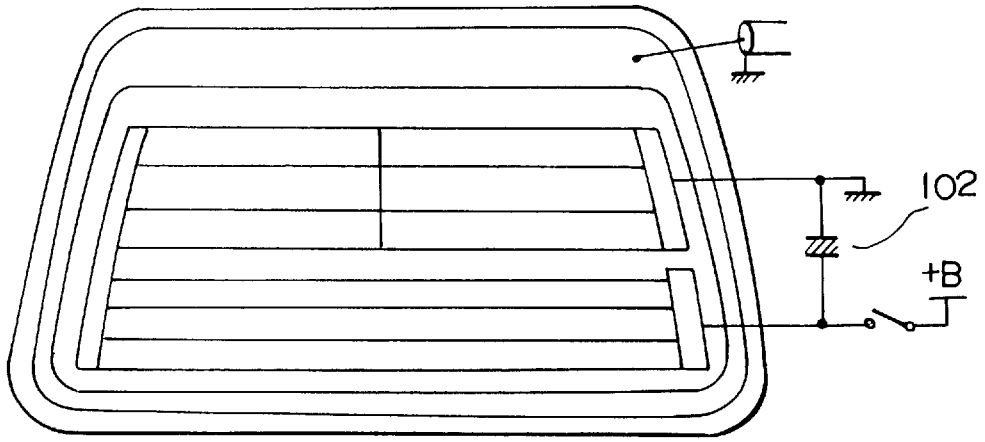
FIG. 78A shows a slot antenna setting that resulted in the test data presented in FIG. 78B.
Figure 78B:
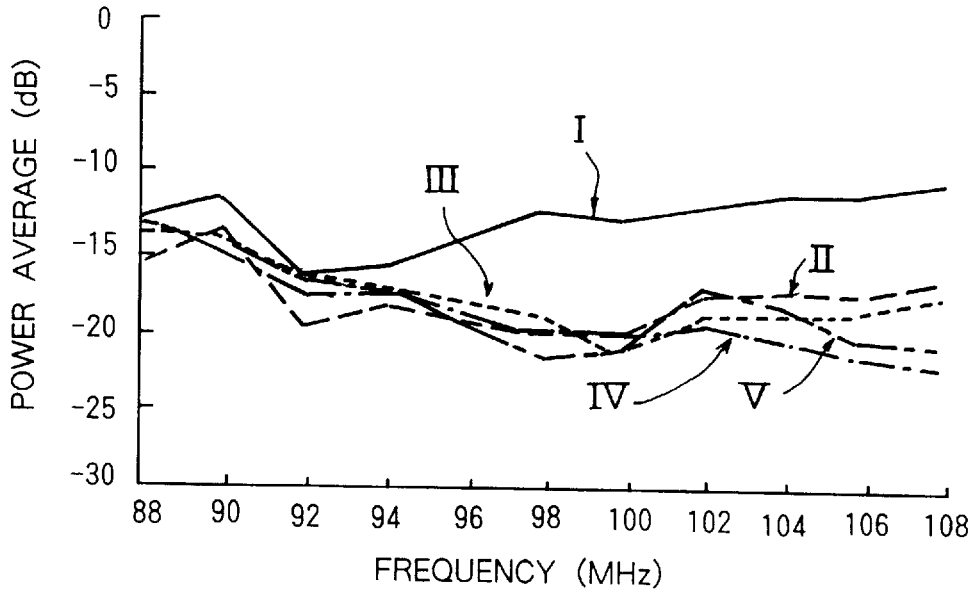
FIG. 78B shows a horizontally polarized wave receiving sensitivity characteristic of the slot antenna in FIG. 78A, wherein a plurality of feeding points were tested.
Figure 79:
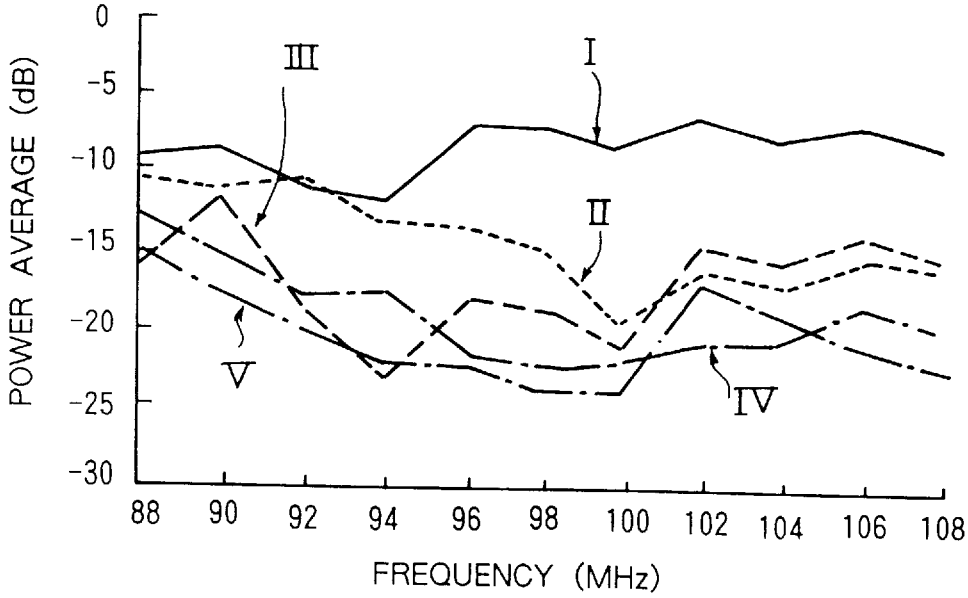
FIG. 79 shows a vertically polarized wave receiving sensitivity characteristic of the slot antenna in FIG. 78A.

FIG. 78B shows a horizontally polarized wave receiving sensitivity characteristic of the slot antenna comprising a complete conductor loop and a defogger with a filter capacitor 102 (like the slot antenna in FIG. 78A), wherein several different feeding points are tested. FIG. 79 shows a vertically polarized wave receiving sensitivity characteristic on the same slot antenna setting as above. In FIG. 78B and FIG. 79, the solid line I represents a sensitivity characteristic of the slot antenna with the feeding point set to the center of the top portion of the conductor, the line II represents a sensitivity characteristic of the slot antenna with the feeding point set to the top-left corner of the conductor, the line III represents a sensitivity characteristic of the slot antenna with the feeding point set to the top-right corner of the conductor, the line IV represents a sensitivity characteristic of the slot antenna with the feeding point set to the bottom-left corner of the conductor, and the line V represents a sensitivity characteristic of the slot antenna with the feeding point set to the bottom-right corner of the conductor. As seen from FIG. 78B and FIG. 79, a substantially improved sensitivity characteristic results if the conductor is fed at its top center, in particular.

Figure 80:
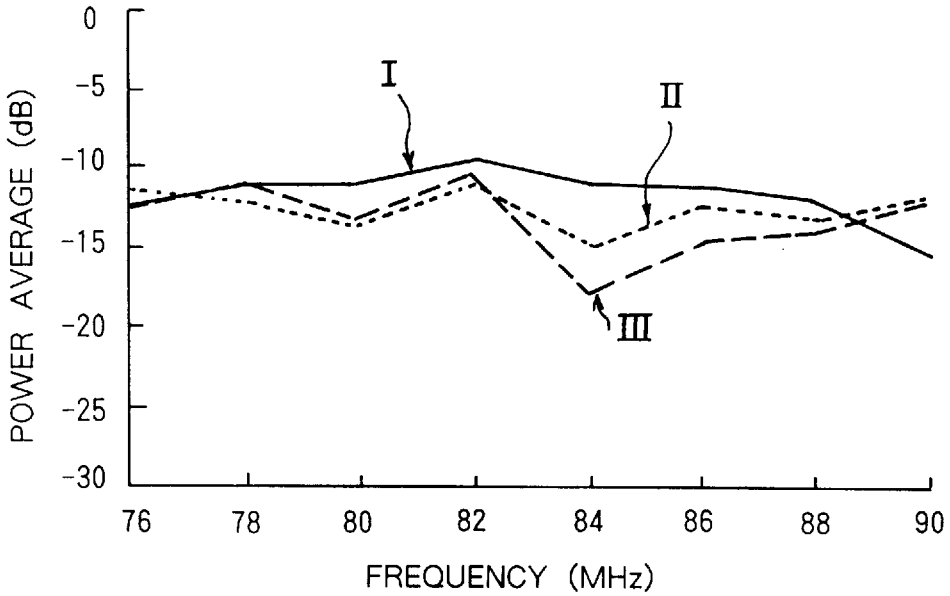
FIG. 80 shows a horizontally polarized wave receiving sensitivity characteristic of the slot antenna in FIG. 50, wherein the feeding point position was changed.

FIG. 80 shows a horizontally polarized wave receiving sensitivity characteristic of the slot antenna having a slit at the bottom-left corner of a conductor loop (like the slot antenna in FIG. 50), wherein several different feeding points are tested. In FIG. 80, the line I represents a sensitivity characteristic of the slot antenna with the feeding point set to the top-right corner of the conductor, the dotted line II represents a sensitivity characteristic of the slot antenna with the feeding point set to the top-left corner of the conductor, and the line III represents a sensitivity characteristic of the slot antenna with the feeding point set to the right-hand side of the conductor. As seen from FIG. 80, an increased sensitivity characteristic results if the feeding point is set to the top-right corner diagonally opposite from the slit.

Figure 81:
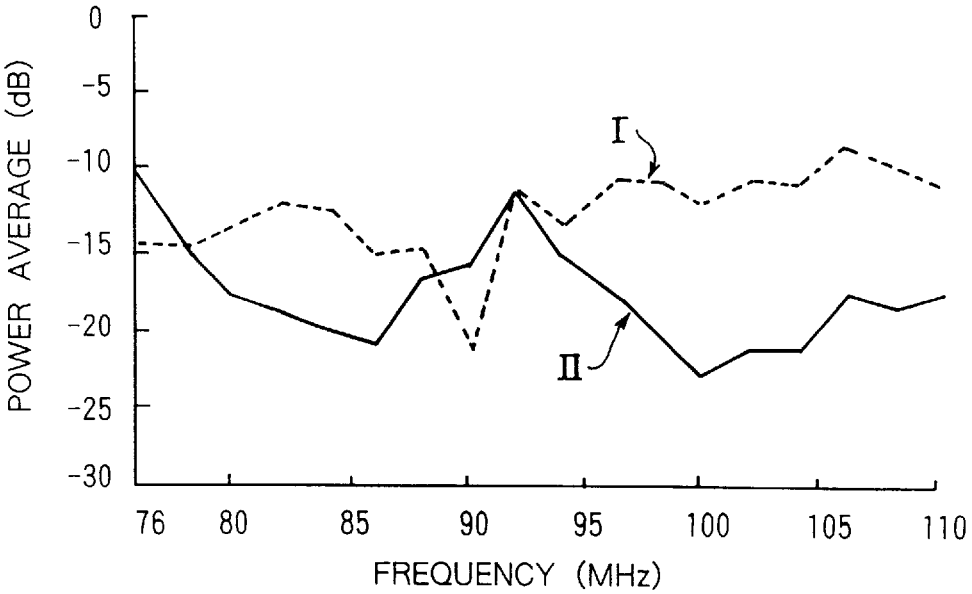
FIG. 81 shows a vertically polarized wave receiving sensitivity characteristic of the slot antenna in FIG. 50, wherein the feeding point was shifted to above or below the slit.
Figure 82:
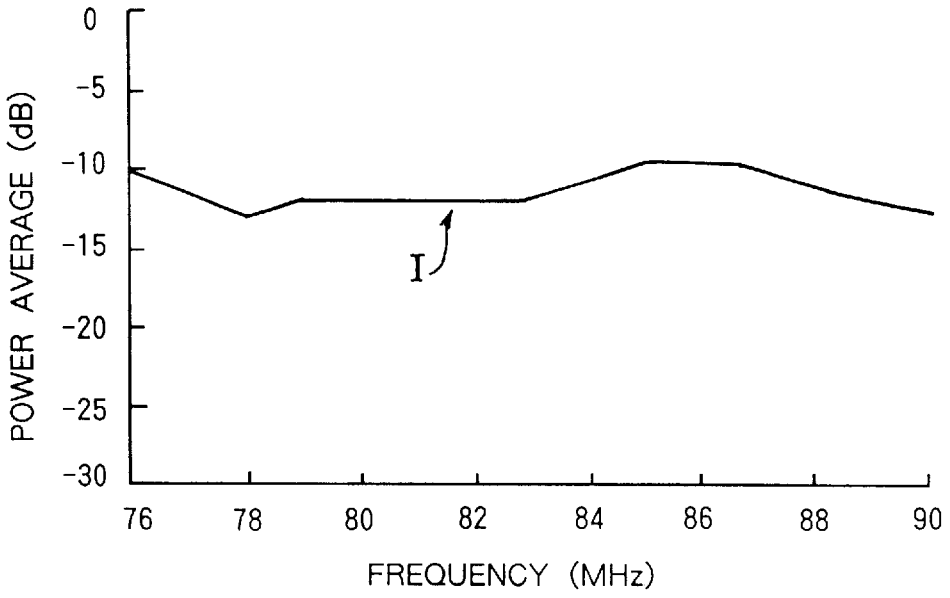
FIG. 82 shows a horizontally polarized wave receiving sensitivity characteristic of the slot antenna setting corresponding to FIG. 81.
Figure 83:
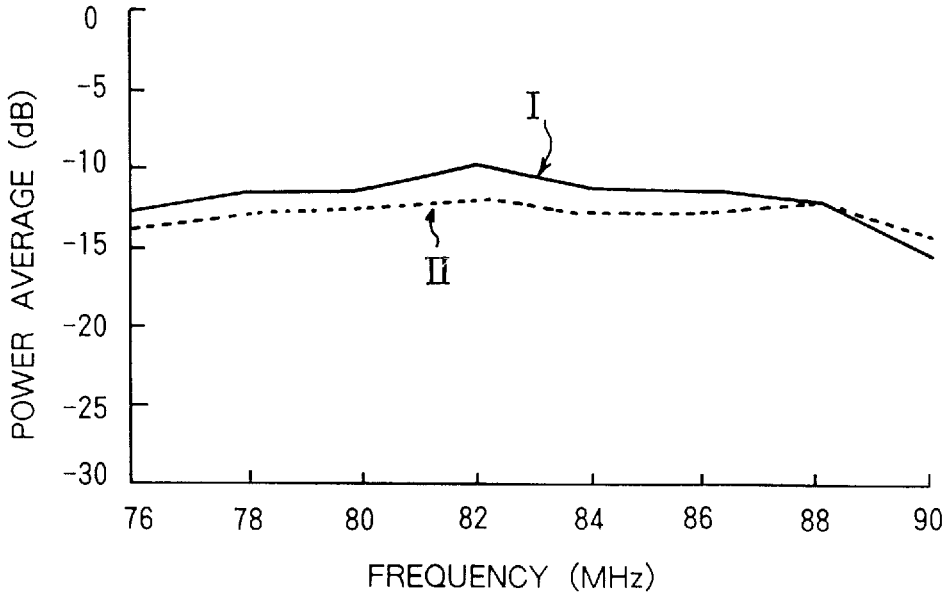
FIG. 83 shows a horizontally polarized wave receiving sensitivity characteristic of the slot antenna, wherein the number of feeding points was increased on the conductor.
Figure 84:
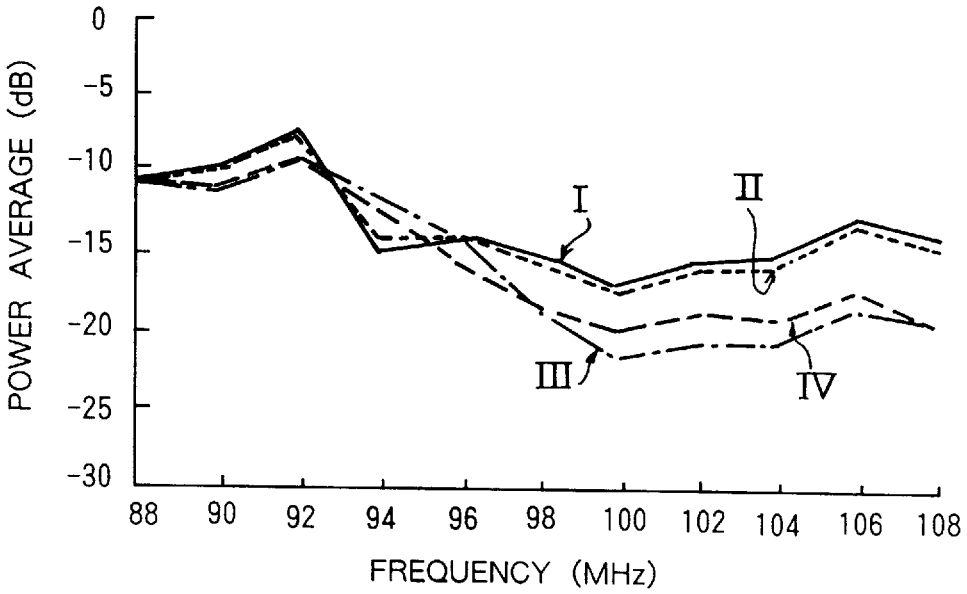
FIG. 84 shows a vertically polarized wave receiving sensitivity characteristic of the slot antenna setting corresponding to FIG. 83.

FIG. 81 shows a vertically polarized wave receiving sensitivity characteristic of the slot antenna having a slit at the bottom-left corner of a conductor loop, (namely, equivalent to the slot antenna in FIG. 50 except for the feeding point position), wherein the upper and lower ends of the conductor at the slit are tested. FIG. 82 shows a horizontally polarized wave receiving sensitivity characteristic of the same slot antenna setting as above. In FIG. 81 and FIG. 82, the line I represents a sensitivity characteristic of the slot antenna with the feeding point set to the upper end of the conductor at the slit, and the line II (only in FIG. 81) represents a sensitivity characteristic of the slot antenna with the feeding point set to the lower end of the conductor at the slit. As seen from FIG. 81 and FIG. 82, an increased receiving sensitivity characteristic in specific frequency range results when the feeding point is set to the upper end of the conductor rather than to the lower end of the conductor FIG. 83 shows a horizontally polarized wave receiving sensitivity characteristic of the slot antenna having a conductor loop (like the slot antenna in FIG. 38A), wherein the number of feeding points is changed. FIG. 84 shows a vertically polarized wave receiving sensitivity characteristic of the same slot antenna setting. In FIG. 83, the solid line I, as a reference, represents a sensitivity characteristic of the slot antenna with the feeding point set to the top-right corner of the conductor only, and the dotted line II represents a sensitivity characteristic of the slot antenna with two feeding points are set, one to the top-right corner and the other to the top-left corner. In FIG. 84, the solid line I represents a sensitivity characteristic of the slot antenna with the feeding point set to the top-right corner only, the dotted line II the sensitivity characteristic of the slot antenna where the feeding point is set to the top-right corner of the conductor and the conductor is terminated at its top-left corner, the dot-dash line III the sensitivity characteristic of the slot antenna with the feeding point set to the top-left corner, and the dotted line IV the sensitivity characteristic of the slot antenna where the feeding point is set to the top-left corner and the conductor is terminated at its top-right corner.

Figure 85:
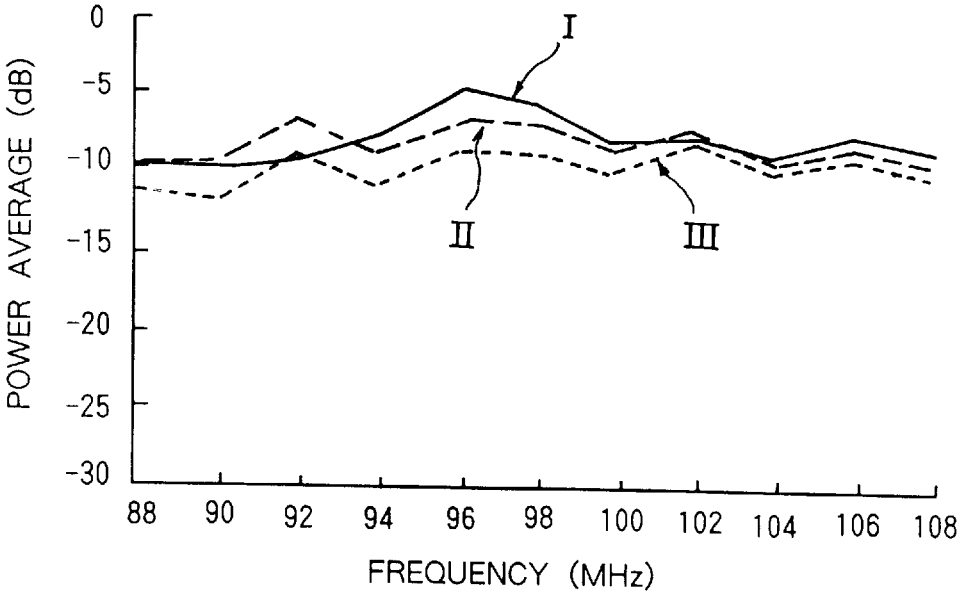
FIG. 85 shows a vertically polarized wave receiving sensitivity characteristic of the slot antenna, wherein the number of feeding points was increased on the horizontally oriented U-shaped conductor.

FIG. 85 shows a vertically polarized wave receiving sensitivity characteristic of the slot antenna having a slit at the bottom-left corner of the conductor (namely, the slot antenna in FIG. 50), wherein the number of feeding points is changed for test. The solid line I represents a sensitivity characteristic of the slot antenna with the feeding point set to the top-left corner of the conductor, the dotted line II the sensitivity characteristic of the slot antenna where two feeding points are set, one to the top-left corner and the other to the top-right corner of the conductor, and the dotted line III the sensitivity characteristic of the slot antenna where three feeding points are set, one to the top-left corner, one to the top-right corner and the other to the bottom-left corner of the conductor. As seen from FIG. 84 and FIG. 85, no substantial change takes place in the sensitivity characteristic even if the number of feeding points is increased.

FIG. 86 shows a horizontally polarized wave receiving sensitivity characteristic of the slot antenna having a conductor loop and two feeding points, one to its top-left corner and the other to the top-right corner of the conductor (namely, like the slot antenna in FIG. 11A). FIG. 87 shows a vertically polarized wave receiving sensitivity characteristic of the slot antenna setting as above. In FIG. 86 and FIG. 87, the solid line I represents a sensitivity characteristic of the slot antenna with the feeding point set to the top-right corner of the conductor, and the dotted line II the sensitivity characteristic of the slot antenna with the feeding point set to the top-left corner of the conductor.

Figure 88:
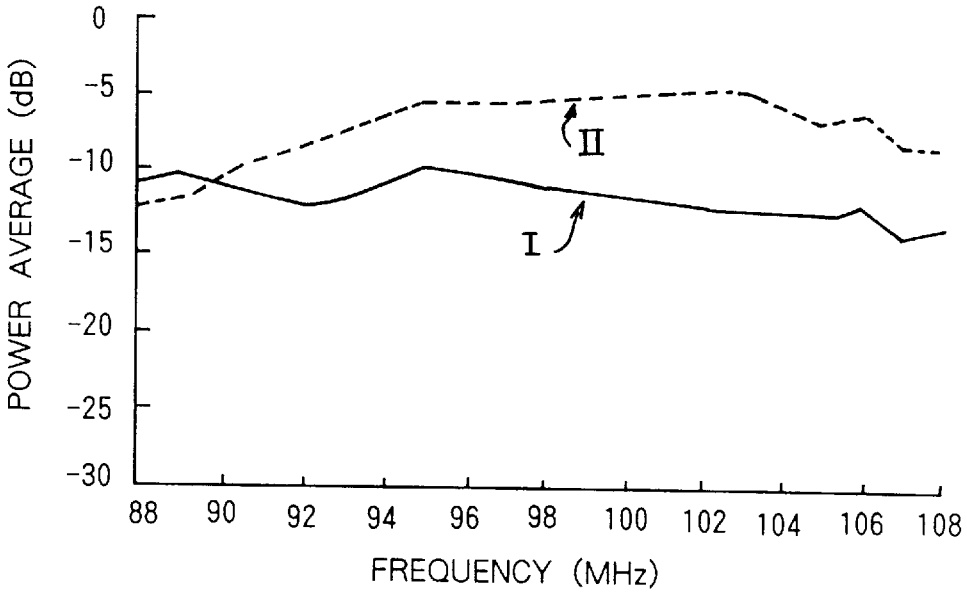
FIG. 88 shows a vertically polarized wave receiving sensitivity characteristic of the slot antenna in FIG. 78A, wherein the feeding point was set to each of the top-left and top-right corners of the conductor.
Figure 89A:
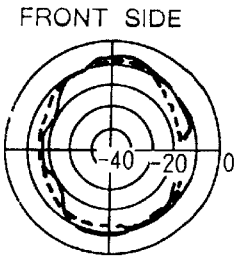
FIG. 89 shows a vertically polarized wave receiving sensitivity characteristic of the slot antenna setting corresponding to FIG. 88.
Figure 89B:
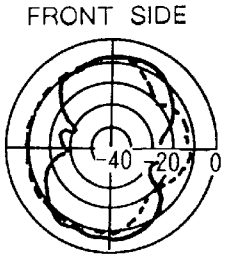
Figure 89C:
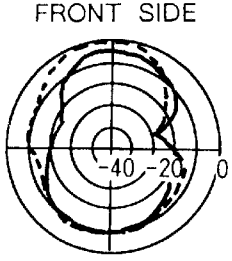
Figure 89D:
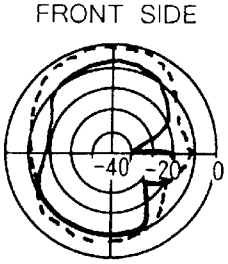
Figure 89E:
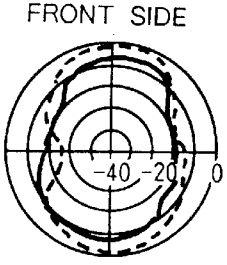
Figure 89F:
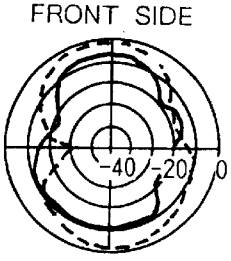
Figure 89G:
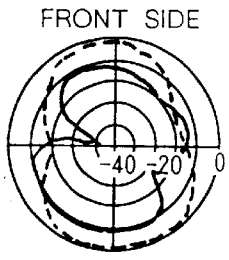
Figure 89H:
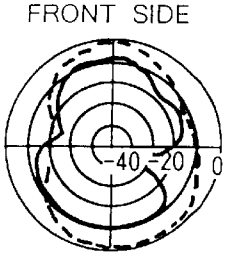
Figure 89I:
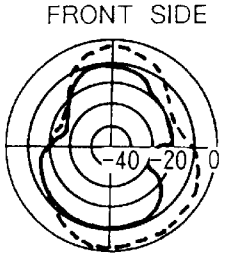
Figure 89J:
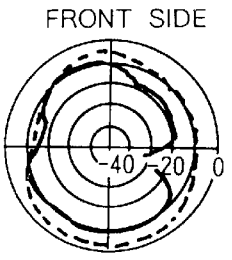
Figure 89K:
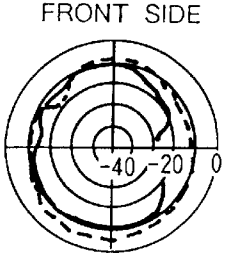

FIG. 88 shows a vertically polarized wave receiving sensitivity characteristic of the slot antenna in which a slot is formed in a manner that surrounds a horizontally oriented U-shaped conductor on a glass window with the top portion of the slot 25 mm wide, the right-hand side portion 15 mm wide and the bottom portion 40 mm wide (namely, like the slot antenna in FIG. 78A), wherein the feeding point is set to the top-left or top-right corner of the conductor. FIG. 89 shows a directivity pattern of the above slot antenna. In FIG. 88 and FIG. 89, the solid line I represents a sensitivity characteristic with the feeding point set to the top-right corner of the conductor, and the dotted line II represents a sensitivity characteristic with the feeding point set to the top-left corner of the connector. As seen from FIG. 88 and FIG. 89, an excellent space diversity reception is achieved by making directivity symmetrical with left-right symmetrical feeding when a diversity antenna is intended by feeding the antenna at two points.

Effect of Grounding on Test Data

Figure 90:
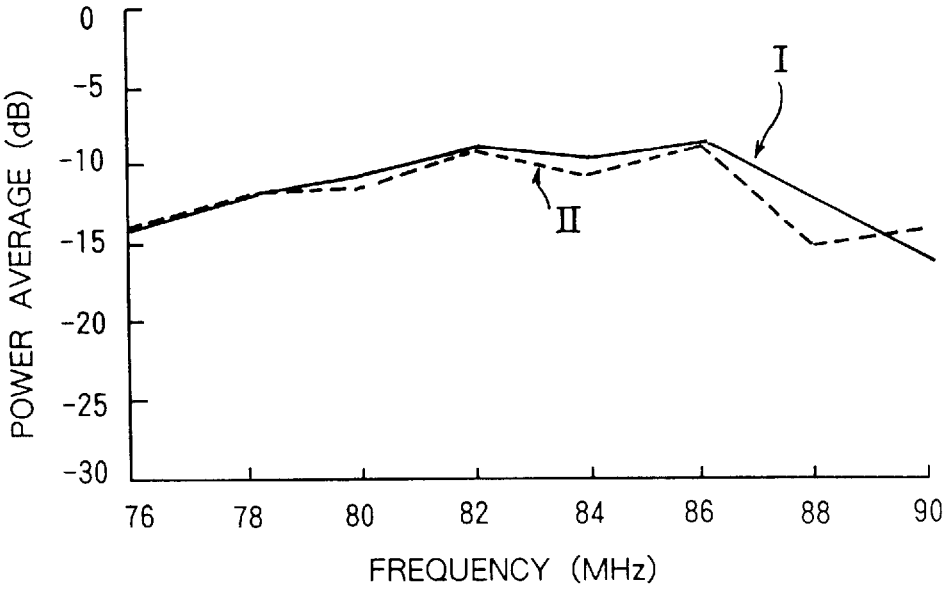
FIG. 90 shows a horizontally polarized wave receiving sensitivity characteristic of the slot antenna, wherein an ungrounded type loop antenna made of 1 mm diameter copper wire is placed in the slot portion surrounding the conductor of copper sheet.

FIG. 90 shows a horizontally polarized wave receiving sensitivity characteristic (as represented by the dotted line II) of the slot antenna (like the slot antenna in FIG. 10) having a conductor made of copper sheet and an ungrounded-type loop antenna of a 1 mm diameter copper wire mounted in the slot that surrounds the conductor, wherein the loop antenna is grounded. The solid line I shows a sensitivity characteristic of the slot antenna without loop antenna. Both lines presents substantially identical results.

The foregoing description of the present invention has been presented for the purposes of illustration only, and various modifications and changes may be made without departing from the nature and scope of the present invention. The scope of the present invention is solely determined by the appended claims.

What is claimed is:

1. A vehicle-mounted antenna, comprising:

a window glass fitted into an opening of a vehicle body;

a defogger having a plurality of heater lines mounted on the window glass;

a planar conductor provided in a peripheral region of the window glass, the peripheral region surrounding the defogger;

a conductive wire intersecting the plurality of heater lines, the conductive wire being provided in a central region of the defogger in a vehicle body width direction;

a slot portion formed on the window glass in a space between the vehicle body and the planar conductor; and a feeder line coupled to the vehicle body and the planar conductor, wherein said antenna functions as a slot type antenna which emits radio wave from the slot portion by capacitive coupling of the planar conductor and the defogger.

2. The antenna according to claim 1, wherein said planar conductor functions as a planar uniform conductor.

3. The antenna according to claim 1, further comprising a conductor other than the defogger provided at a peripheral region of an area in which the defogger is provided on the window glass.

4. The antenna according to claim 3, wherein the other conductor is capacitively coupled to the defogger.

5. A vehicle-mounted antenna, comprising:

a window glass fitted into an opening of a vehicle body;

a defogger mounted on the window glass;

a planar conductor mounted on the window glass, the planar conductor being provided so as to surround a peripheral region of an area in which the defogger is provided on the window glass;

a slot portion disposed between the planar conductor and the body of the vehicle, wherein feeding is performed to both the conductor and the body;

a feeder coupled to the vehicle body and the planar conductor; and a slit formed on the planar conductor in a space, wherein said antenna functions as a slot type antenna which emits radio wave from the slot portion by a capacitive coupling of the planar conductor and the defogger.

6. The antenna according to claim 5, wherein said planar conductor functions as a planar uniform conductor.

7. The antenna according to claim 6, wherein part of said planar conductor functions as a sunshade for screening sunlight.

8. The antenna according to claim 6, wherein a space or a cutout is formed in the planar conductor to allow a mobile telephone antenna within.

9. The antenna according to claim 6, wherein an upper portion of the planar conductor functions more as a planar conductor than a lower portion of the conductor.

10. The antenna according to claim 5, wherein a capacitor of a predetermined capacitance is coupled between the defogger and the planar conductor.

11. The antenna according to claim 10, wherein a feeding point is set to the planar conductor near the junction where the capacitor is connected to the planar conductor.

12. The antenna according to claim 5, wherein a choke coil is coupled to the defogger.

13. The antenna according to claim 12, wherein a capacitor is coupled between a junction of the choke coil with the defogger and ground.

14. The antenna according to claim 5, wherein a coil is coupled between the defogger and the planar conductor.

15. The antenna according to claim 5, wherein the slit is formed through the planar conductor.

16. The antenna according to claim 15, wherein said slit has a predetermined width.

17. A method for designing an antenna according to claim 16, wherein the antenna's maximum sensitivity frequency is adjusted by increasing or decreasing the width of the slit.

18. A method for designing an antenna according to claim 15, wherein the antenna's maximum sensitivity frequency is adjusted by shifting the slit in position on the planar conductor.

19. The antenna according to claim 15, wherein a feeding point is set to a position diagonally opposite from the slit on the on the planar conductor.

20. The antenna according to claim 15, wherein a feeding point is set to the upper end of the planar conductor at the slit of the planar conductor.

21. The antenna according to claim 5, wherein a feeding point is set to the top portion of the planar conductor.

22. The antenna according to claim 5, wherein a plurality of feeding points are provided to the planar conductor.

23. The antenna according to claim 22, wherein the plurality of feeding points are set in symmetrical positions with respect to the center across the planar conductor so that the antenna functions as a diversity antenna.

24. The antenna according to claim 5 further comprising an ungrounded antenna having a transformer made of a primary coil and a secondary coil, whereby said ungrounded antenna functioning as a slot type antenna is connected to the feeder side of the secondary coil.

25. The antenna according to claim 5, wherein the defogger is provided with one or more conductors.

* * * * *

UNITED STATES PATENT AND TRADEMARK OFFICE

CERTIFICATE OF CORRECTION

PATENT NO.: 5,831,580
DATED : November 3, 1998
INVENTOR(S): Tatsuaki Taniguchi, et al.

It is certified that error appears in the above-identified patent and that said Letters Patent is hereby corrected as shown below:

Column 13, line 17, change "end" to --ends--;

Column 14, line 8, change "Fig. 1A" to --Fig. 11A--;

Column 22, line 23, change "Fig. 74" (second occurrence) to --Fig. 75--;

Column 26, line 31, (claim 19), delete "on the" (second occurrence).

Signed and Sealed this

Tenth Day of August, 1999

*Attest:*

Q. TODD DICKINSON

*Attesting Officer*

*Acting Commissioner of Patents and Trademarks*